US006222518B1

(12) United States Patent
Ikeda et al.

(10) Patent No.: US 6,222,518 B1
(45) **Date of Patent: *Apr. 24, 2001**

(54) LIQUID CRYSTAL DISPLAY WITH LIQUID CRYSTAL DRIVER HAVING DISPLAY MEMORY

(75) Inventors: Makiko Ikeda; Tsutomu Furuhashi, both of Yokohama; Hiroyuki Nitta, Fujisawa; Isao Takita, Fujisawa; Naruhiko Kasai, Fujisawa; Satoru Tsunekawa, Higashimurayama; Tatsuhiro Inuzuka, Yokohama, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/972,972

(22) Filed: Nov. 19, 1997

Related U.S. Application Data

(63) Continuation of application No. 08/297,058, filed on Aug. 29, 1994, now Pat. No. 5,815,136.

(30) Foreign Application Priority Data

Aug. 30, 1993 (JP) ..... 5-213733
Dec. 20, 1993 (JP) ..... 5-320074

(51) Int. Cl.[7] ..... G09G 3/36

(52) U.S. Cl. ..... 345/98; 345/100

(58) Field of Search ..... 345/87, 98, 99, 345/100, 213, 204, 89, 95, 211, 34, 35, 41, 42

(56) References Cited

U.S. PATENT DOCUMENTS 5,307,085 4/1994 Nakamura ..... 345/200
5,321,811 6/1994 Kato et al. ..... 345/98
5,396,297 3/1995 Shindou et al. ..... 345/200

(List continued on next page.)

FOREIGN PATENT DOCUMENTS 5-210356 8/1993 (JP) .

OTHER PUBLICATIONS

U.S. application Ser. No. 07/953,807 filed on Sep. 30, 1992.
"HM62256 Series", *Hitachi IC Memory Data Book No. 1—SRAM, SRAM Module, PSRAM, As Memory and ECL RAM*, 11th Edition, pp. 269–282, published by Worldwide Product Marketing Operations, Semiconductor and IC Div., Hitachi, Ltd., Japan, in Feb. 1994.

(List continued on next page.)

*Primary Examiner*—Chanh Nguyen
(74) *Attorney, Agent, or Firm*—Antonelli, Terry, Stout & Kraus, LLP

(57) ABSTRACT

An information processing system includes a bus; a display data generating circuit coupled to the bus for generating display data in a form of a plurality of bits for each of a plurality of pixels of a display panel; and a display apparatus coupled to the bus. The display data generating circuit includes a central processing unit and a memory. The display apparatus includes a display panel including a plurality of data lines and a plurality of scanning lines in a matrix form with pixels formed at intersections of the data lines and the scanning lines, the display panel being capable of displaying a grayscale image in accordance with the display data in a form of a plurality of bits for each of a plurality of pixels of a display panel; a signal driver for supplying driving voltages corresponding to the display data to at least a part of the plurality of data lines to display an image, the signal driver including a display memory for storing the display data and being constructed in an integrated circuit; and a scanning driver for scanning the plurality of scanning lines. The display data generating circuit transfers the display data via the bus to the display memory.

1 Claim, 57 Drawing Sheets

U.S. PATENT DOCUMENTS

| | | | | |
|---|---|---|---|---|
| 5,412,777 | | 5/1995 | Wakimoto | 345/200 |
| 5,523,773 | * | 6/1996 | Arakawa et al. | 345/98 |

OTHER PUBLICATIONS

"HD66108 (RAM–Provided 165–Channel LCD Driver for Liquid Crystal Dot Matrix Graphics)", *Hitachi LCD Controller/Driver LSI Data Book*, pp. 638–690, published by Hitachi, Ltd., Japan, prior to Aug. 29, 1994.

"HD66107T (LCD Driver for High Voltage)", *Hitachi LCD Contoller/Driver LSI Data Book*, pp. 787–806, published by Hitachi, Ltd., Japan, prior to Aug. 29, 1994.

* cited by examiner

ADDRESS BUS
DISPLAY DATA BUS
CONTROL SIGNAL BUS
COL. ADDRESS DECODER
I/O PORT
MEMORY CELL
LATCH
LEVEL SHIFTER
VOLTAGE SELECTOR
COL. ADDRESS LATCH COUNTER
ROW ADDR. LATCH COUNT.
TIMING CONTROL CIRCUIT
BUFFER UNIT
RAS
101
102
103
104
105-1
106-1
107-1
108-1
109-1
110-1
111-1
112-1
113-1
114-1
115-1
116-1
117-1
118-1
119-1
120-1
121-1
122-1
123-1
124-1
125-1
126-1
127-1
128-1
105-2
106-2
107-2
108-2
109-2
110-2
111-2
112-2
113-2
114-2
115-2
116-2
117-2
118-2
119-2
120-2
121-2
122-2
123-2
124-2
125-2
126-2
127-2
128-2
129
A
B
C

ACCESS USING CHIP SELECTING FUNCTION

FIG.15

MEMORY MAP OF MEMORY CELL 120

COLUMN LOW

| | | | | |
|---|---|---|---|---|
| (hex0,hex0) | (hex1,hex0) | ------- | (hex12,hex0) | (hex13,hex0) |
| (hex0,hex1) | (hex1,hex1) | ------- | (hex12,hex1) | (hex13,hex1) |
| ⋮ | ⋮ | | ⋮ | ⋮ |
| (hex0,hexEE) | (hex1,hexEE) | ------- | (hex12,hexEE) | (hex13,hexEE) |
| (hex0,hexEF) | (hex1,hexEF) | ------- | (hex13,hexEF) | (hex13,hexEF) |

FIG.32A

SCREEN MEMORY MAP SEEN FROM CPU

X-DIRECTION

Y-DIRECTION

DRIVER | DRIVER

SCANNING CIRCUIT

| | | | | | | | | | |
|---|---|---|---|---|---|---|---|---|---|
| 00000H | 00001H | | 00026H | 00027H | 00028H | 00029H | | 0004EH | 0004FH |
| 00100H | 00001H | | 00126H | 00127H | 00128H | 00129H | | 0014EH | 0014FH |
| | | | | | | | | | |
| | | | | | | | | | |
| | | | | | | | | | |
| | | | | | | | | | |
| 0EE00H | 0EE01H | | 0EE26H | 0EE27H | 0EE28H | 0EE29H | | 0EE4EH | 0EE4FH |
| 0EF00H | 0EF01H | | 0EF26H | 0EF27H | 0EF28H | 0EF29H | | 0EF4EH | 0EF4FH |

FIG.32B

DRIVER MEMORY MAP SEEN FROM DRIVER

COLUMN

LOW

DRIVER | DRIVER

SCANNING CIRCUIT

| | | | | | | | | | |
|---|---|---|---|---|---|---|---|---|---|
| 0000H | 0001H | | 0026H | 0027H | 0000H | 0001H | | 0026H | 0027H |
| 0040H | 0041H | | 0066H | 0067H | 0040H | 0041H | | 0066H | 0067H |
| | | | | | | | | | |
| | | | | | | | | | |
| | | | | | | | | | |
| | | | | | | | | | |
| 3B80H | 3B81H | | 3BA6H | 3BA7H | 3B80H | 3B81H | | 3BA6H | 3BA7H |
| 3BC0H | 3BC1H | | 3BE6H | 3BE7H | 3BC0H | 3BC1H | | 3BE6H | 3BE7H |

FIG.33
DRIVER ADDRESS MODE
| MODEA2 | MODEA1 | MODEA0 | DRIVER 1D |
|---|---|---|---|
| 0 | 0 | 0 | 0 |
| 0 | 0 | 1 | 1 |
| 0 | 1 | 0 | 2 |
| 0 | 1 | 1 | 3 |
| 1 | 0 | 0 | 4 |
| 1 | 0 | 1 | 5 |
| 1 | 1 | 0 | 6 |
| 1 | 1 | 1 | 7 |
FIG.34
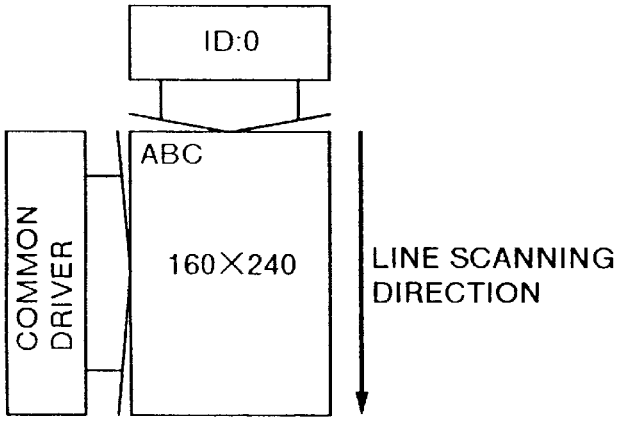
FIG.35
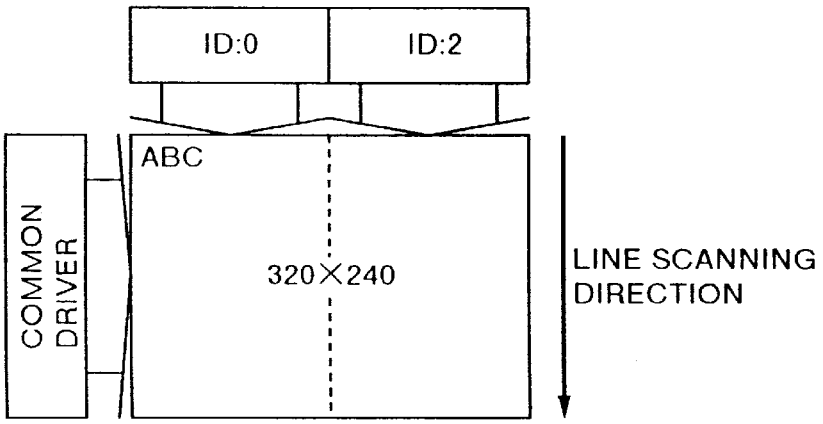

MEMORY PAGE MODE READ CYCLE

MEMORY PAGE MODE EARLY-WRITE CYCLE

MEMORY PAGE MODE DELAYED-WRITE CYCLE

LIQUID CRYSTAL DISPLAY WITH LIQUID CRYSTAL DRIVER HAVING DISPLAY MEMORY

CROSS-REFERENCE TO RELATED APPLICATION

This application is a continuation of application Ser. No. 08/297,058 filed on Aug. 29, 1994, now U.S. Pat. No. 5,815,136.

BACKGROUND OF THE INVENTION

The present invention relates to a liquid crystal driver which has an internal memory and a liquid crystal display which uses such a driver.

In a liquid crystal display connected to a computer, there is performed an operation in which an image is always displayed on a display screen. The image display operation is performed in such a manner that a liquid crystal driver on the liquid crystal display side successively reads display data from a display memory (or makes a display access) and supplies the read data to a liquid crystal panel at a predetermined period. In the case where there is a command from a computer side for rewriting or change and addition of display data (hereinafter referred to as updating), it is necessary to update data of the display memory (or make an updating access). Since the display data updating operation (or updating access) is not synchronous with the display operation on the liquid crystal display side and is not periodical, there may be the case where an access to the display memory for the display operation and an access to the display memory for the updating of data conflict with each other. In general, the display operation cannot be interrupted and has a preference to the updating operation. Therefore, it is necessary to change the contents of the display memory so that the updating operation does not obstruct the display operation.

The conventional liquid crystal display is constructed using, for example, a liquid crystal driver HD66107T disclosed in *Hitachi LCD Controller/Driver LSI Data Book,* pp. 787–806, published by Hitachi, Ltd. Such a conventional liquid crystal driver will be explained by use of FIGS. 2 to 5.

In FIG. 2, reference numeral 201 denotes a control signal bus for transferring a control signal, and numeral 202 denotes a data bus for transferring display data. Numerals 203-1 and 203-2 denote liquid crystal drivers. In the shown example, two liquid crystal drivers are used in conformity with the width of a liquid crystal panel 219 in an X (or horizontal) direction. The liquid crystal drivers 203-1 and 203-2 will hereinafter be represented generically as "liquid crystal driver 203". (Similar representation will be used for other reference numerals.) Numeral 204 denotes a timing control circuit for controlling the operation of the liquid crystal driver 203, and numeral 205 denotes a shift register for generating a signal which latches display data transferred by the data bus 202. Numeral 206 denotes a signal line for transferring latch clocks outputted from the shift register 205, numeral 207 a latch for successively taking in display data, numeral 208 a data bus for transferring data outputted from the latch 207, numeral 209 a latch for simultaneously taking in data transferred by the data bus 208, and numeral 210 a data bus for transferring data outputted from the latch 209. Numeral 211 denotes a level shifter for shifting display data transferred by the data bus 210 into a voltage level corresponding to a liquid crystal applied voltage (or a voltage to be applied to the liquid crystal of a liquid crystal panel). Numeral 212 denotes a data bus for transferring the level-shifted data, and numeral 213 denotes a voltage selector. Numeral 214 denotes an output voltage line for transferring a liquid crystal applied voltage which is selected by the voltage selector 213 in accordance with display data transferred through the data bus 212. Numeral 215 denotes a CL2 clock signal for controlling the shift register 205, and numeral 216 denotes a CL1 clock signal for taking data into the latch 209. Numeral 217 denotes a scanning circuit for selecting a line on which display is to be made. Numeral 218 denotes a scanning signal line for transferring a scanning signal generated by the scanning circuit 217, and numeral 219 denotes the display panel. Numeral 220 denotes a power supply circuit, and numerals 221 and 222 denote driving voltage lines for transferring driving voltages which drive the scanning circuit 217 and the liquid crystal driver 203, respectively.

FIG. 3 shows a block diagram of an example of a personal computer system using the liquid crystal display shown in FIG. 2. In the shown example, a display memory 307 is arranged at the exterior of the liquid crystal driver 203.

In FIG. 3, reference numeral 301 denotes a CPU, numeral 302 a main memory, numeral 303 an address bus for transferring an address, numeral 304 a data bus for transferring data, and numeral 305 a control signal bus for transferring a control signal. Numeral 306 denotes a display controller, and numeral 307 denotes the display memory for storing display data therein. Numeral 308 denotes a timing control circuit, and numeral 309 denotes a timing signal which includes a signal for accessing the display memory 307 and a signal for operating the liquid crystal driver 208. Numeral 310 denotes a selection signal for making a change-over between a display address (or address for display) and an updating address (or address for updating). Numeral 311 denotes a controller for generating a timing signal to be transferred to a signal bus 312 and an address to be transferred to a display address bus 313. Numeral 314 denotes a selector for selecting a display address and an updating address, numeral 315 an address bus for transferring an address selected by the selector 314 for accessing the display memory 307, and numeral 316 a data buffer. Numeral 317 denotes a data bus for transferring data for accessing the display memory 307, and numeral 318 denotes a data bus for transferring display data for the liquid crystal display.

FIG. 4 is a timing chart showing an access to the display memory 307 in the system shown in FIG. 3.

FIG. 5 is a timing chart showing the operation of the liquid crystal driver 203.

The liquid crystal display using the conventional liquid crystal driver will be explained using FIG. 2 again.

A control signal transferred through the signal bus 201 is inputted to the timing control circuit 204. A generated CL2 clock signal 215 is transferred to the shift register 205 which in turn generates a latch clock. The generated latch clock signal is outputted to the signal line 206. On the other hand, display data transferred through the data bus 202 to the driver 203 is successively latched by the latch 207 in accordance with the latch clock signal transferred through the signal line 206. The display data latched by the latch 207 is simultaneously stored into the latch 209 through the data bus 208 in accordance with a CL1 clock signal 216. This operation is shown in FIG. 5. Also, display data outputted from the latch 209 by the CL1 clock signal is inputted through the data bus 210 to the level shifter 211 for conversion thereof into a voltage level corresponding to a liquid crystal applied voltage. The level-shifted display data is transferred through the data bus 212 to the voltage selector 213 which in turn selects a liquid crystal applied voltage. The selected liquid crystal applied voltage is supplied through the output voltage line 214 to the liquid crystal panel 219.

Thus, the conventional liquid crystal driver has only a function of latching display data and outputting it after conversion into a liquid crystal applied voltage. This point will be explained in detail by use of FIG. 3 in conjunction with the system using the liquid crystal display driven by the conventional liquid crystal driver 203.

In the conventional system, it is necessary to transfer display data to the liquid crystal display at a fixed period. Therefore, the system requires the display memory 307 for storing display data for one screen, means for reading display data from the display memory 307 to output the read display data to the liquid crystal display, and means for updating display data to be stored in the display memory 307. Since only one system is provided for the address bus 317, the data bus 317 and the control signal 309 for the display memory 307, it is necessary that a display access for reading display data to output the read display data to the liquid crystal display and an updating access for updating display data should be made to the display memory 307 in a time division or multiplexing manner, as shown in FIG. 4. Therefore, the conventional system is constructed as follows.

The address bus 315 is constructed such that a display address or updating address is transferred to the address bus 315 in such a manner that the address bus 313 for transferring an address for the display access and the address bus 303 for transferring an address for the updating access are changed over by the selector 314. The change-over control is performed by the timing control circuit 308. The timing control circuit 308 is inputted with a control signal from the CPU 301 through the control signal bus 305 and a control signal from the controller 311 through the control signal bus 312. The two control signals perform an arbitration control which determines whether the display access or the updating access is to be made to the display memory 307. The similar holds for the data bus. Namely, in the case of the display access, the data bus 317 is constructed such that data on the data bus 317 is transferred to the data bus 318 through the buffer 316. In the case of the updating access, data on the data bus 304 is transferred to the data bus 317 through the buffer 316.

A liquid crystal driver HD66108 with internal display memory, in which a display memory is incorporated in the liquid crystal driver, has been disclosed in *Hitachi LCD Controller/Driver LSI Data Book,* pp. 638–690, published by hitachi, Ltd. A liquid crystal display system using such a liquid crystal driver with internal memory will now be explained by use of a block diagram shown in FIG. 6.

In FIG. 6, reference numeral 601 denotes a liquid crystal driver, numeral 602 a data bus, and numeral 603 a control signal. Numeral 604 denotes an address register, numeral 605 an X coordinate value register, numeral 606 a Y coordinate value register, numeral 607 a data bus for outputting an X coordinate value, and numeral 608 a data bus for outputting a Y coordinate value. Numeral 609 denotes an X coordinate value decoder, numeral 610 a Y coordinate value decoder, and numeral 611 an X coordinate value decode signal. Numeral 612 denotes an I/O port for controlling the input/output of display data, numeral 613 a data bus for transferring display data, and numeral 614 a Y coordinate value decode signal. Numeral 615 denotes a memory cell (which may be a static RAM), and numeral 616 denotes a data bus for transferring data for display. Numeral 617 denotes a latch, numeral 618 a data bus for transferring display data outputted from the latch 617, numeral 619 a level shifter, numeral 620 a data bus for transferring the level-shifted data, numeral 621 a voltage selector, and numeral 622 an output voltage line for transferring a liquid crystal applied voltage. Numeral 623 denotes a timing control circuit.

Next, explanation will be made of the operation of the liquid crystal driver 601.

Since the liquid crystal driver 601 uses access based on an I/O interface, the address of a register to be accessed is set into the address register 604 through the data bus 602 and the register of the address set in the address register 604 is accessed through the data bus 602. Accordingly, the updating access to the display memory is as follows. First, the address of the X coordinate value register 605 is set into the address register 604. Next, X coordinate value data to be subjected to updating is set into the X coordinate value register 605 through the data bus 602 in accordance with the address set in the address register 604. Next, the address of the Y coordinate value register 606 is set into the address register 604 and Y coordinate value data to be subjected to updating is set into the Y coordinate value register 606 through the data bus 602 in accordance with the address set in the address register 604. Next, the I/O port 612 is accessed, thereby making it possible to update data at any position in the memory cell 615. Data in the memory cell 615 for data lines of each liquid crystal driver 601 is read by the timing control circuit 623 and is stored into the latch 617. Thereafter, a voltage conversion is made by the level shifter 619 and a liquid crystal applied voltage is selected by the voltage selector 621 which in turn outputs the selected liquid crystal applied voltage. This control for reading of data from the memory cell 615 is made for every one horizontal period, thereby enabling the display on the liquid crystal display 219.

Thus, it becomes possible to update data of the memory cell 615 at any position by setting data of each register of the liquid crystal driver 601.

In the prior art shown in FIG. 3, the liquid crystal driver always takes in serialized display data, converts the data into a liquid crystal applied voltage after taking-in of display data for one horizontal line, and outputs the liquid crystal applied voltage to effect the display. Therefore, means for transferring the serialized display data to the liquid crystal driver is needed. In the prior art shown in FIG. 3, display data for one frame is stored in the display memory. Provided that the operating conditions of the liquid crystal panel are such that the frame frequency is 70 Hz, the resolving power of the liquid crystal panel is 240 in the number of vertical lines and 320 in the number of horizontal dots and the data bus width of the liquid crystal driver and the display memory is a 8-bit bus, it is necessary to always read 8-bit data from the display memory at a period of about 0.7 MHz (=70 (Hz)×240 (lines)×320 (dots)+8 (bits)). Accordingly, the display controller, the display memory and the liquid crystal driver must operate at the period of about 0.7 MHz and this operation muse be repeated for each frame even if a displayed image is a still picture.

The power consumption of the liquid crystal display and system increases in proportion to the operating frequency. Therefore, in order to attain a reduction in power consumption, it is necessary to reduce the operating frequency without deteriorating the operating efficiency of the system.

In the prior art shown in FIG. 3, the display access and the updating access are made to the display memory in a multiplexing manner. Since the display access has a preference to the updating access, it is necessary to perform the updating access in the intervals of the display access. Therefore, even in the case where it is desired to perform an updating processing at a high speed, the display access imposes a restriction on a processing speed for the updating access.

In the prior art shown in FIG. 6, when the display access is made to the display memory, a "BUSY" is given to the CPU to take a wait. In actual, the address register 604 has a "BUSY" bit and the CPU reads the "BUSY" bit (or makes a busy check) to make arbitration between the display access and the updating access. Thereby, in the case where the display and updating accesses to the display memory conflict with each other, the speed of the updating access becomes low. Also, when display data at any position is to be updated, the updating of display data becomes possible after the register data setting has been made four times, as mentioned above. Therefore, a considerable time is required for the updating access, thereby deteriorating the operating efficiency of the system.

In the prior art shown in FIG. 3, no consideration is taken to grayscale display and the case where the liquid crystal driver is provided in a Y-axis direction of the liquid crystal panel.

SUMMARY OF THE INVENTION

An object of the present invention is to attain a reduction in power consumption by making the operating frequency of a liquid crystal driver without deteriorating the operating efficiency of a liquid crystal display system.

Another object of the present invention is to provide a liquid crystal driver having a function with conveniences in use taken into consideration which function includes the realization of multi-grayscale display and the arrangement of the liquid crystal driver in the Y-axis direction of a liquid crystal panel.

A liquid crystal display according to the present invention comprises a liquid crystal panel having a plurality of data lines and a plurality of scanning lines arranged in a matrix form with pixels being formed at intersections of the data and scanning lines, a scanning circuit for successively applying a voltage to the scanning lines, and a liquid crystal driver for receiving display data from an external device to apply a voltage corresponding to the display data to the data lines. The scanning circuit includes a synchronizing signal generating circuit for generating a frame display synchronizing signal indicative of a frame period for display of image on the liquid crystal panel and a line display synchronizing signal indicative of a line period for image display on the liquid crystal panel. The liquid crystal driver includes a display memory accessed through a memory interface for reading and writing of data, the display memory storing therein display data corresponding to the pixels, an address converter for converting, when the external device performs a read/write operation for the reading/writing of display data for the display memory, an address of display data on a display screen designated by the external device into a corresponding address of the display memory, a reading unit for reading display data of the display memory on each of successive lines in synchronism with the line display synchronizing signal, a holding unit for simultaneously holding display data for output data lines of the liquid crystal driver read by the reading unit, a voltage output circuit for outputting the display data held by the holding unit after conversion thereof into a voltage to be applied to the liquid crystal of the liquid crystal panel, and a timing control circuit for arbitrating between a display operation in which the voltage is applied to the data lines at a predetermined period on the basis of the display data stored in the display memory and the read/write operation which is performed by the external device for the display memory asynchronism with the display operation.

Since the liquid crystal driver of the present invention has the display memory incorporated therein, the periodic high-speed transfer of display data through a CPU bus becomes unnecessary and hence the operating frequency of the liquid crystal driver can be decreased (or a display access of once in one horizontal period suffices), thereby making it possible to attain a reduction in power consumption. Also, since the liquid crystal driver of the present invention can be accessed through a general purpose memory interface, a CPU can access the liquid crystal driver itself as it is a general purpose memory. Thereby, the updating speed can be improved as compared with that in the case of the conventional access through an I/O interface.

With the use of the address converter for converting an address designated by the system (or a CPU address) into an address of the internal display memory, an address including the combination of an X-direction address and a Y-direction address of the display screen of the liquid crystal panel can be used as the CPU address, thereby facilitating address determination at the time of updating.

The address converter is also effective in the case where a liquid crystal driver having a larger size is formed by combining liquid crystal driver elements which have the same construction. Namely, each of the liquid crystal driver elements receives a liquid crystal driver ID indicative of its own arrangement position externally supplied so that the conversion into an address of its own internal display memory can be made in accordance with the arrangement position. With this construction, the plurality of combined liquid crystal driver elements seem to be equivalent to a single liquid crystal driver when seen from the CPU.

With the use of two stages of holding circuits (or latch circuits) for holding read data from the display memory at the time of display, an updating access at any point of time is performable without obstructing a display access.

In the case where the liquid crystal driver is arranged in a Y-axis direction (or on the left or right side) of a liquid crystal panel, selecting mean for successively selecting different pixels one by one from display data of plural pixels on the same address simultaneously read when outputted from the display memory to the liquid crystal panel is provided in the liquid crystal driver. Thereby, at the time of updating from the CPU, simultaneous access to plural continuous pixels arranged in a horizontal direction of the display panel becomes possible as in the case where the liquid crystal drivers are arranged in an X-axis direction (or the upper or lower side) of the liquid crystal panel.

BRIEF DESCRIPTION OF THE DRAWINGS

FIG. 15 shows a memory map of the liquid crystal driver with internal memory shown in FIG. 1;

FIG. 32A is a screen memory map of the liquid crystal display system in the sixth embodiment when seen from the CPU, and FIG. 32B is a driver memory map thereof when seen from the liquid crystal driver;

FIG. 33 is a diagram for explaining an address mode of the liquid crystal driver;

FIGS. 34 to 37 are diagrams showing the respective liquid crystal driver arrangements in the liquid crystal display of the sixth embodiment for different resolving powers of the liquid crystal panel;

DESCRIPTION OF THE PREFERRED EMBODIMENTS

A first embodiment of the present invention will be explained in connection with a liquid crystal driver of the present invention by use of FIGS. 1 and 7 to 17.

Figure 1A:
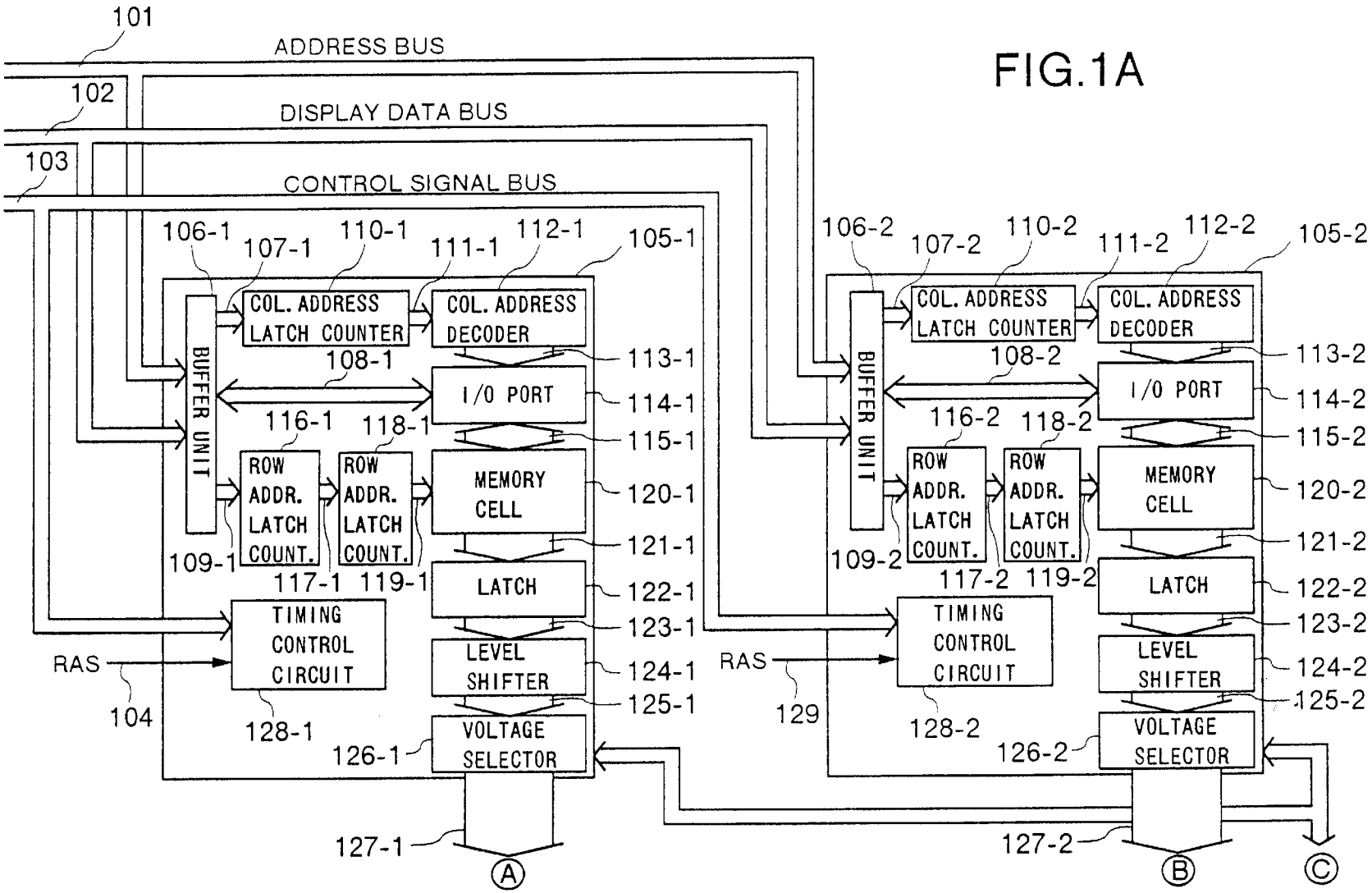
FIGS. 1A and 1B show a block diagram of a liquid crystal display according to the present invention.
Figure 1B:
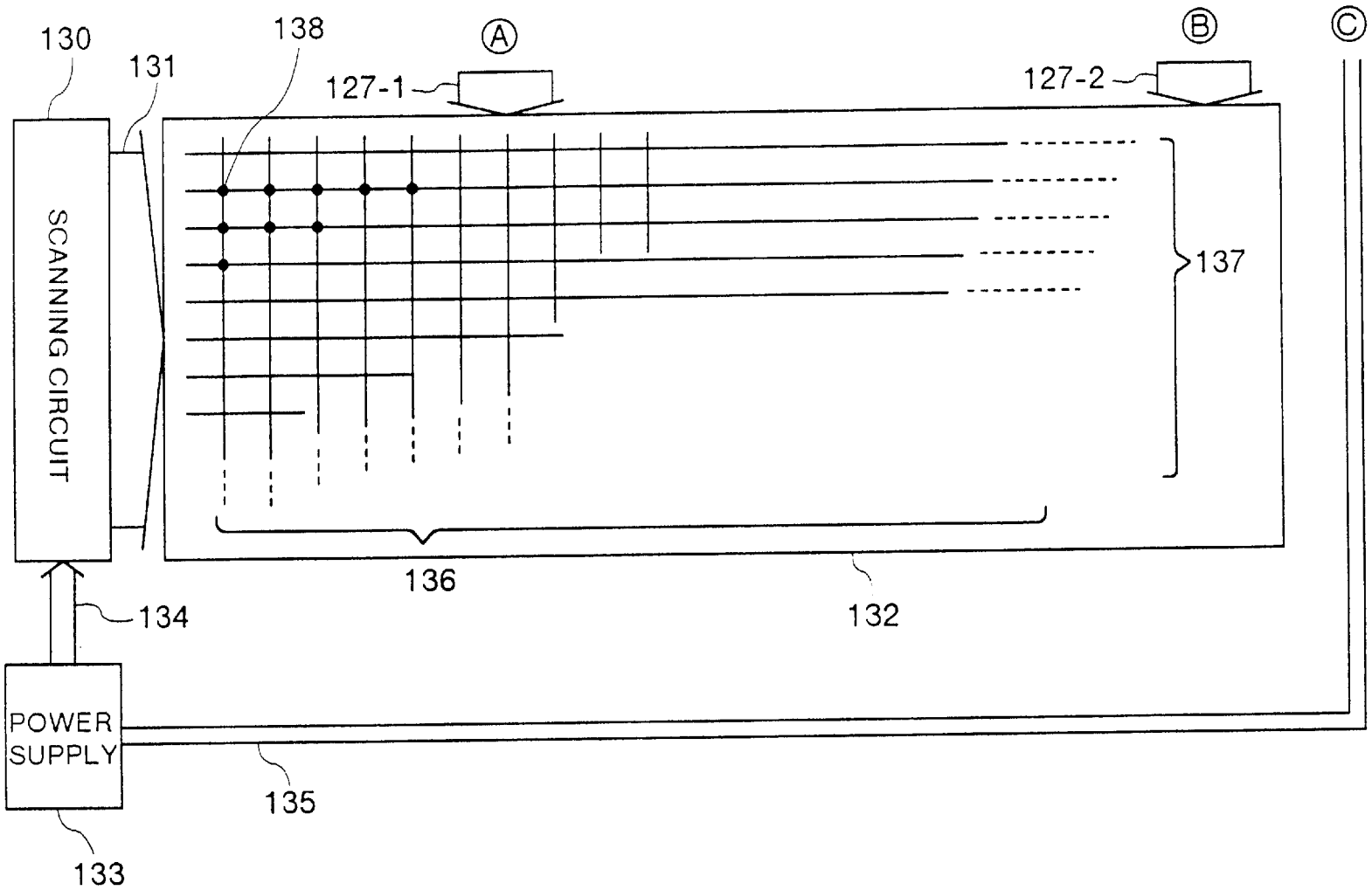
Figure 2:
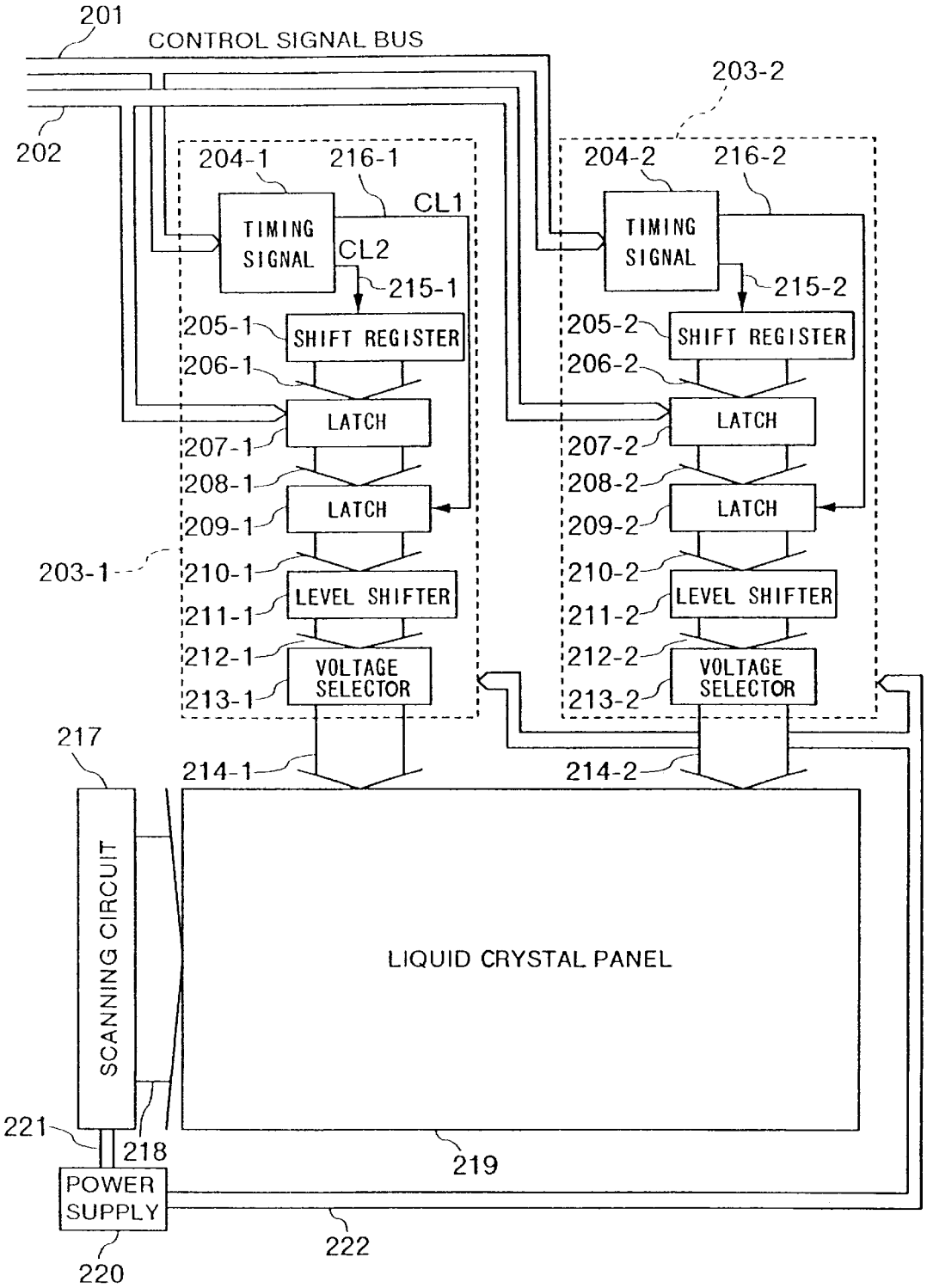
FIG.2 PRIOR ART
FIG. 2 is a block diagram of the conventional liquid crystal display.
Figure 3:
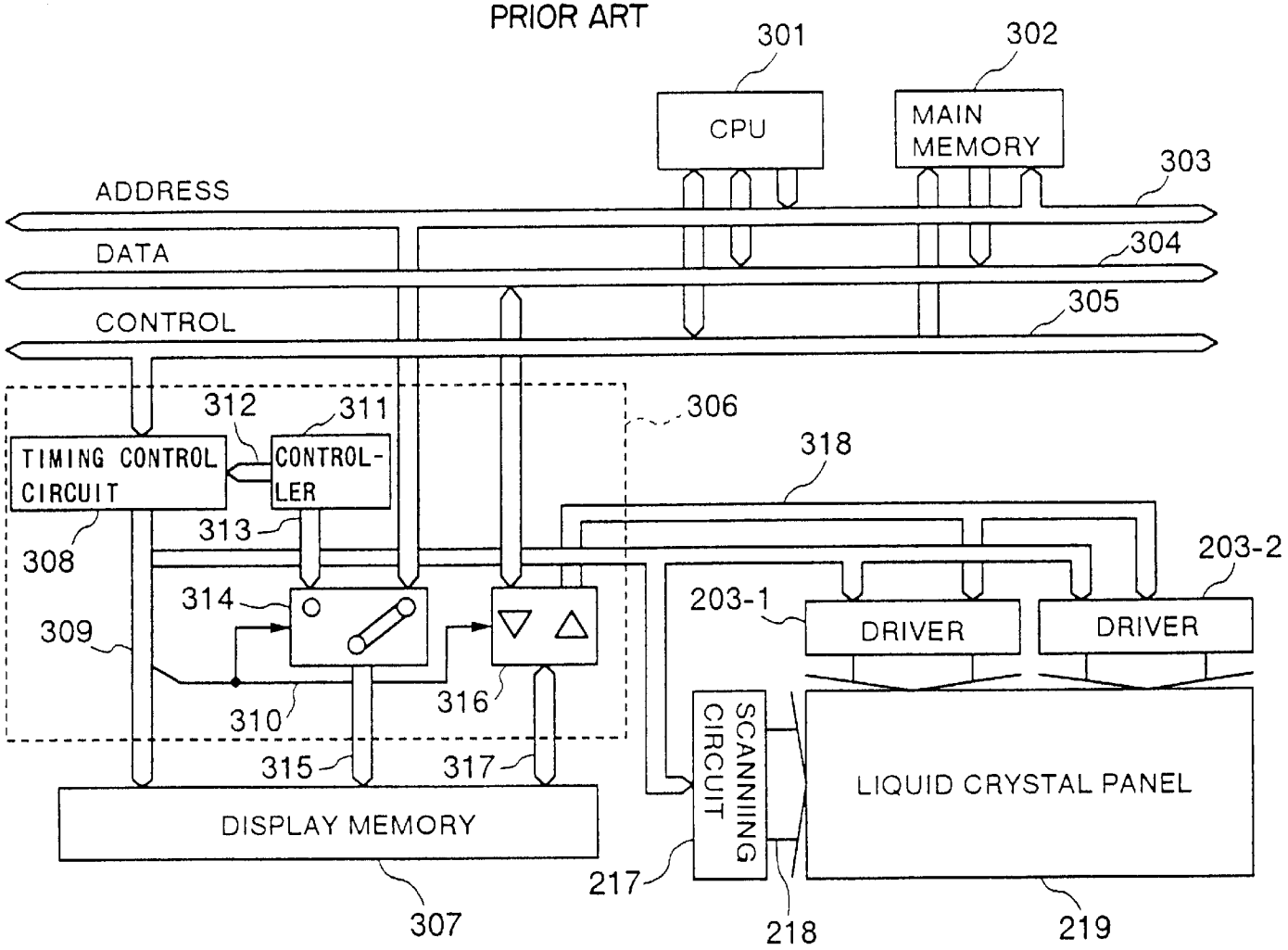
FIG.3 PRIOR ART
FIG. 3 is a block diagram of a personal computer system using the liquid crystal display shown in FIG. 2.
Figure 4:
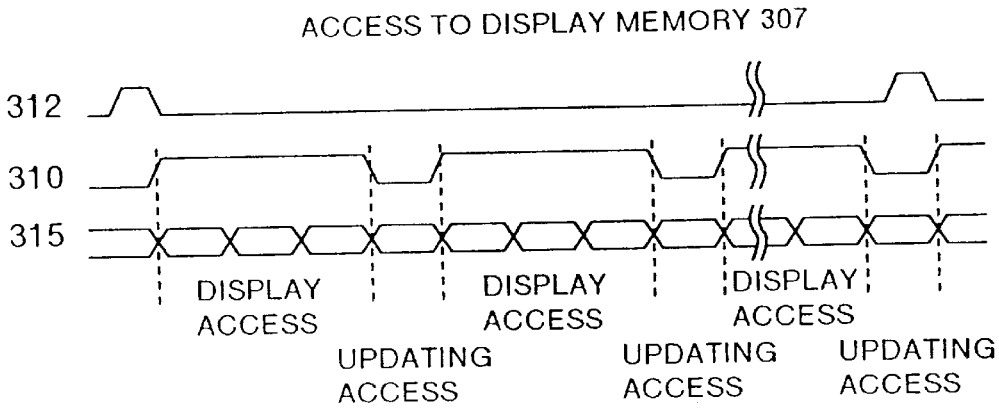
FIG.4 PRIOR ART
FIG. 4 is a timing chart showing the access to a display memory in the system shown in FIG. 3.
Figure 5:
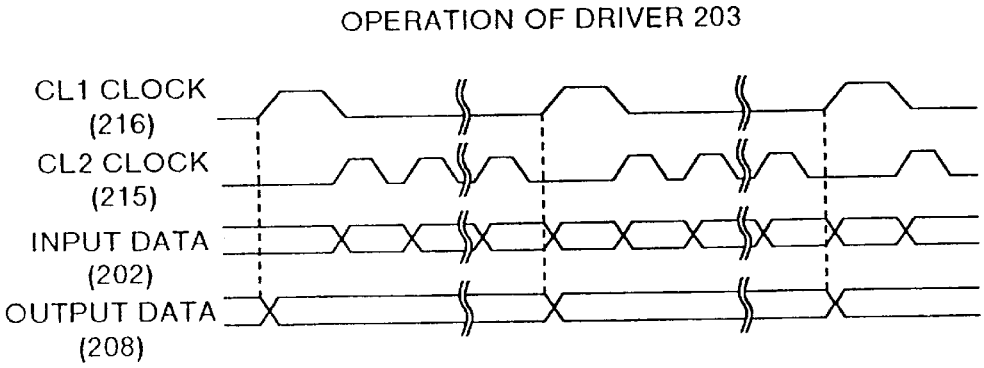
FIG.5 PRIOR ART
FIG. 5 is a timing chart showing the operation of the conventional liquid crystal driver.
Figure 6:
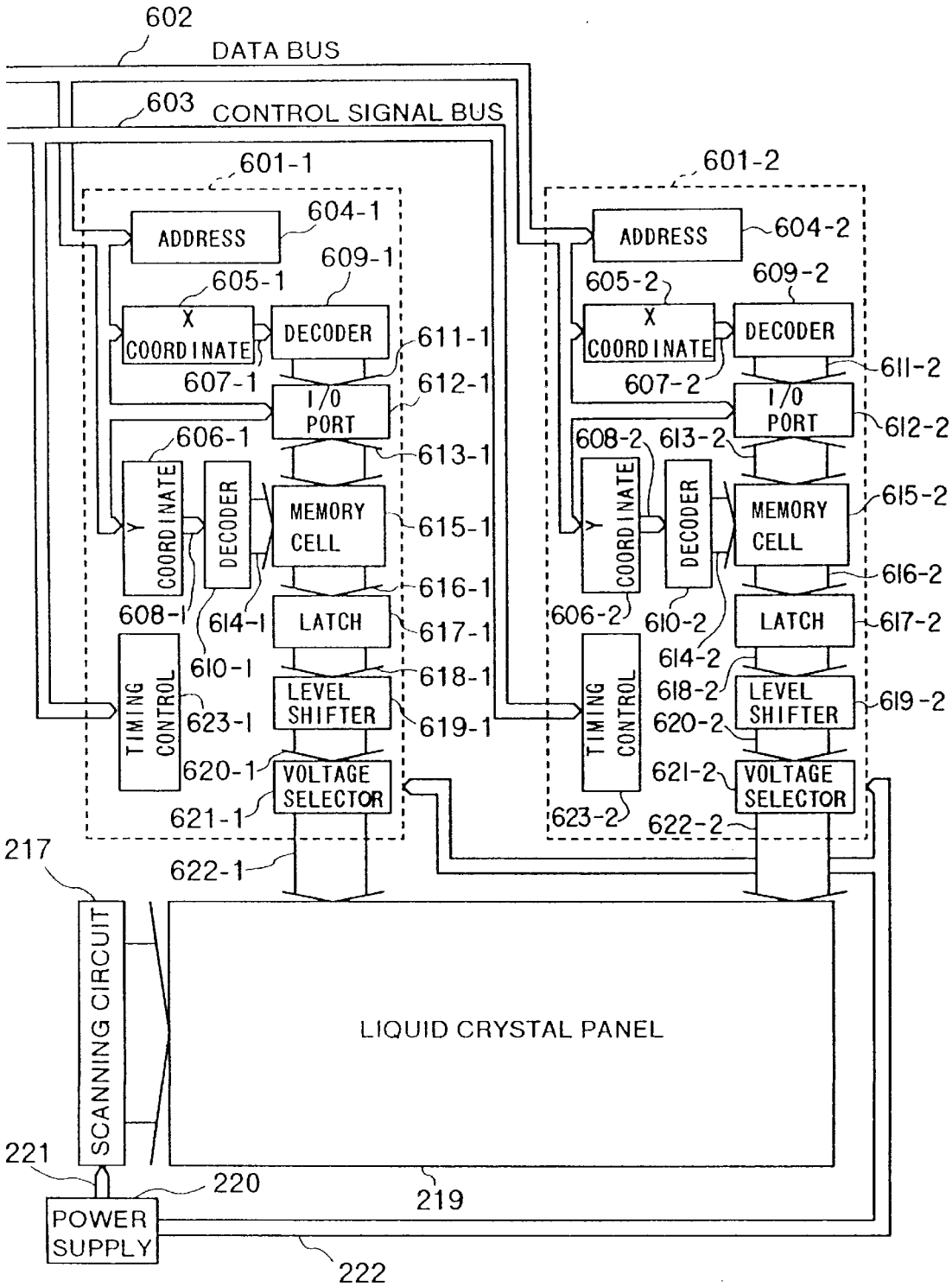
FIG.6 PRIOR ART
FIG. 6 is a block diagram of a liquid crystal display using the conventional liquid crystal driver with internal memory.

FIG. 1 is a block diagram of a liquid crystal display using a liquid crystal driver of the present invention.

In FIG. 1, reference numeral 101 denotes an address bus for transferring an address, numeral 102 a data bus for transferring display data, numeral 103 a control signal bus for transferring a control signal, and numeral 104 a RAS signal. Numeral 105 denotes a liquid crystal driver of the present invention which has 160 bits as the number of outputs. Numeral 106 denotes a buffer unit (or a bi-directional buffer) for the address bus 101 and the data bus 102, numeral 107 a column address bus for transferring a column address designating a column address of a memory cell, numeral 108 a data bus for transferring display data, and numeral 109 a row address bus for transferring a row address designating a row address of the memory cell. Numeral 110 denotes a column address latch/counter, and numeral 111 denotes a column address bus for transferring a column address latched or counted by the column address latch/counter 110. Numeral 112 denotes a column address decoder, and numeral 113 denotes a signal bus for transferring a decode signal decoded by the column address decoder 112. Numeral 114 denotes an I/O port for controlling the input/output of display data. Numeral 115 denotes a data bus for transferring display data. Numeral 116 denotes a row address latch/counter, numeral 117 a row address bus for transferring a row address latched or counted by the row address latch/counter 116, numeral 118 a row address decoder, and numeral 119 denotes a signal bus for transferring a decode signal decoded by the row address decoder 118. Numeral 120 denotes a memory cell, and numeral 121 denotes a data bus for transferring display data of 160 bits outputted from the memory cell 120 in accordance with a display instruction. Numeral 122 denotes a latch for simultaneously latching the display data of 160 bits transferred by the data bus 121. Numeral 123 denotes a data bus for transferring display data latched by the latch 122, and numeral 124 denotes a level shifter for converting a voltage level of display data into a level corresponding to a liquid crystal applied voltage. Numeral 125 denotes a data bus for transferring the level-shifted display data, numeral 126 a voltage selector, and numeral 127 an output voltage line for transferring a liquid crystal applied voltage selected by the voltage selector 126 in accordance with display data. Numeral 128 denotes a timing control circuit, and numeral 129 denotes a RAS signal inputted to a liquid crystal driver 105-2. Numeral 130 denotes a scanning circuit, numeral 131 a scanning signal line for transferring a scanning signal generated by the scanning circuit 130, and numeral 132 a liquid crystal panel which has a resolving power of (320 dots)×(240 lines). Numeral 133 denotes a power supply circuit, numeral 134 a driving voltage line for transferring a voltage for driving the scanning circuit, and numeral 135 a voltage line for transferring a liquid crystal driving voltage.

The liquid crystal panel 132 includes 320 data lines 136 which are connected to the output voltage line 127 and 240 scanning lines 137 which are connected to the scanning signal line 131. The data lines 136 and the scanning lines 137 are arranged in a matrix form so that 320×240 pixels are formed at the intersections of the lines 136 and 137.

Figure 7:
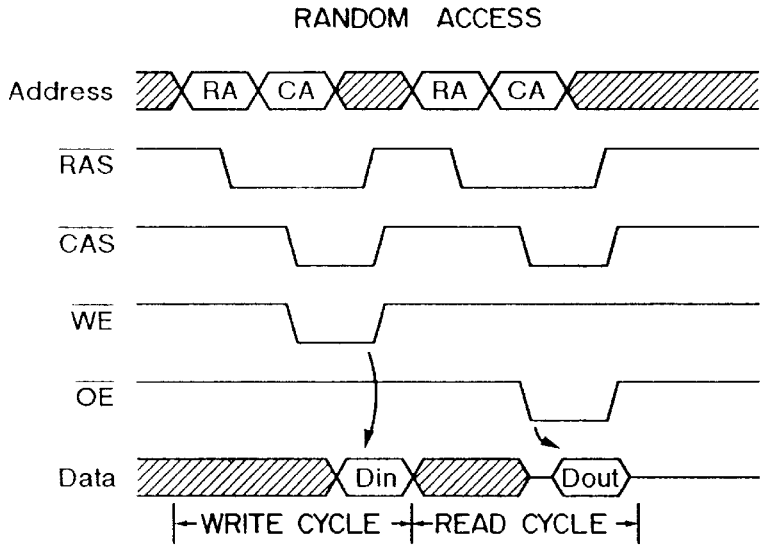
FIG. 7 is a timing chart of a random access of a liquid crystal driver in the liquid crystal display of the present invention shown in FIG. 1.

FIGS. 7 to 14 show timing charts of the access to the memory cell 120. More particularly, FIG. 7 is a timing chart of a random access. A row address and a column address are multiplex-transferred to the address bus. RAS is a row address signal for taking in a row address, and CAS is a column address signal for taking in a column address. WE is a write enable signal, and the writing into the memory cell 120 is made when WE is "L". OE is an output enable signal, and the reading from the memory cell is made when OE is "L". Data to be written in the memory cell 120 and data read from the memory cell 120 are transferred to the data bus.

Figure 8:
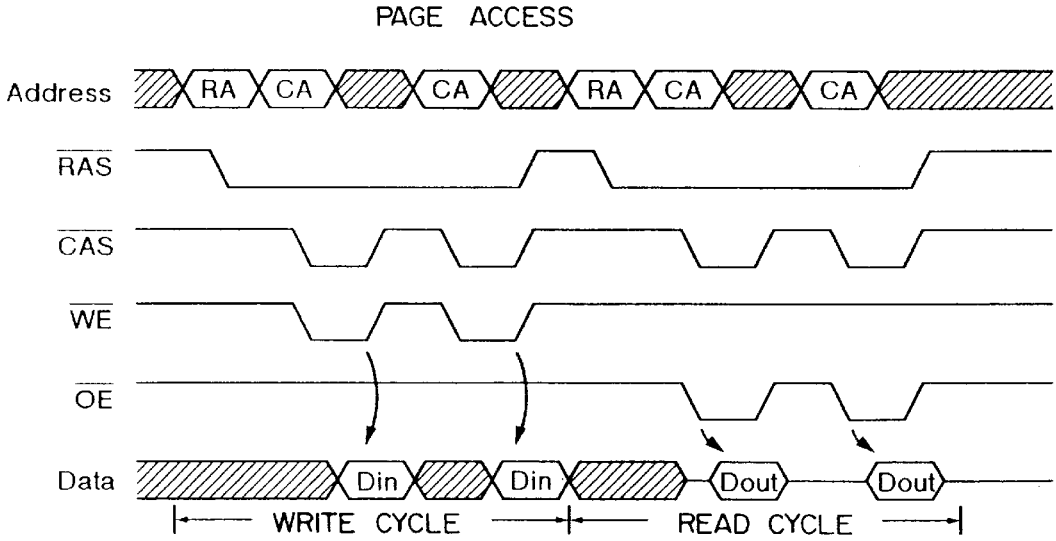
FIG. 8 is a timing chart of a page access of the liquid crystal driver in the liquid crystal display of the present invention shown in FIG. 1.
Figure 9:
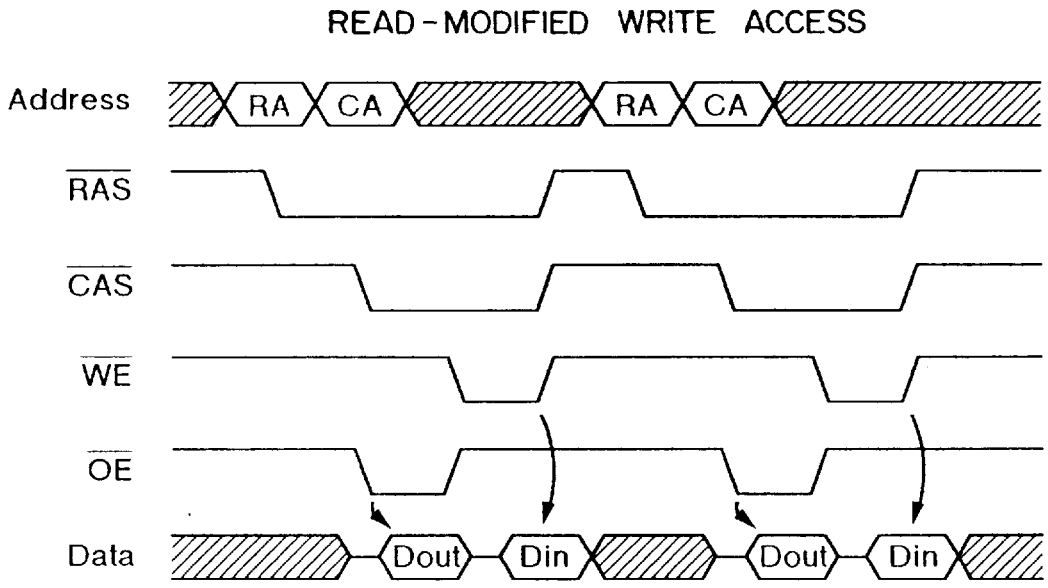
FIG. 9 is a timing chart of a read-modified write access of the liquid crystal driver in the liquid crystal display shown in FIG. 1.
Figure 10:
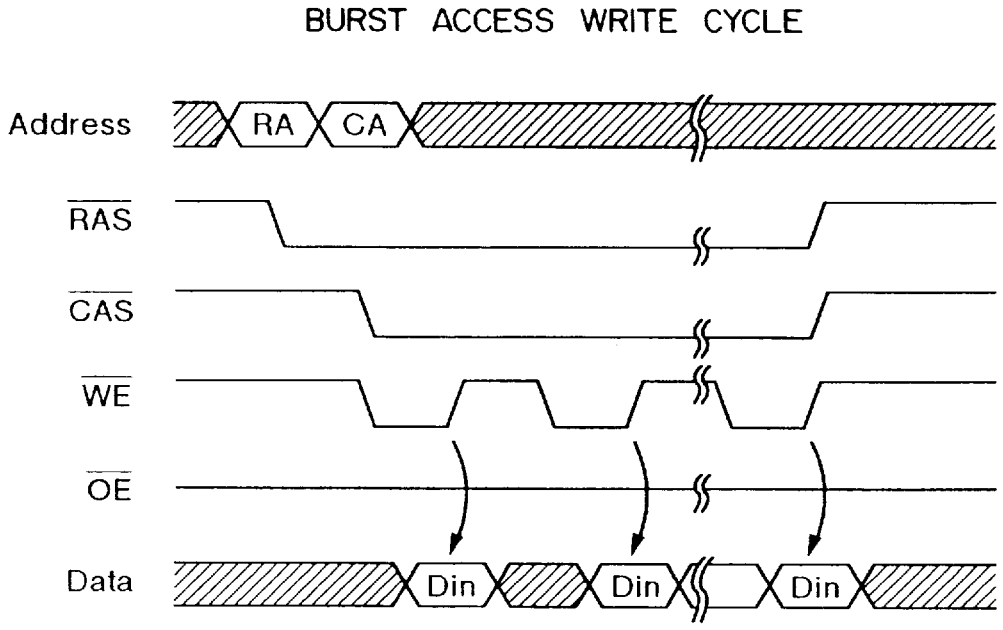
FIG. 10 is a timing chart of a write cycle in a burst access of the liquid crystal driver in the liquid crystal display shown in FIG. 1.
Figure 11:
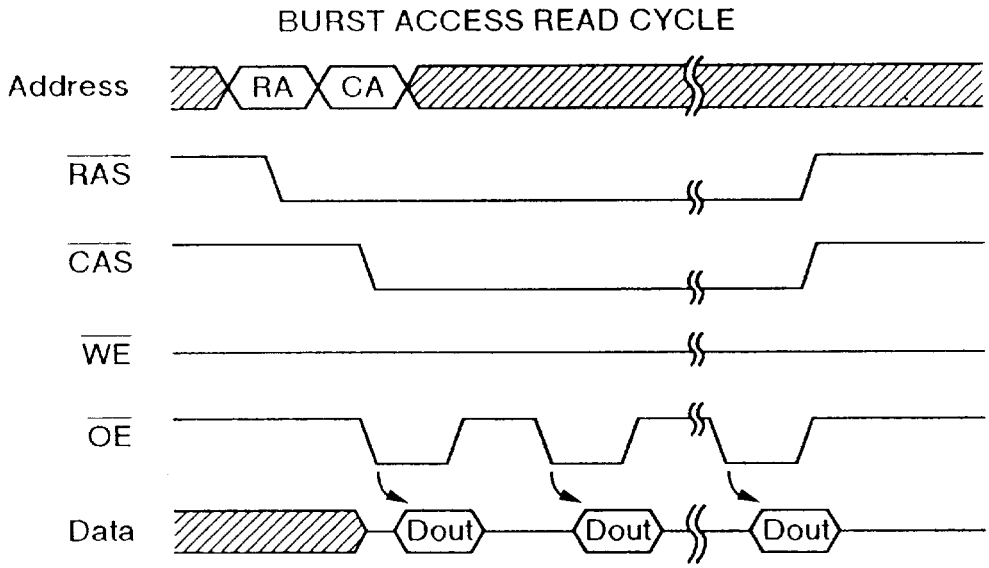
FIG. 11 is a timing chart of a read cycle in the burst access of the liquid crystal driver in the liquid crystal display shown in FIG. 1.
Figure 12:
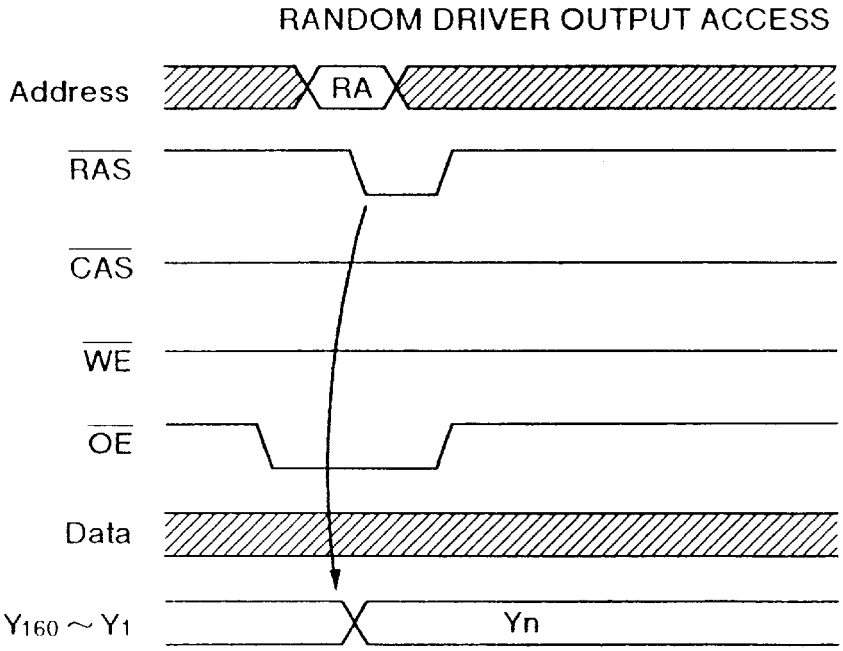
FIG. 12 is a timing chart of a random driver output access of the liquid crystal driver in the liquid crystal display shown in FIG. 1.

FIG. 8 is a timing chart of a page access. FIG. 9 is a timing chart of a read-modified write access. FIG. 10 is a timing chart of a write cycle in a burst access. FIG. 11 is a timing chart of a read cycle in the burst access. FIG. 12 is a timing chart of a random driver output access.

Figure 13:
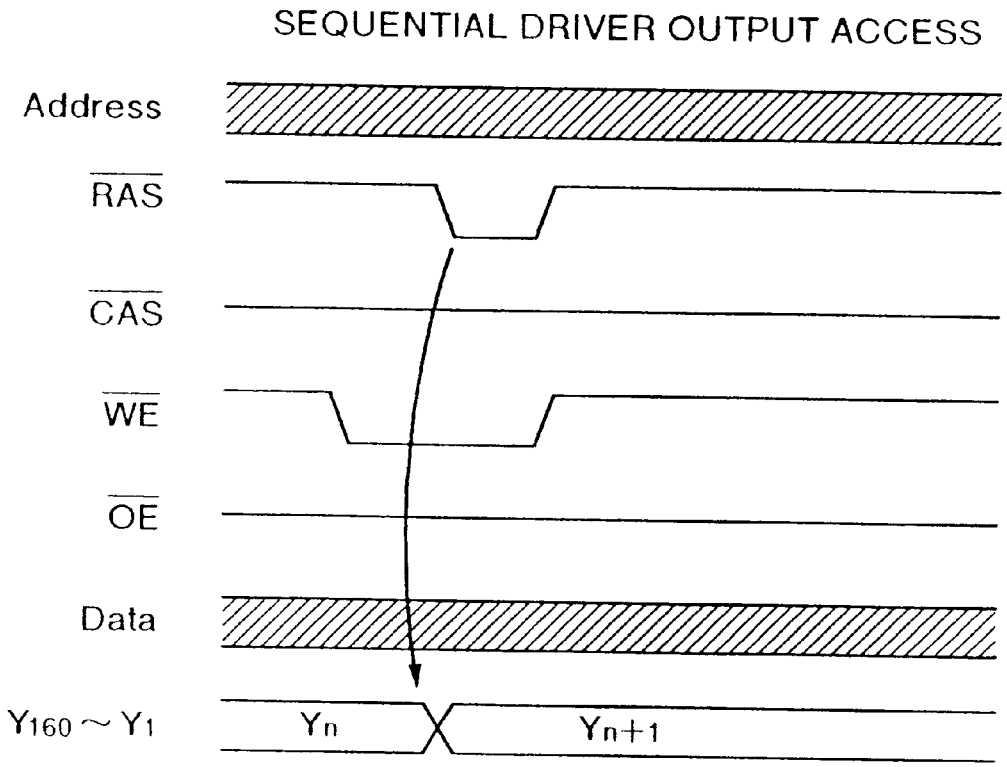
FIG. 13 is a timing chart of a sequential driver output access of the liquid crystal driver in the liquid crystal display shown in FIG. 1.

FIG. 13 is a timing chart of a sequential driver output access. A timing chart of the leading line of the sequential driver output access is similar to the timing chart of the random driver output access shown in FIG. 12.

Figure 14:
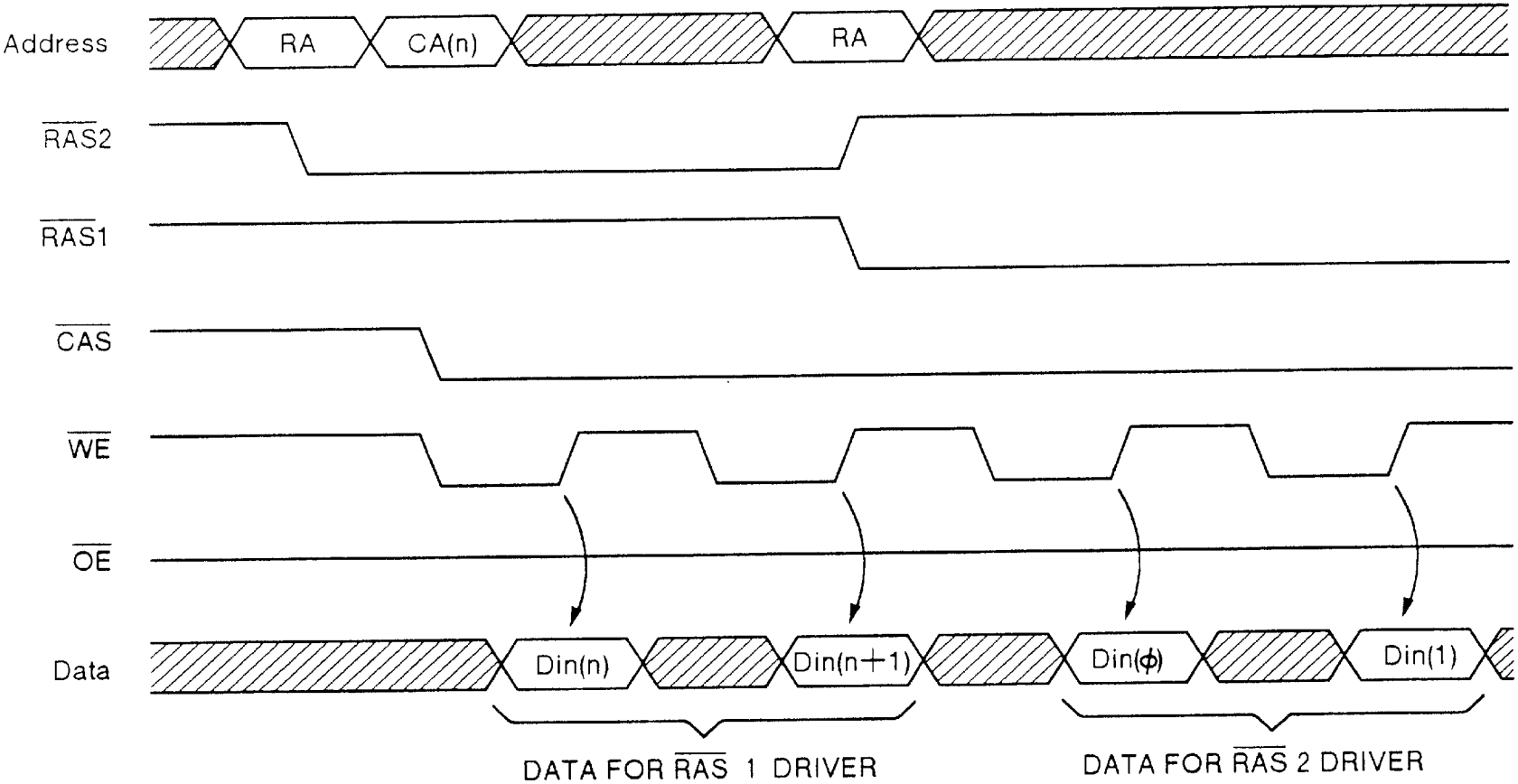
FIG. 14 is a timing chart in the case where a continuous access using a plurality of liquid crystal drivers is made by use of a chip selecting function in the liquid crystal display shown in FIG. 1.

FIG. 14 is a timing chart in the case where a continuous access using a plurality of liquid crystal drivers 105 is made by use of a chip selecting function. The timing chart shows a burst access write mode as one example.

In FIG. 14, RAS1 is a RAS (Raw Address Strobe) signal of the liquid crystal driver 105-1, and RAS2 is a RAS signal of the liquid crystal driver 105-2. Each of the RAS signals has a chip selecting function.

FIG. 15 shows a memory map of the memory cell 120 of the driver 105. An X coordinate value represents a column address, and a Y coordinate value represents a row address. Since one address includes 8-bit data, the X coordinate value takes hex0 to hex13. Since there are 240 lines in a vertical direction, the Y coordinate value takes hex0 to hexEF.

Figure 16:
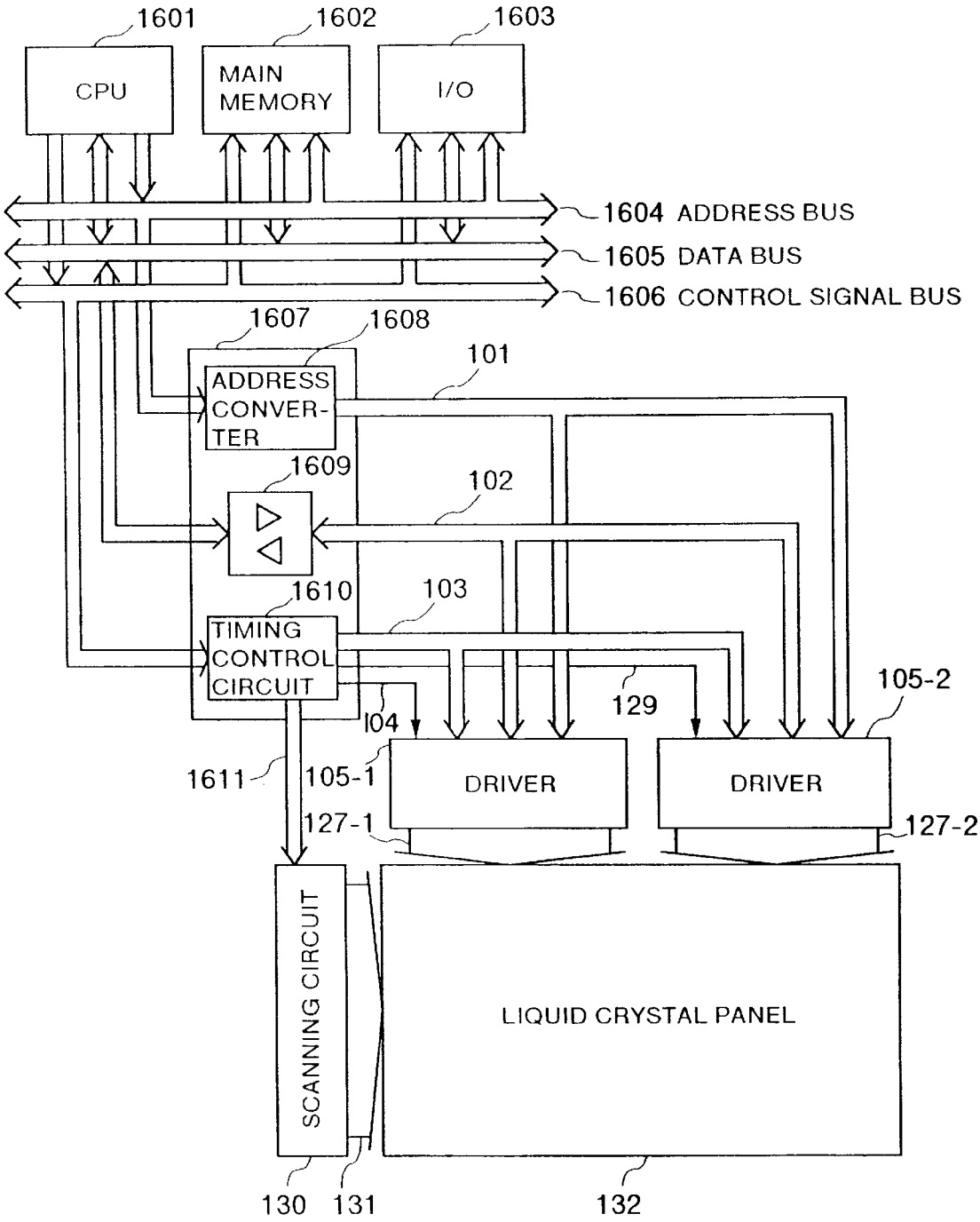
FIG. 16 is a block diagram of a liquid crystal display system according to a first embodiment in which the liquid crystal driver of the present invention is used.

FIG. 16 is a block diagram of a liquid crystal display system according to a first embodiment in which the liquid crystal driver 105 of the present invention is used.

In FIG. 16, reference numeral 1601 denotes a CPU, numeral 1602 a main memory, and numeral 1603 an I/O device. Numeral 1604 denotes an address bus for transferring an address outputted from the CPU 1601, numeral 1605 a data bus for transferring data, and numeral 1606 a control signal bus for transferring a control signal outputted from the CPU 1601. Numeral 1607 denotes a liquid crystal controller, and numeral 1608 denotes an address converter by which an address transferred through the address bus 1604 is converted into an X coordinate value (or column address) and a Y coordinate value (or row address) corresponding to the driver memory map (or memory cell 120) of the liquid crystal driver 105. Numeral 1609 denotes a buffer for display data, numeral 1610 a timing control circuit, and numeral 1611 a control signal bus for transferring a control signal for the scanning circuit 130.

Figure 17A:
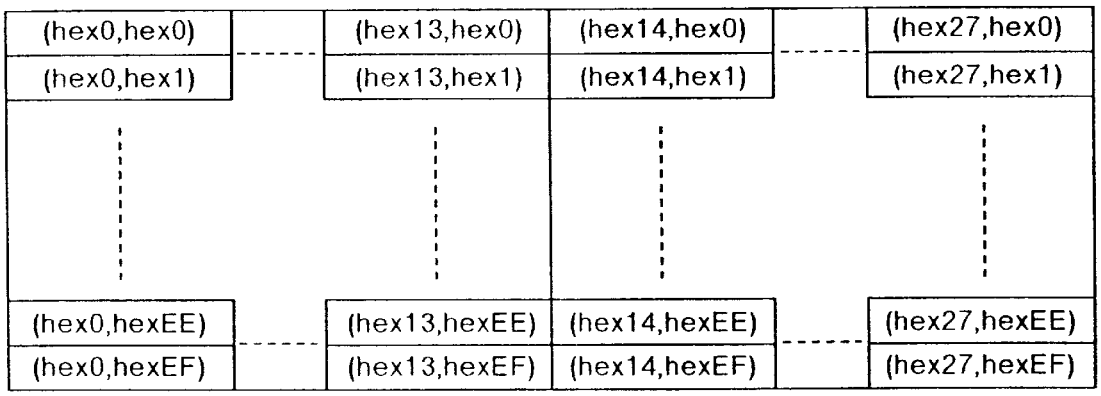
FIG. 17A is a screen memory map of the liquid crystal display system of FIG. 16 when seen from the CPU.
Figure 17B:
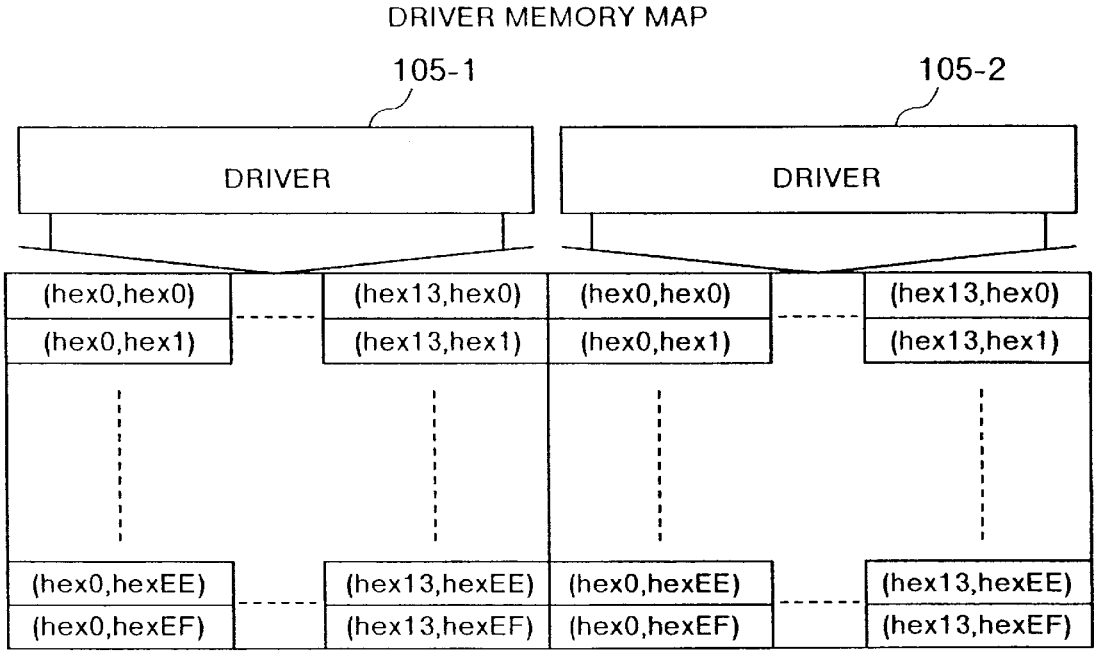
FIG. 17B is a driver memory map thereof when seen from the driver.

FIG. 17A is a screen memory map when seen from the CPU, and FIG. 17B is a driver memory map when seen from the driver. In the screen memory map when seen from the CPU, the X coordinate value takes hex0 to hex27 since the horizontal resolving power is 320 dots, and the Y coordinate value takes hex0 to hexEF since the vertical resolving power is 240 lines.

The operation of the present invention will be explained by use of the block diagram of the liquid crystal display shown in FIG. 1.

An address transferred from the CPU 1601 through the address bus 101 is transferred to the buffer unit 106 of the liquid crystal driver 105. A row address is transferred from the buffer unit 106 to the row address latch/counter 116 through the address bus 109, and a column address is transferred from the buffer unit 106 to the column address latch/counter 110 through the address bus 107. A timing control signal and a RAS signal are transferred to the timing control circuit 128 through the control signal bus 103. The timing control circuit 128 generates a control signal for controlling an updating access to the memory cell 120 (for the updating of data) and a display access to the memory cell 120 (for the display of data). The RAS signal of control signals has a chip selecting function and therefore differs for each liquid crystal driver so that RAS signals 104 and 129 are inputted to the liquid crystal drivers 105-1 and 105-2, respectively. However, the drivers has a similar operation. The column address is transferred from the column address latch/counter 110 to the column address decoder 112 through the column address bus 111 and is decoded by the column address decoder 112. A decode signal outputted from the column address decoder 112 through the signal line 113 controls the I/O port 114. A row address outputted from the row address latch/counter 116 through the row address bus 117 is transferred to the row address decoder 118 and is decoded thereby. A decode signal outputted from the row address decoder 118 is transferred to the memory cell 120 through the signal line 119. Data inputted/outputted from the data bus 102 through the buffer unit 106 is transferred through the data bus 108 to the I/O port 114 so that the writing/reading at a coordinate designated by the row address and the column address is performed in accordance with the control signal outputted from the timing control circuit 128.

When a control signal for effecting a display access is outputted from the timing control circuit 128, display data of 160 bits having a designated row address is simultaneously transferred through the data bus 121 to the latch 122 which in turn latches the display data of 160 bits simultaneously. The display data latched by the latch 122 is transferred through the data bus 123 to the level shifter 124 for shift to a voltage level corresponding to a liquid crystal applied voltage. The level-shifted display data is transferred through the data bus 125 to the voltage selector 126 which in turn selects a liquid crystal applied voltage corresponding to the data. The selected liquid crystal applied voltage is supplied from the output voltage line 127 to the liquid crystal panel 132.

Next, the timing of the updating access and the display access will be explained in detail for various modes by use of FIGS. 7 to 17.

First, a random access, which is one mode of the updating access, will be explained using the timing chart shown in FIG. 7.

A row address RA transferred from the address bus 101 is read upon falling of a RAS signal to designate a row address at which access to the memory cell 120 is to be made. Similarly, a column address CA is read upon falling of a CAS (Column Address Strobe) signal to designate a column address at which access is to be made. In the case where the access is a write cycle, input data Din transferred from the data bus 115 is written into the designated address of the memory cell 120 upon rising of a write enable signal WE. In the case where the access is a read cycle, data Dout stored at the designated address of the memory cell 120 is read upon falling of an output enable signal OE and is transferred to the data bus 102 through the data bus 115. The access cycle is completed when RAS is turned to "H" (high level).

Next, a page access, which is another mode of the updating access, will be explained using the timing chart shown in FIG. 8.

In the page access, in the case where the first designation of a row address is followed by access to data having the same row address, the access can be made continuously by merely designating column addresses. In the leading or first cycle, a row address and a column address are designated upon falling of RAS and upon falling of CAS, respectively, as in the random access, as shown in FIG. 8. In the subsequent cycle, a row address is not designated but only a column address is designated upon falling of CAS, thereby making the access to data having the same row address. Accordingly, it becomes possible to perform a processing for the subsequent cycle inclusive of the second cycle in a short time as compared with the random access, thereby realizing a high-speed access.

Next, a read-modified write access, which is a mode of the updating access, will be explained using the timing chart shown in FIG. 9.

The read-modified write access is an access in which the reading and writing at the same address are continuously performed. As shown in FIG. 9, an address at which access is to be made is designated and OE is thereafter rised to read the stored data. After a read cycle with OE rised has been completed, WE is turned to "L" (low level) so that input data Din on the data bus 115 is written upon rising of WE into the address subjected to the reading.

Next, a burst access, which is a mode of the updating access, will be explained using the timing charts shown in FIGS. 10 and 11.

The burst access is used in the case where data subjected to access has the same row address and the column addresses are continuous. After an address for the leading or first access cycle has been designated, a sequential access becomes possible in the subsequent cycles inclusive of the second cycle by making the sequential addition of a column address in the column address latch/counter 110 with no address designation by RAS and CAS.

First, a write cycle of the burst access will be explained using the timing chart shown in FIG. 10. In the leading cycle, the taking-in of addresses is made upon falling of RAS and CAS, as in the random access, to designate an address of the memory cell 120 at which access is to be made. Upon rising of WE, input data Din is written from the data bus 115 into the designated address. Next, upon falling of WE, 1 (one) is added to the column address latch/counter 110. In the second cycle, input data Din is written upon rising of WE into an address obtained by adding 1 to the column address of the leading cycle. Subsequently, the writing of data is performed at the same cycle as the second cycle. The access is completed when RAS is turned to "H".

Next, a read cycle of the burst access will be explained using FIG. 11. In the leading cycle, an address of the memory cell 120, at which access is to be made, is designated and output data Dout is thereafter read upon falling of OE. The reading is completed by rising OE. In the second cycle, 1 is added to the column address latch/counter 110 upon falling of OE and data having an address obtained by adding 1 to the leading address is read. Subsequently, the reading of data is performed at the same cycle as the second cycle. The access is completed when RAS is turned to "H". The burst access has an advantage over the page access in the aspect of reduction in power consumption since the address value transferred through the address bus is not changed.

Next, a random driver output access, which is one mode of the display access, will be explained using the timing chart shown in FIG. 12.

When the taking-in of a row address RA is made upon falling of RAS, data Yn of one row at the designated row address is simultaneously outputted to the latch 122 through the data bus 121 in the case where OE is "L" and WE is "H".

Next, a sequential driver output access, which is another mode of the display access, will be explained using the timing chart shown in FIG. 13.

The leading output cycle is the same as the random output access. Next, in the OE takes "H" and the WE takes "L" upon falling of RAS, data Yn+1 of one row at an address obtained by adding 1 to the row address latch/counter 116 is simultaneously outputted to the latch 122 through the data bus 121. Similarly, the output of data is sequentially performed.

Thus, the output of data from the memory cell 120 is performed only once in one horizontal period. Namely, the most time of one horizontal period can be used for an updating access, thereby enabling high-speed updating.

In the case where a plurality of liquid crystal drivers 105 are used in order to drive the liquid crystal panel 132, it is necessary to select a driver which is to make updating access. This liquid crystal driver selecting method will be explained by use of FIG. 14 showing a timing chart of a burst access write cycle in the case where two liquid crystal drivers are used.

A control signal RAS is used as a chip selection signal for selecting a driver which is to make updating access. It is assumed that the liquid crystal driver is in a non-selected condition when RAS is "H" and a selected condition when RAS is "L". As shown in FIG. 14, the liquid crystal driver 105-1 takes a selected condition when RAS1 inputted to the liquid crystal driver 105-1 is "L". The operation of the liquid crystal driver 105-1 in the selected condition is similar to the burst access write cycle shown by the timing chart in FIG. 10. Namely, input data Din(n) and Din(n+1) corresponding to the liquid crystal driver 105-1 are written. At this time, RAS2 inputted to the liquid crystal driver 105-2 is "H" and hence the liquid crystal driver 105-2 takes a non-selected condition. Therefore, even if the other control signals for updating access are inputted, the liquid crystal driver 105-2 does not make access.

Next, when RAS1 is turned to "H", RAS2 is turned to "L" so that the liquid crystal driver 105-1 takes a non-selected condition and the liquid crystal driver 105-2 takes a selected condition. Input data Din(0), Din(1), - - - are written into the liquid crystal driver 105-2 in the selected condition.

Thus, a driver, which is to make updating access, can be selected by changing over the chip selection signals RAS.

A memory map of the memory cell 120 will be explained by use of FIG. 15.

An address map of the memory cell 120 is such that the X coordinate is a column address and the Y coordinate is a row address. Since the resolving power of the liquid crystal panel 132 is 320 (dots)×240 (lines) and the number of outputs of the liquid crystal driver 105 is 160 bits, the X coordinate of the memory map takes hex0 to hex13 and the Y coordinate thereof takes hex0 to hexEF. Thus, the memory map depends upon the number of output signals of the liquid crystal driver 105 and the resolving power of the liquid crystal panel 132.

Next, a liquid crystal display system using the liquid crystal driver of the present invention will be explained by use of FIGS. 16, 17A and 17B.

First, the explanation will be made using a block diagram of a liquid crystal display system in a first embodiment shown in FIG. 16.

An address outputted from a CPU 1601 is transferred through an address bus 1604 to a main memory 1602, an I/O device 1603 and a liquid crystal controller 1607. The address transferred to the liquid crystal controller 1607 is inputted to an address converter 1608 and is converted thereby into an address corresponding to a memory map of the liquid crystal driver 105. The memory map and the address conversion will now be explained using FIGS. 17A and 17B.

Since the resolving power of the liquid crystal panel is 320 (dots)×240 (lines), a screen memory map when seen from the CPU 1601 is such that the X coordinate of the memory map takes hex0 to hex27 and the Y coordinate thereof takes hex0 to hexEF, as shown in FIG. 17A. On the other hand, since a driver memory map when seen from the liquid crystal driver 105-1 and 105-2 takes a memory map of the internal memory cell 120 of each driver, the driver memory map is in a form in which two memory maps shown in FIG. 15 lie side by side, as shown in FIG. 17B. Therefore, the driver memory map when seen from the liquid crystal drivers 105-1 and 105-2 is different from the screen memory map when seen from the CPU 1601. Therefore, if an address transferred from the CPU 1601 is used as it is, a correct address designation for the memory cell 120 of the liquid crystal driver cannot be performed. Accordingly, the address converter 1608 converts an address transferred from the CPU 1601. In the case where RAS104 inputted to the liquid crystal driver 105-1 is "L", the address transferred from the CPU 1601 is not subjected by the address converter 1608 to address conversion or is outputted therefrom to the address bus 101 as it is. In the case where RAS129 inputted to the liquid crystal driver 105-2 is "L", the X coordinate values hex14 to hex27 of the memory map when seen from the CPU 1601 are converted into hex0 to hex13 which are in turn outputted to the address bus 101. With such address conversion, it is possible to make correspondence to the driver memory map, thereby performing correct address designation.

Returning to FIG. 16 again, a control signal transferred to the liquid crystal controller is inputted to a timing control circuit 1610. The timing control circuit 1610 generates a control signal for controlling the timing of an updating access performed by the CPU 1601 and a display access of the liquid crystal driver 105. The control signal is outputted to the control signal bus 103. The timing control circuit 1610 also outputs a control signal for the scanning circuit 130 to a control signal bus 1611.

Display data inputted to or outputted from the CPU 1601 is transferred through a data bus 1605 from or to the main memory 1602, the I/O device 1603 and the liquid crystal controller 1607. The display data transferred to the liquid crystal controller 1607 is transferred through a buffer 1609 to the data bus 102 so that the input/output of data between the CPU 1601 and the liquid crystal driver 105 is made.

Thus, the liquid crystal display system using the liquid crystal driver of the present invention requires the liquid crystal controller having an address converting function. The address converting function may be provided in the liquid crystal driver 105. In such a case, the liquid crystal controller having no address conversion function can be used. The operations of the liquid crystal driver 105 having the address conversion function and the address conversion function in the driver are same with the operation described above. Since a display access is made once in one horizontal period, high-speed updating access is possible. As a result, the power consumption can be reduced as compared with a liquid crystal display system using the conventional liquid crystal driver.

Next, a second embodiment of a liquid crystal display system, in which the liquid crystal driver is used and two-screen driving is made, will be explained using FIGS. 18 to 20.

Figure 18A:
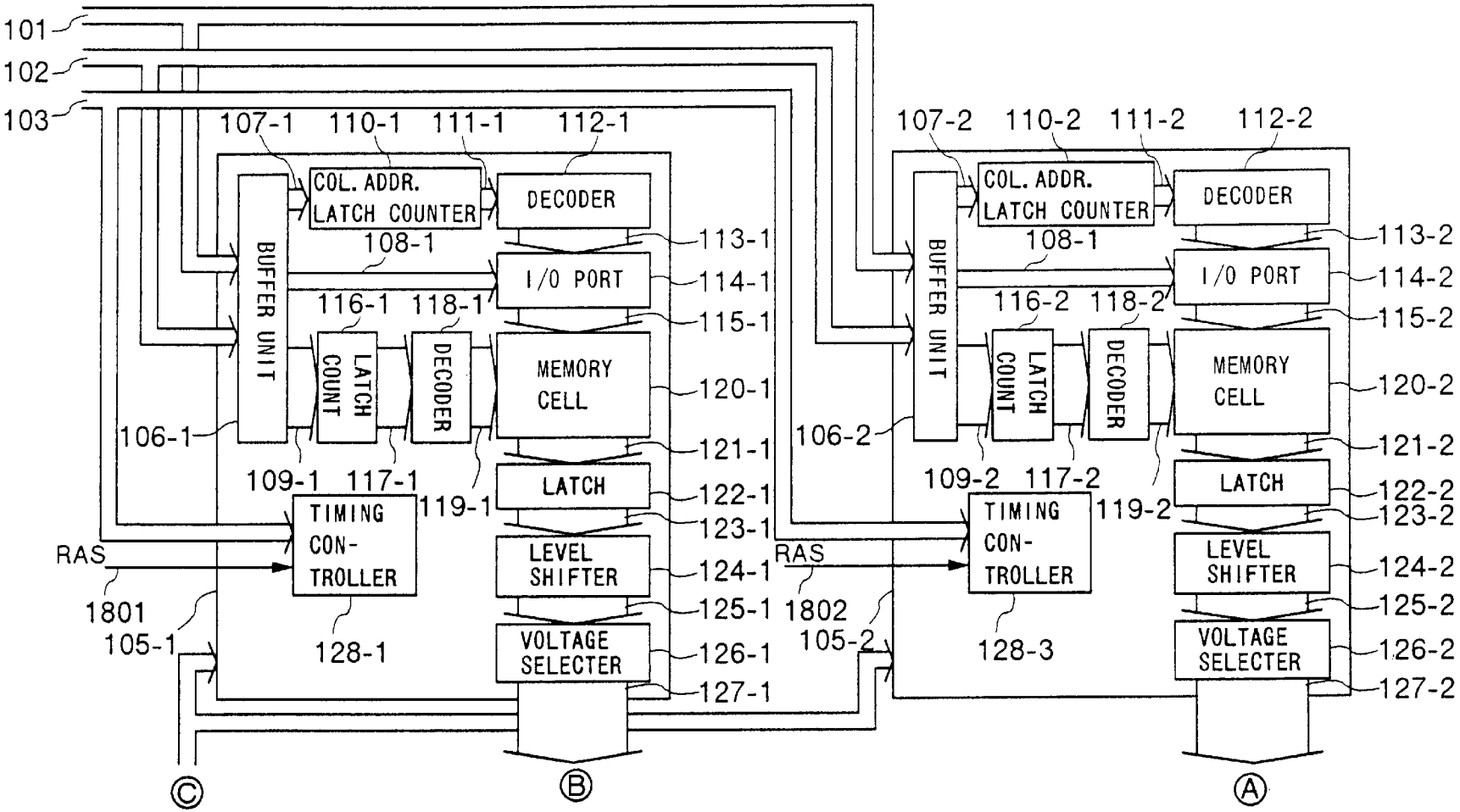
FIGS. 18A, 18B and 18C show a block diagram of a liquid crystal display according to a second embodiment in which the liquid crystal driver of the present invention is used and two-screen driving is made.
Figure 18B:
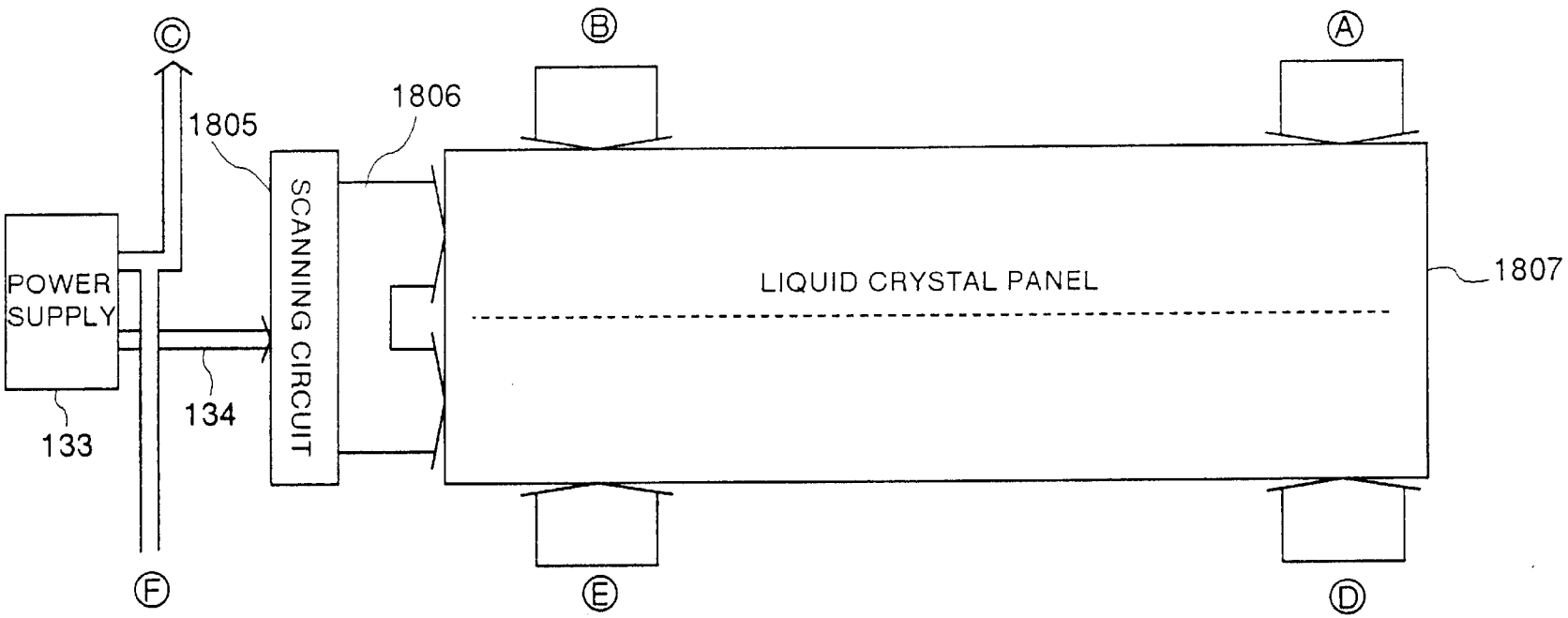
Figure 18C:
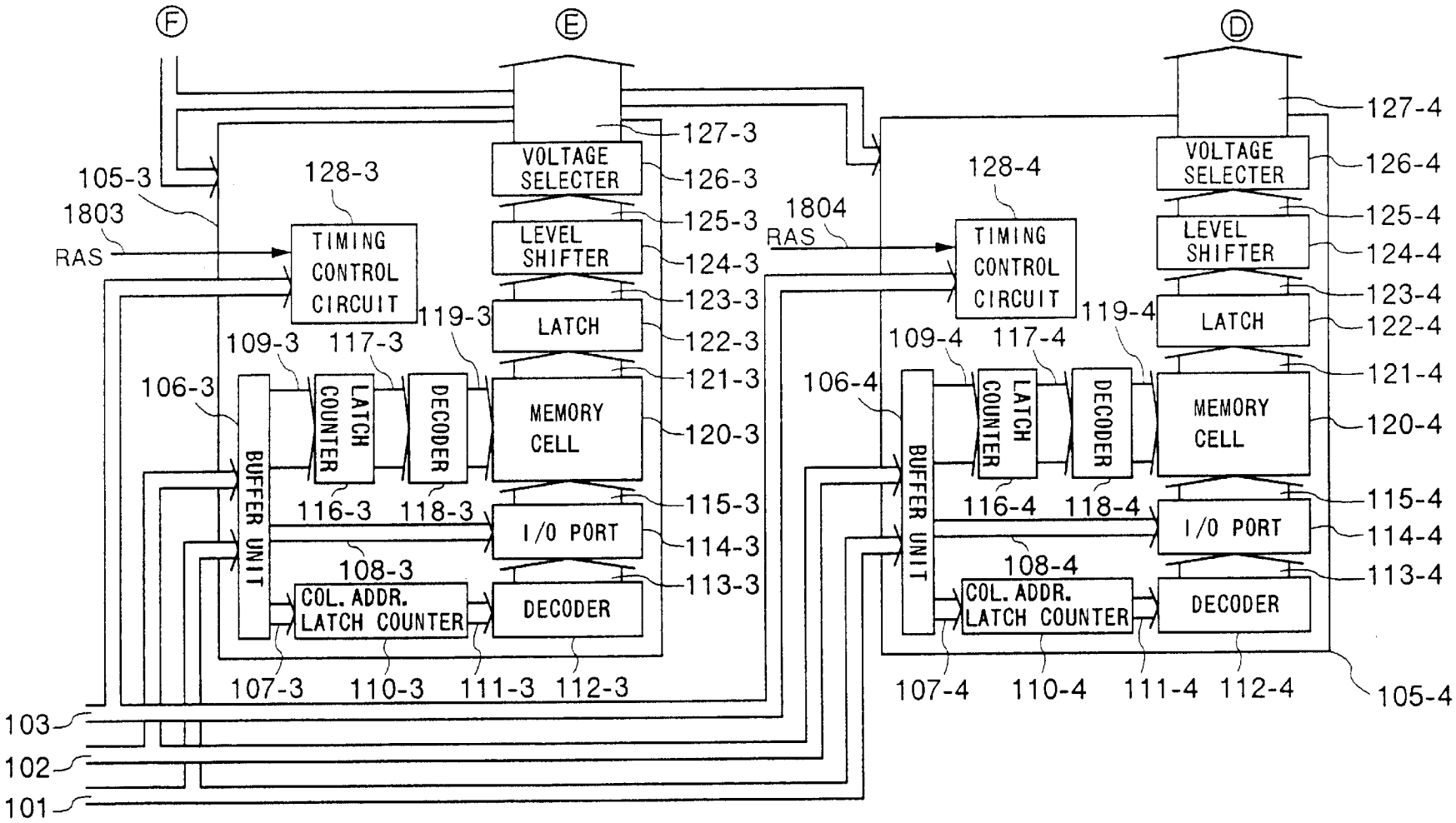

FIG. 18 is a block diagram of the liquid crystal display according to the second embodiment.

In FIG. 18, reference numerals 1801 to 1804 denote RSA signals which are inputted to liquid crystal drivers 105-1 to 105-4. Numeral 1805 denote a scanning circuit, and numeral 1806 denotes a scanning signal line for transferring a scanning signal. Numeral 1807 denotes a liquid crystal panel which has a two-screen construction. The resolving power of an upper display screen portion is 320 (dots)×120 (lines) and that of a lower display screen portion is 320 (dots)×120 (lines). The total resolving power is 320 (dots)×240 (lines).

Figure 19:
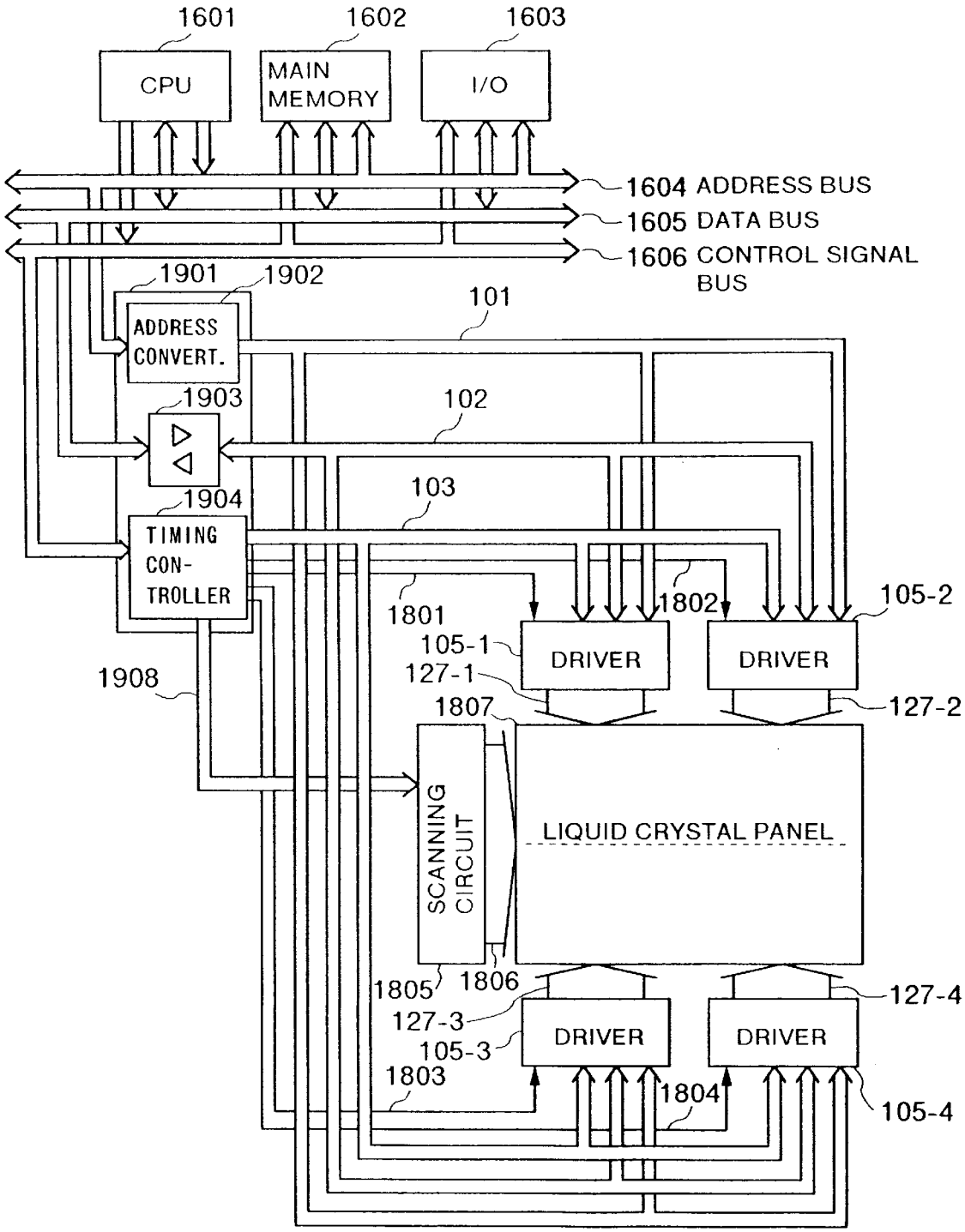
FIG. 19 is a block diagram of a system using the liquid crystal display shown in FIG. 18.

FIG. 19 is a block diagram of a system when the liquid crystal display shown in FIG. 18 is used.

In FIG. 19, reference numeral 1901 denotes a liquid crystal controller. Numeral 1902 denotes an address converter by which an address transferred from the CPU 1601 is converted into an address corresponding to a memory map of the liquid crystal driver 105. Numeral 1903 denotes to a buffer, and numeral 1904 denotes a timing control circuit. Numeral 1908 denotes to a control signal bus for transferring a control signal for scanning circuit 1805.

Figure 20A:
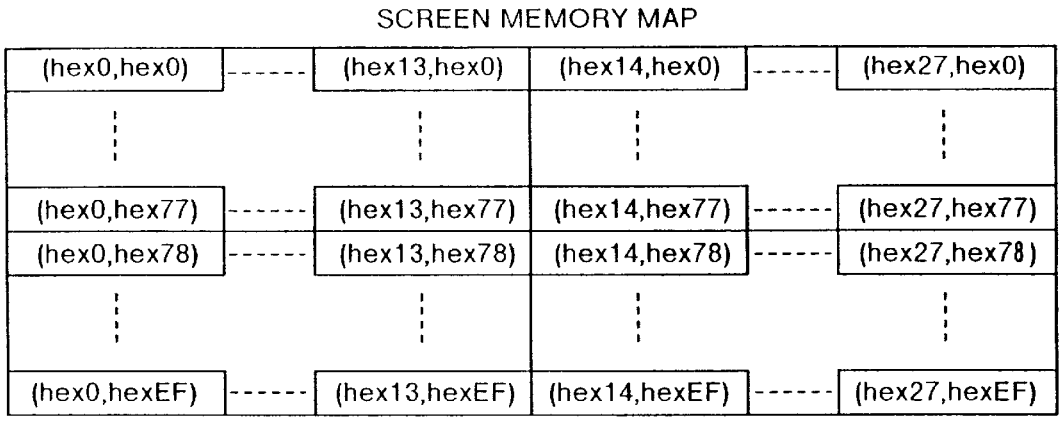
FIG. 20A is a screen memory map of the liquid crystal display system of FIG. 18 when seen from the CPU.
Figure 20B:
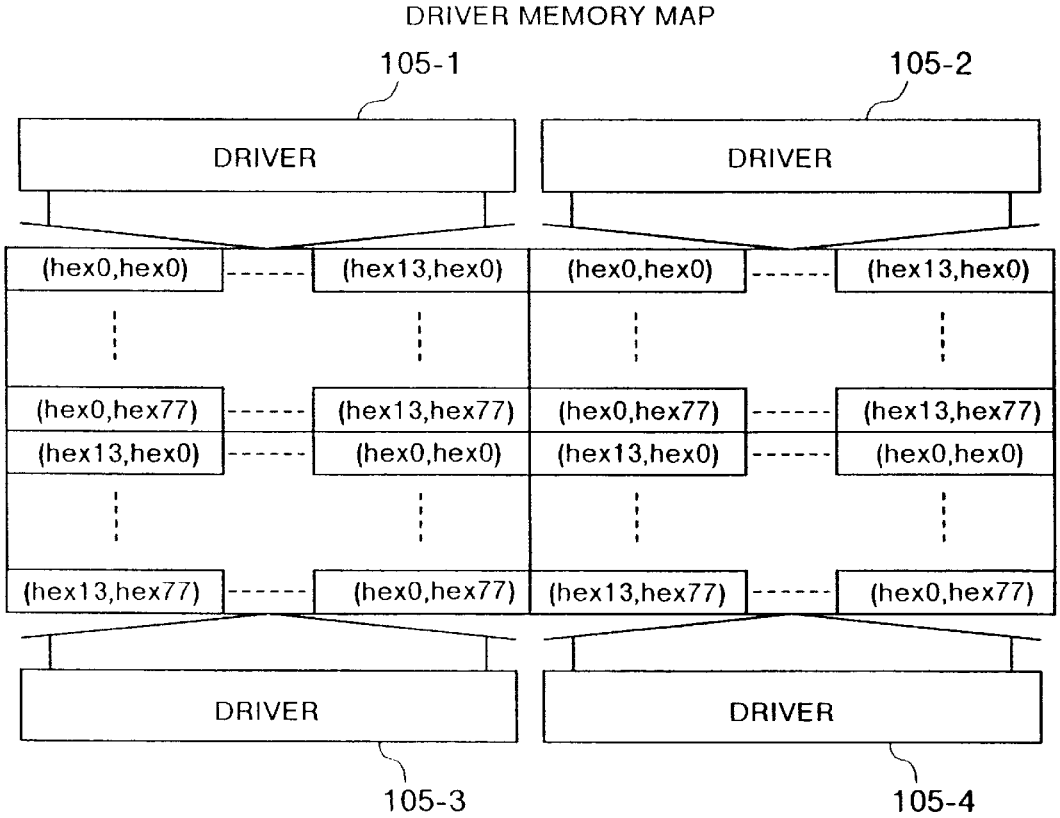
FIG. 20B is a driver memory map thereof when seen from the liquid crystal driver.

FIG. 20A is a screen memory map of the two-screen driving liquid crystal display system of FIG. 18 when seen from the CPU 1601, and FIG. 20B is a driver memory map thereof when seen from the liquid crystal driver 105.

The second embodiment will now be explained using the system block diagram shown in FIG. 18.

The scanning circuit 1805 generates a scanning signal for simultaneously driving the upper and lower display screen portions of the liquid crystal panel 1807 and supplies it through the scanning signal line 1806 to the upper and lower display screen portions of the liquid crystal panel 1807. The liquid crystal drivers 105-1 and 105-2 output liquid crystal applied voltages corresponding to display data for the upper display screen portion of the liquid crystal panel 1807 through output voltage lines 127-1 and 127-2 in accordance with the RAS signals 1801 and 1802. Similarly, the liquid crystal drivers 105-3 and 105-4 output liquid crystal applied voltages corresponding to display data for the lower display screen portion of the liquid crystal panel 1807 through output voltage lines 127-3 and 127-4 in accordance with the RAS signals 1803 and 1804. The operation of the liquid crystal driver is similar to the first embodiment.

Next, the two-screen driving liquid crystal display system will be explained using FIG. 19.

An address, data and a control signal outputted from the CPU 1601 are transferred to the address converter 1902, the buffer 1903 and the timing control circuit 1904 of the liquid crystal controller 1901 through the address bus 1604, the data bus 1605 and the control signal bus 1606, respectively. The address transferred to the address converter 1902 is converted into an address corresponding to a memory map of the liquid crystal drivers 105-1 to 150-4. A screen memory map when seen from the CPU 1601 and a driver memory map when seen from the liquid crystal drivers 105-1 to 105-4 will be explained using FIG. 20.

The screen memory map when seen from the CPU 1601 is such that the X coordinate of the upper display screen portion includes hex0 to hex27 and the Y coordinate thereof includes hex0 to hex77. Similarly, the X coordinate of the lower display screen portion includes hex0 to hex27 and the Y coordinate thereof includes hex78 to hexEF. On the other hand, the driver memory map when seen from the liquid crystal driver is such that the upper display screen portion takes a state in which two driver maps each including the X coordinate values of hex0 to hex13 and the Y coordinate values of hex0 to hex77 are arranged side by side. Since the scanning circuit 1805 scans the liquid crystal panel 1807 from up to down in order, the lower display screen portion takes a state of the driver memory map which has the reversed X coordinate values for the driver memory map of the upper display screen portion. Therefore, the address converter 1902 performs no address conversion in the case where RAS1801 is "L" and converts the X coordinate values hex14 to hex27 of the screen memory map into hex0 to hex13 when RAS1802 is "L". In the case where RAS1803 is "L", the X coordinate values hex0 to hex13 of the screen memory map are converted into hex13 to hex0 and the Y coordinate values hex78 to hexEF are converted into hex0 to hex77. In the case where RAS1804 is "L", the X coordinate values hex14 to hex27 of the screen memory map are converted into hex13 to hex0 and the Y coordinate values hex78 to hexEF are converted into hex0 to hex77. With such address conversion, it is possible to make correspondence to the driver memory map of the liquid crystal driver, thereby performing correct address designation.

The other operation of the liquid crystal display system shown in FIG. 19 is similar to the first embodiment.

By thus providing the address converter corresponding to the two-screen driving, the two-screen driving becomes possible even if the liquid crystal driver of the present invention is used.

The first and second embodiments concern the case where binary display is made. Next, explanation will be made of the case where grayscale display is made.

First, a third embodiment, in which a frame rate control system (hereinafter abbreviated to FRC) is used and four-grayscale display is made, will be explained by use of FIGS. 21 to 23.

Figure 21A:
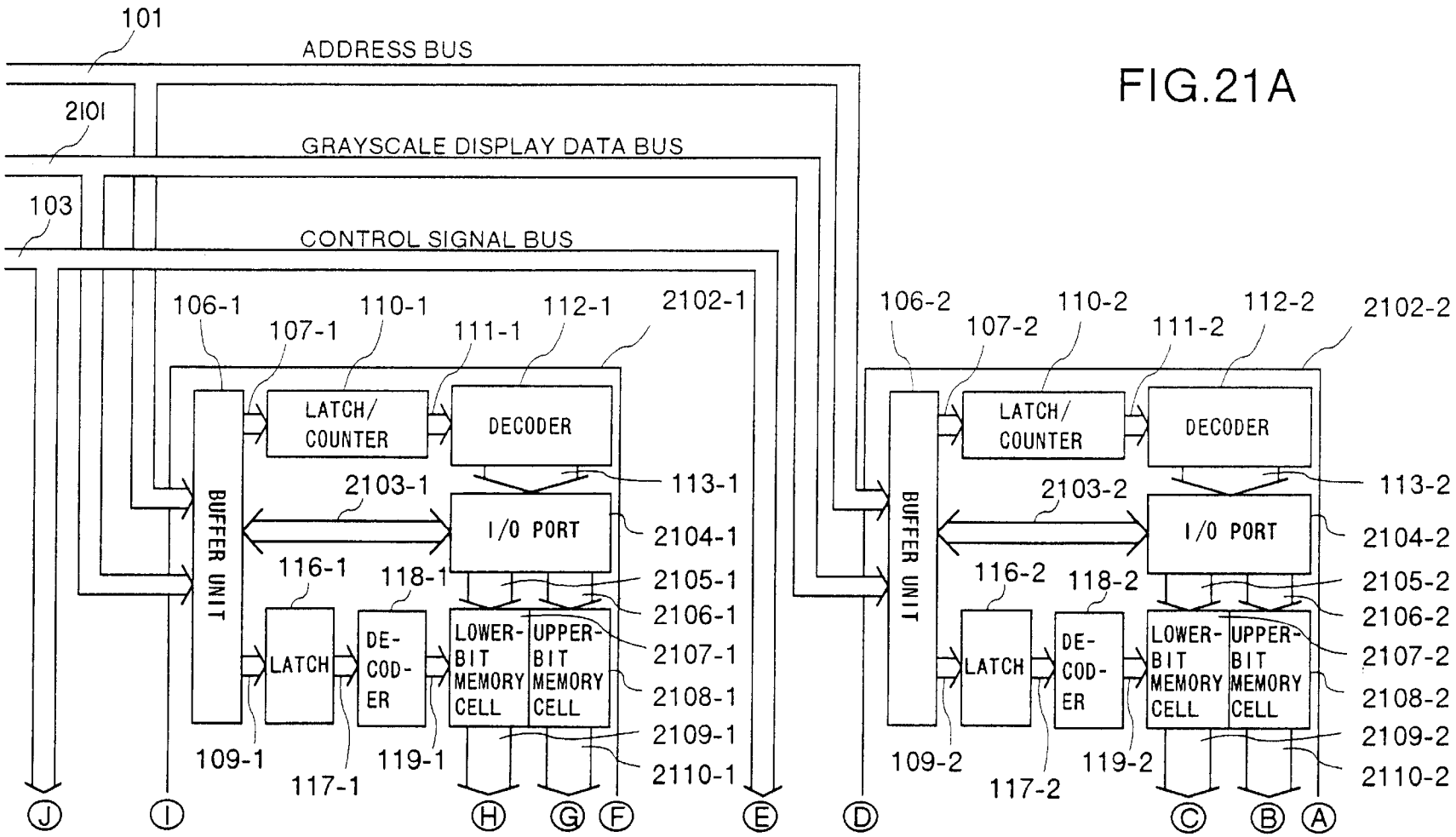
FIGS. 21A, 21B and 21C show a block diagram of a liquid crystal display according to a third embodiment in which the liquid crystal driver of the present invention using an FRC as a grayscale system is used.
Figure 21B:
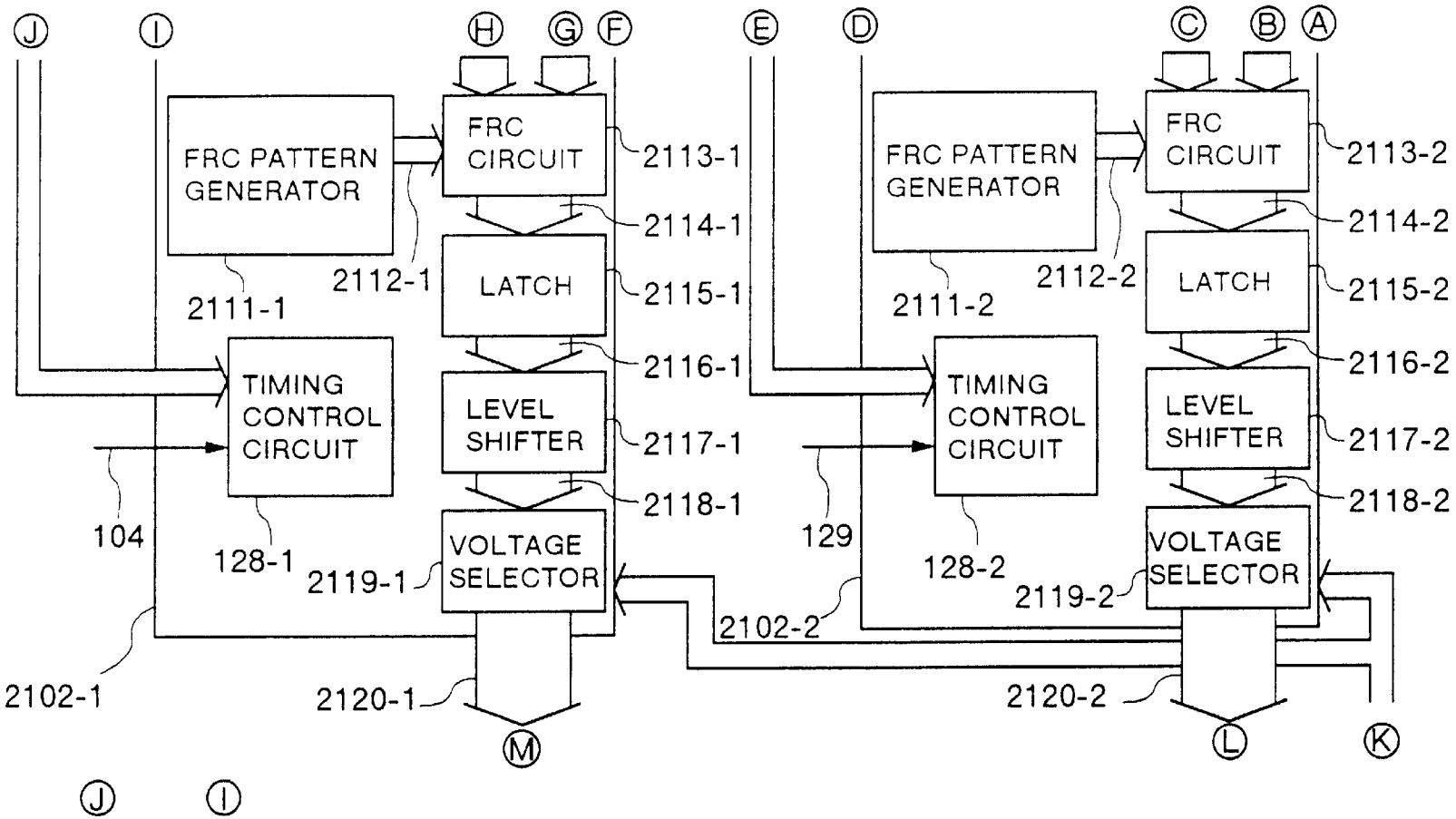
Figure 21C:
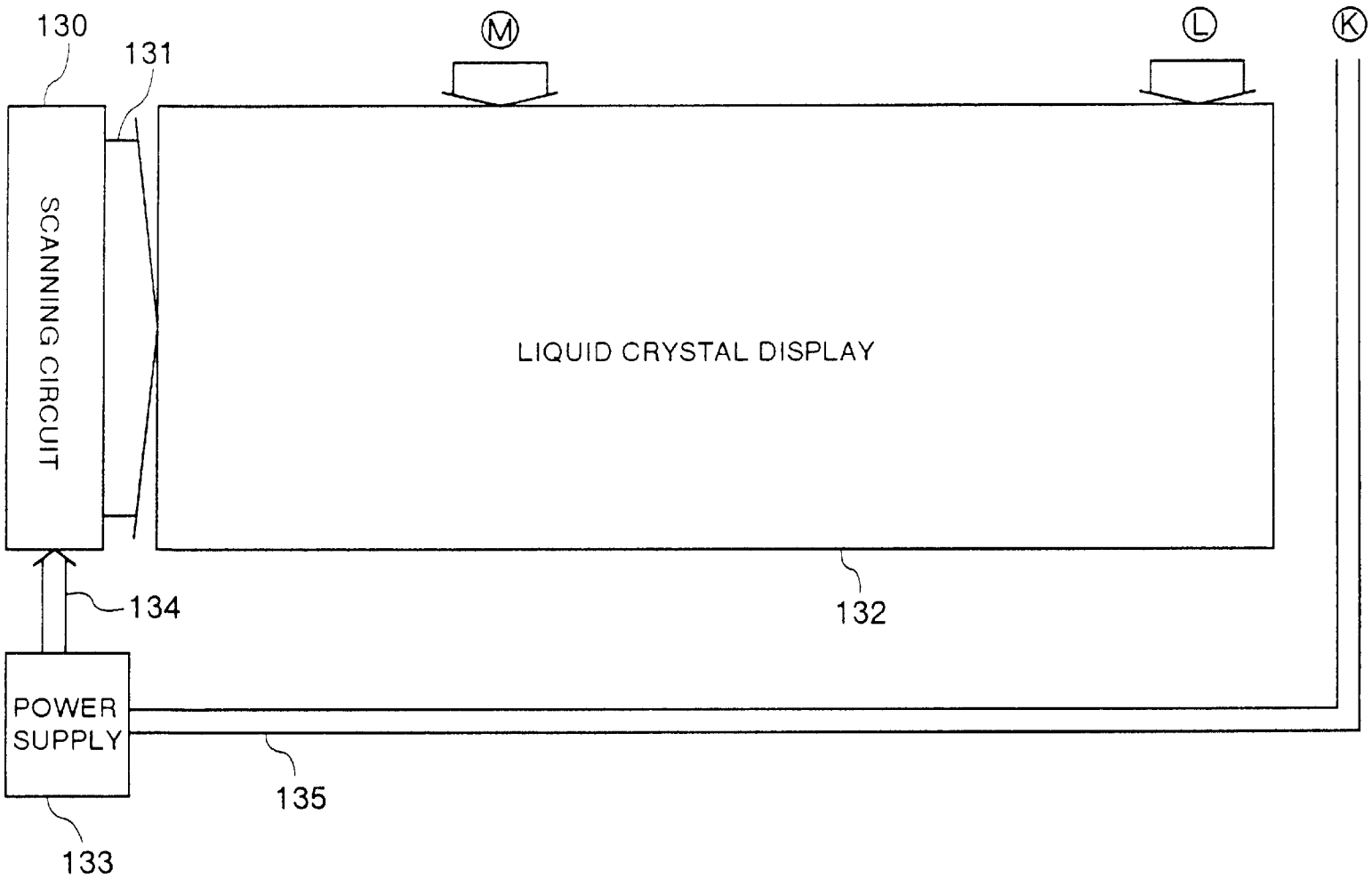

FIG. 21 is a block diagram of a liquid crystal display in the third embodiment using the liquid crystal driver of the present invention in which the FRC is used.

In FIG. 21, reference numeral 2101 denotes a data bus for transferring grayscale display data, and numeral 2102 denotes a liquid crystal driver in which the FRC is used as a grayscale system. Numeral 2103 denotes a data bus for transferring grayscale display data, and numeral 2104 denotes an I/O port for performing the input/output control of the grayscale display data. Numeral 2105 denotes a lower-bit data bus for transforming lower-bit data of the grayscale display data, and numeral 2106 denotes an upper-bit data bus for transforming upper-bit data thereof. Numerals 2107 and 2108 denote memory cells for storing therein the lower-bit data and the upper-bit data, respectively, and numerals 2109 and 2110 denote a lower-bit data bus and an upper-bit data bus for transferring data outputted from the memory cells 2107 and 2108, respectively. Numeral 2111 denotes an FRC pattern generator, numeral 2112 a signal line for transferring an FRC display pattern, and numeral 2113 an FRC circuit for selects an FRC pattern corresponding to the grayscale display data and outputs the selected FRC pattern as FRC display data. Numeral 2114 denotes a data bus for transferring the FRC display data for one horizontal line selected by the FRC circuit 2113, and numeral 2115 denotes a latch for simultaneously latching the FRC display data for one horizontal line. Numeral 2116 denotes a data bus for transferring FRC display data outputted from the latch 2115, numeral 2117 a level shifter, numeral 2118 a data bus for transferring the FRC display data voltage subjected to voltage level shift by the level shifter 2117, numeral 2119 a voltage selector, and numeral 2120 an output voltage line for supplying a liquid crystal applied voltage selected by the voltage selector 2119 to the liquid crystal panel 132.

Figure 22:
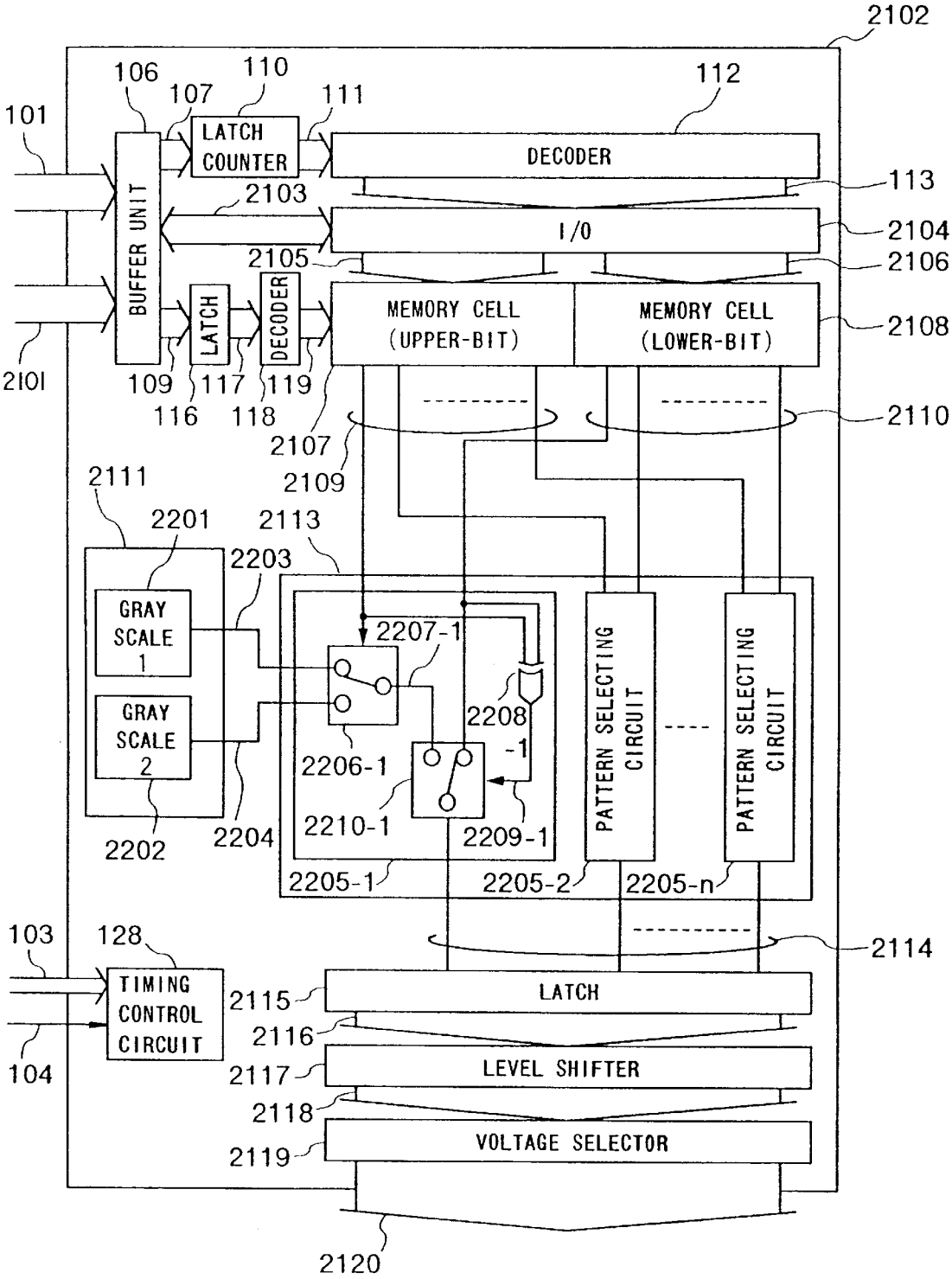
FIG. 22 is a detailed block diagram of the liquid crystal driver shown in FIG. 21.

FIG. 22 is a detailed block diagram of the liquid crystal driver 2102 in which the FRC in the present embodiment is used.

In FIG. 22, reference numerals 2201 and 2202 denote FRC patterns incorporated in the FRC pattern generating circuit 2111. The pattern 2201 is a grayscale 1 indicative of light gray and the pattern 2202 is a grayscale 2 indicative of dark gray. Numerals 2203 and 2204 denote signal lines for transferring the FRC patterns 2201 and 2202, respectively, and numerals 2205-1 to 2205-n FRC pattern selecting circuits. Numeral 2206 denotes a switch for selecting the FRC patterns 2201 and 2202 in accordance with the lower-bit data. Numeral 2207 denotes a signal line for transferring an FRC pattern selected by the switch 2206, numeral 2208 an EOR element, numeral 2209 a control signal, and numeral 2210 a switch for selecting the FRC pattern and the upper-bit data in accordance with the control signal 2209.

Figure 23:
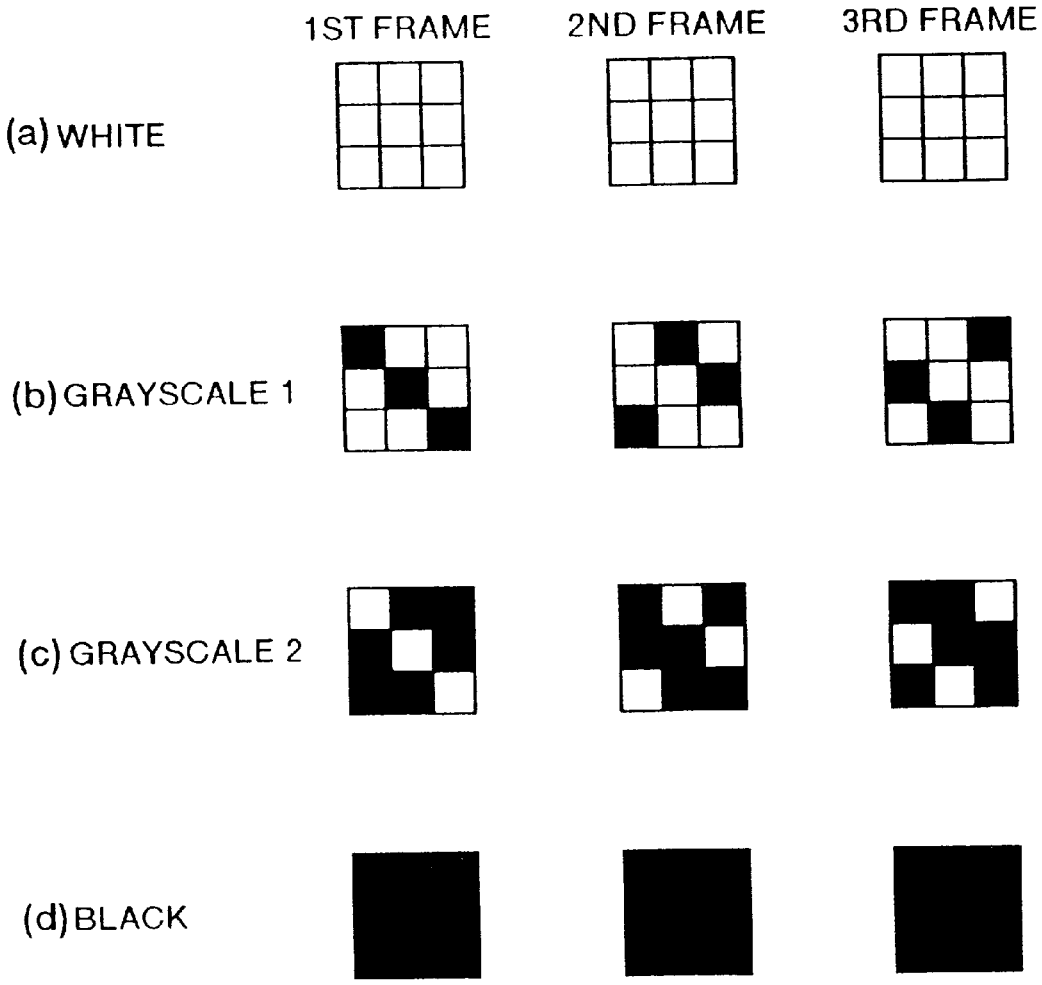
FIG. 23 shows display patterns in the case where the FRC is used.

FIG. 23 shows display patterns in the case where the FRC is used.

The third embodiment using the FRC will be explained using FIG. 21.

A row address and a column address transferred through the address bus 101 are decoded by the row address decoder 118 and the column address decoder 112 as in the first embodiment. The decoded row address is transferred as a decode signal through the signal line 119 to the memory cells 2107 and 2108. Similarly, the decoded column address is transferred as a decode signal from the signal lines 2105 and 2106 to the memory cells 2107 and 2108, respectively, so that the same address is designated for the memory cells 2107 and 2108. Lower-bit data and upper-bit data of display data transferred from the data bus 2101 to the I/O port 2104 through the bus 2103 are respectively outputted to the lower-bit bus 2105 and the upper-bit bus 2106, respectively, so that the lower-bit data and the upper-bit data are stored into the same address of the memory cells 2107 and 2108, respectively. Display data transferred from the memory cells 2107 and 2108 respectively through the lower-bit data bus 2109 and the upper-bit data bus 2110 is supplied to the FRC circuit 2113 which in turn selects an FRC pattern and outputs FRC display data to the data bus 2114. The FRC pattern generating circuit 2111 and the FRC circuit 2113 will now be explained using FIG. 22.

In the FRC pattern generating circuit 2111, FRC patterns for displaying the grayscale 1 (light grayscale) and the grayscale 2 (dark grayscale) Of four grayscales of white to black are stored as the FRC patterns 2201 and 2202. The FRC pattern will now be explained using FIG. 23.

In the present embodiment, black, grayscale 1, grayscale 2 and white as shown by (d), (b), (c) and (a) of FIG. 23 are displayed when the upper and lower bits of the display data are "00", "01", "10" and "11", respectively. The FRC pattern includes 3×3 dots as one unit. In the case where the grayscale 1 is displayed, three dots of the 3×3 dots are subjected to non-illumination and the other dots are subjected to illumination. Dots to be subjected to non-illumination are the first pixel of the first column, the second pixel of the second column and the third pixel of the third column in the first frame. In the second frame, shift by one pixel to the left is made for each column, that is, the third pixel of the first column, the first pixel of the second column and the second pixel of the third column are subjected to non-illumination. Similarly, in the third frame, the second pixel of the first column, the third pixel of the second column and the first pixel of the third column are subjected to non-illumination. In the subsequent frames, the above is repeated. In the case where the grayscale 2 is displayed, the pixels subjected to illumination and non-illumination are subjected to non-illumination and illumination, respectively. In the case where white or black is displayed, all pixels are subjected to illumination or non-illumination. Accordingly, four-grayscale display is made in such a manner that the number of pixels subjected to illumination is 9, 6, 3 and 0 for white, grayscale 1, grayscale 2 and black, respectively.

Explanation will be made returning to FIG. 22 again.

The EOR element 2208 of each FRC pattern selecting circuit 2205 is inputted with lower-bit data and upper-bit data corresponding to that FRC pattern selecting circuit through the lower-bit data bus 2109 and the upper-bit data bus 2110 and outputs a control signal as an output signal to the switch 2210 through the signal line 2209. The control signal takes "0" when the upper-bit data and the lower-bit data are "00" or "11" and takes "1" when they are "01" or "10". The switch 2210 selects the upper-bit data when the control signal transferred from the signal line 2209 is "0" and selects the FRC pattern inputted through the signal line 2207 when it is "1". With the above operation, in the case where the upper and lower bits of the display data are "11", the switch 2210 selects the upper-bit data so that white is displayed. In the case of "00", the upper-bit data is similarly selected so that black is displayed. In the case of "10", the switch 2206 selects the FRC pattern 2203 and the switch 2210 selects the FRC pattern so that the grayscale 1 is displayed. In the case of "01", the switch 2206 selects the FRC pattern 2204 so that the grayscale 2 is displayed.

With the FRC pattern generating circuit 2111 and the FRC circuit 2113 provided in the liquid crystal driver with internal memory, grayscale display based on the FRC can be made. Also, it is possible to cope with an increase in number of grayscales by increasing the number of FRC patterns.

Next, a fourth embodiment, in which a four-grayscale pulse width modulation system (hereinafter abbreviated to PWM) is used as the grayscale system, will be explained by use of FIGS. 24 and 25.

Figure 24A:
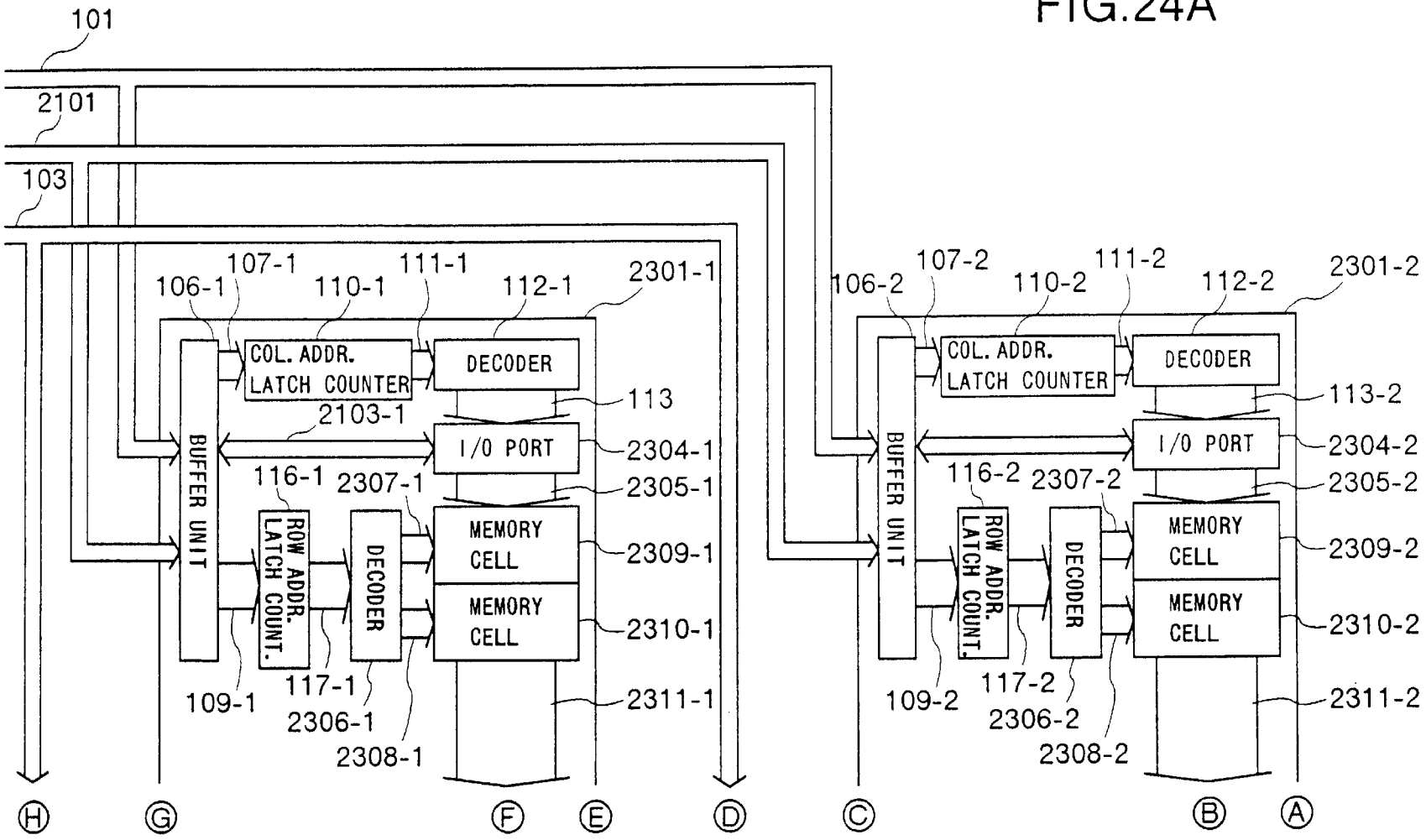
FIGS. 24A and 24B show a block diagram of a liquid crystal display according to a fourth embodiment in which the liquid crystal driver of the present invention using a PWM the grayscale system is used.
Figure 24B:
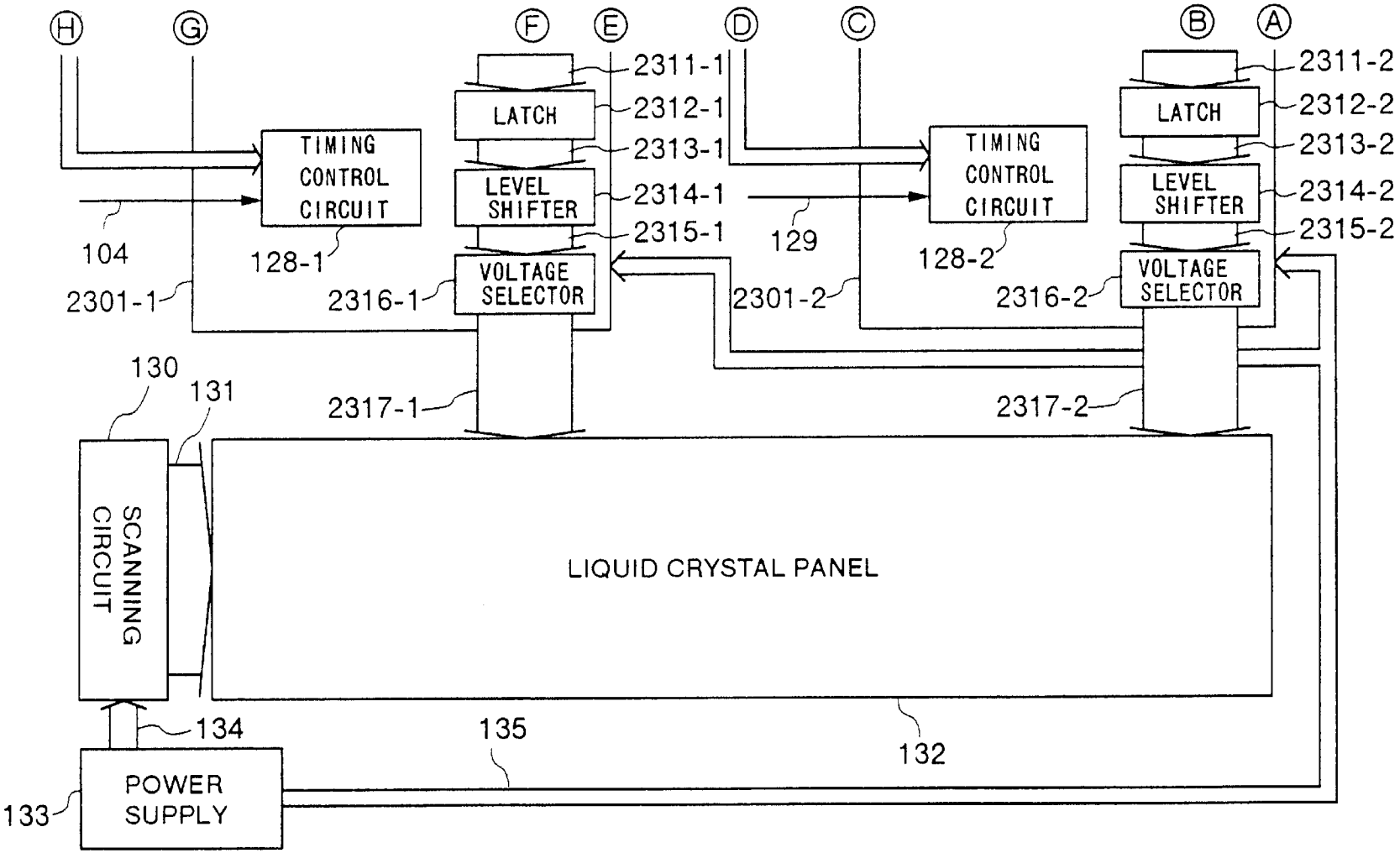

FIG. 24 is a block diagram of a liquid crystal display system using a liquid crystal driver in which the PWM is used as the grayscale system.

In FIG. 24, reference numeral 2301 denotes a liquid crystal display in which the PWM is used as the grayscale system. Numeral 2306 denotes a row address decoder, numerals 2307 and 2308 signal buses for transferring decode signals, and numerals 2309 and 2310 memory cells.

FIGS. 25A to 25D are timing charts for explaining a relationship between a scanning voltage and a liquid crystal applied voltage outputted from the liquid crystal driver 2201 in each grayscale in the case where the PWM is used.

The fourth embodiment will be explained using FIG. 24.

The row address decoder 2306 decodes a transferred row address and outputs a decode signal the memory cells 2309 and 2310 through the signal lines 2307 and 2308, respectively. Upper-bit data and lower-bit data of grayscale display data transferred to the liquid crystal driver 2301 are stored into the memory cells 2309 and 2310, respectively. In one horizontal period, the upper-bit data stored in the memory cell 2309 and the lower-bit data stored in the memory cell 2310 are outputted to a data bus 2311 in a change-over manner. When the outputted grayscale display data is "1", a voltage selector 2316 selects as a liquid crystal applied voltage an ON voltage for displaying white. When the data is "0", the voltage selector 2316 selects an OFF voltage for displaying black. This operation will now be explained using the timing charts shown in FIGS. 25A to 25D.

Figure 25A:
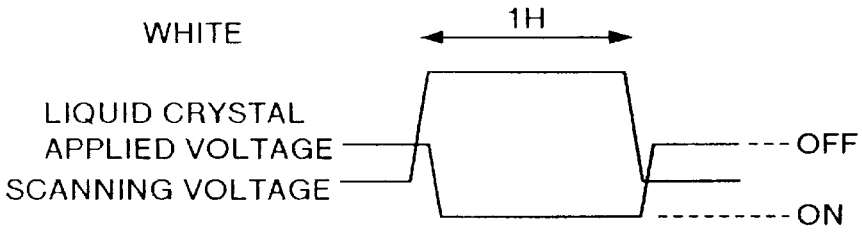
FIGS. 25A to 25D are timing charts of a liquid crystal applied voltage and a scanning voltage in each grayscale in the case where the PWM is used.
Figure 25B:
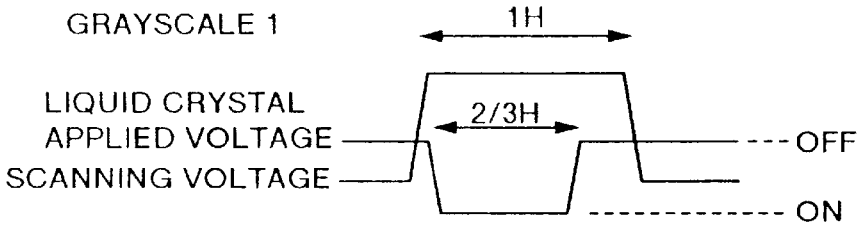
Figure 25C:
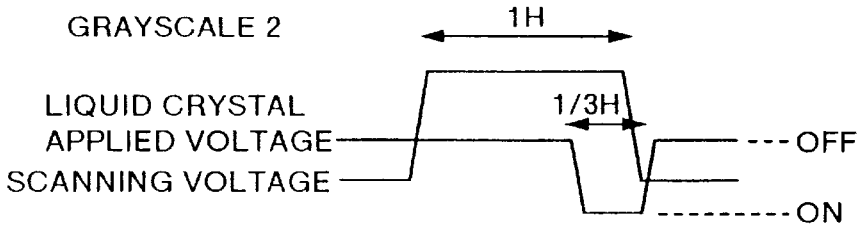
Figure 25D:
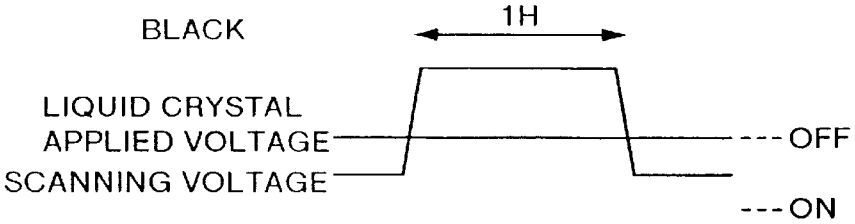

When the display data is outputted from the memory cells 2309 and 2310, the upper-bit data stored in the memory cell 2309 is outputted in the former 2/3H of 1H (one horizontal period) and the lower-bit data stored in the memory cell 2310 is outputted in the latter 1/3H thereof. Accordingly, in the case where the upper and lower bits of the display data are "11", "1" is outputted as display data during 1H so that the ON voltage is selected as the liquid crystal applied voltage to display white, as shown in FIG. 25A. In the case of "10", "1" and "0" are outputted in the former 2/3H and in the latter 1/3H, respectively, so that the ON and OFF voltages are selected as the liquid crystal applied voltages in the former 2/3H and in the latter 1/3H, respectively (see FIG. 25B). Since an effective voltage value(or a difference between the scanning voltage and the liquid crystal applied voltage) in the case of "10" is decreased as compared with that in the case of "11", a grayscale 1 is displayed. Similarly, in the case of "01", the OFF and ON voltages are selected in the former 2/3H and in the latter 1/3H, respectively (see FIG. 25C), so that a grayscale 2 is displayed with the effective voltage value further decreased. In the case of "00", the OFF voltage is selected during 1H (see FIG. 25D) so that black is displayed. Thus, grayscale display becomes possible with the effective voltage value changed by changing a period of time in which the ON or OFF voltage is applied.

The other operation is similar to the operation in the first or third embodiment.

As mentioned above, grayscale display based on the PWM becomes possible by using the liquid crystal driver having a function of performing the PWM. Also, it is possible to cope with an increase in number of grayscales by increasing the number of divisional parts of one horizontal period.

Next, a fifth embodiment, in which the liquid crystal drivers of the present invention are provided in the Y-axis direction (or on the left or right side) of the liquid crystal panel, will be explained by use of FIGS. 26 to 28.

Figure 26:
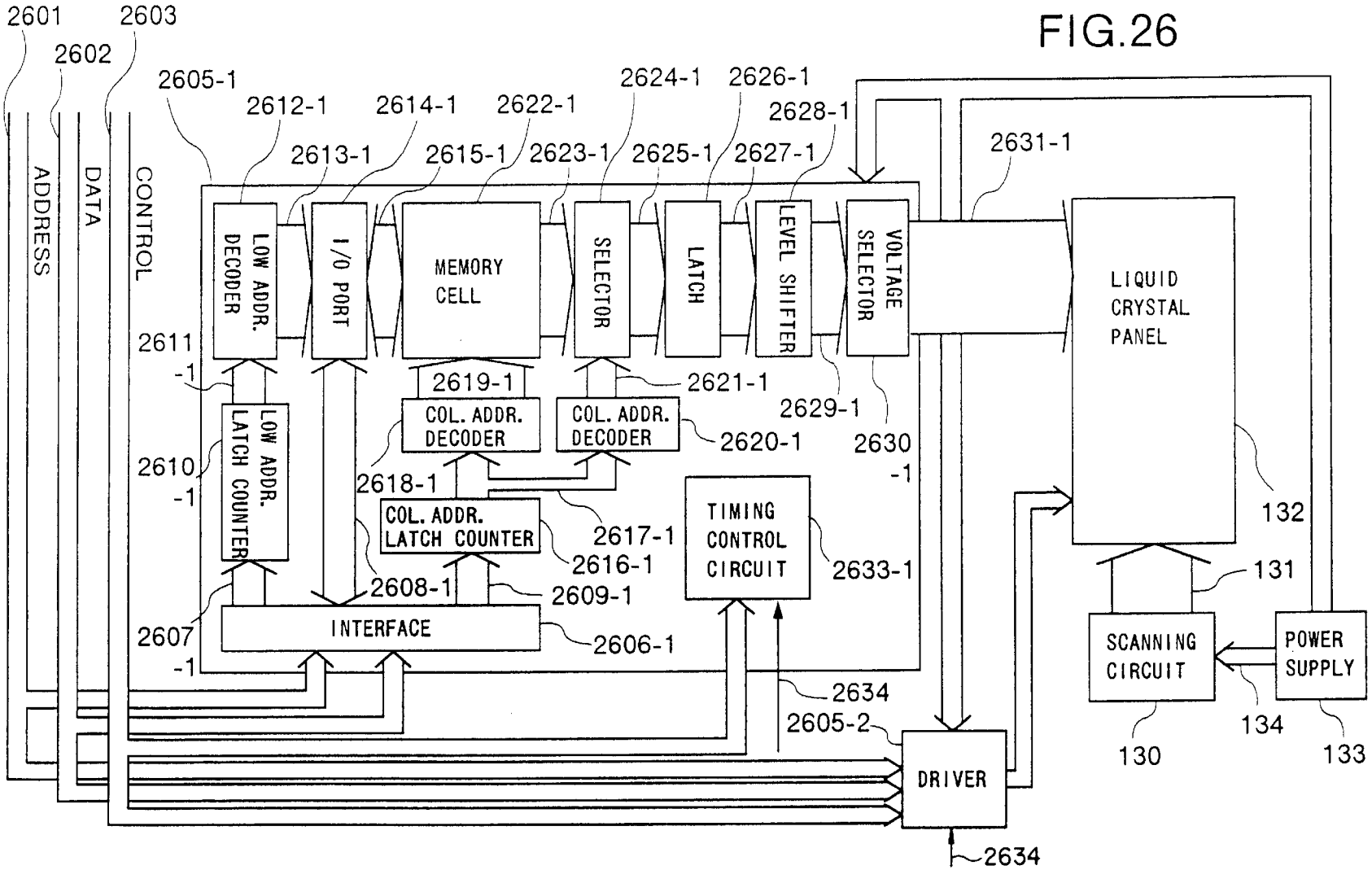
FIG. 26 is a block diagram of a liquid crystal display according to a fifth embodiment in which the liquid crystal driver of the present invention is used.

FIG. 26 is a block diagram of a liquid crystal display in the fifth embodiment using the liquid crystal driver of the present invention.

In FIG. 26, reference numeral 2601 denotes an address bus for transferring an address, numeral 2602 a data bus for transferring display data, numeral 2603 a control signal bus for transferring a control signal, and numeral 2604 a RAS signal having a chip selecting function. Numeral 2605 denotes a liquid crystal driver of the present invention the number of outputs of which is 160 bits. Numeral 2606 denotes a buffer unit for the address bus 2601 and the data bus 2602, numeral 2607 a row address bus for transferring a row address designating a row address of a memory cell, numeral 2608 a data bus for transferring display data, and numeral 2609 a column address bus for transferring a column address designating a column address of the memory cell.

Numeral 2610 denotes a row address latch/counter, and numeral 2611 denotes a row address bus for transferring a row address latched or counted by the row address latch/counter 2610. Numeral 2612 denotes a row address decoder, and numeral 2613 denotes a signal bus for transferring a decode signal decoded by the row address decoder 2612. Numeral 2614 denotes an I/O port for controlling the input/output of display data. Numeral 2615 denotes a data bus for transferring display data. Numeral 2616 denotes a column address latch/counter, numeral 2617 a column address bus for transferring a column address latched or counted by the column address latch/counter 2616, and numeral 2618 a column address decoder for decoding upper bits of the column address transferred through the column address bus 2617. Numeral 2619 denotes a signal bus for transferring a decode signal decoded by the column address decoder 2618.

Numeral 2620 denotes a column address decoder for decoding lower bits of the column address transferred through the column address bus 2617. Numeral 2621 denotes a signal bus for transferring a decode signal decoded by the column address decoder 2620.

Numeral 2622 denotes a memory cell for storing display data. Numeral 2623 denotes a data bus for transferring display data of 1280 (=160×8) bits outputted from the memory cell 2622 in accordance with a display instruction. Numeral 2624 denotes a selector for selecting 8-bit data into 1-bit data. Numeral 2625 denotes a data bus for transferring display data of 160 bits selected by the selector 2604.

Numeral 2626 denotes a latch for simultaneously latching the display data of 160 bits transferred through the data bus 2625. Numeral 2627 denotes a data bus for transferring the display data latched by the latch 2626, and numeral 2628 denotes a level shifter for converting a voltage level of display data into a level corresponding to a liquid crystal applied voltage. Numeral 2629 denotes a data bus for transferring the level-shifted display data, numeral 2630 a voltage selector, and numeral 2631 an output line for transferring a liquid crystal applied voltage selected by the voltage selector in accordance with display data. Numeral 2633 denotes a timing control circuit. Numeral 2634 denotes a RAS signal inputted to the liquid crystal driver 2605-2.

Figure 27:
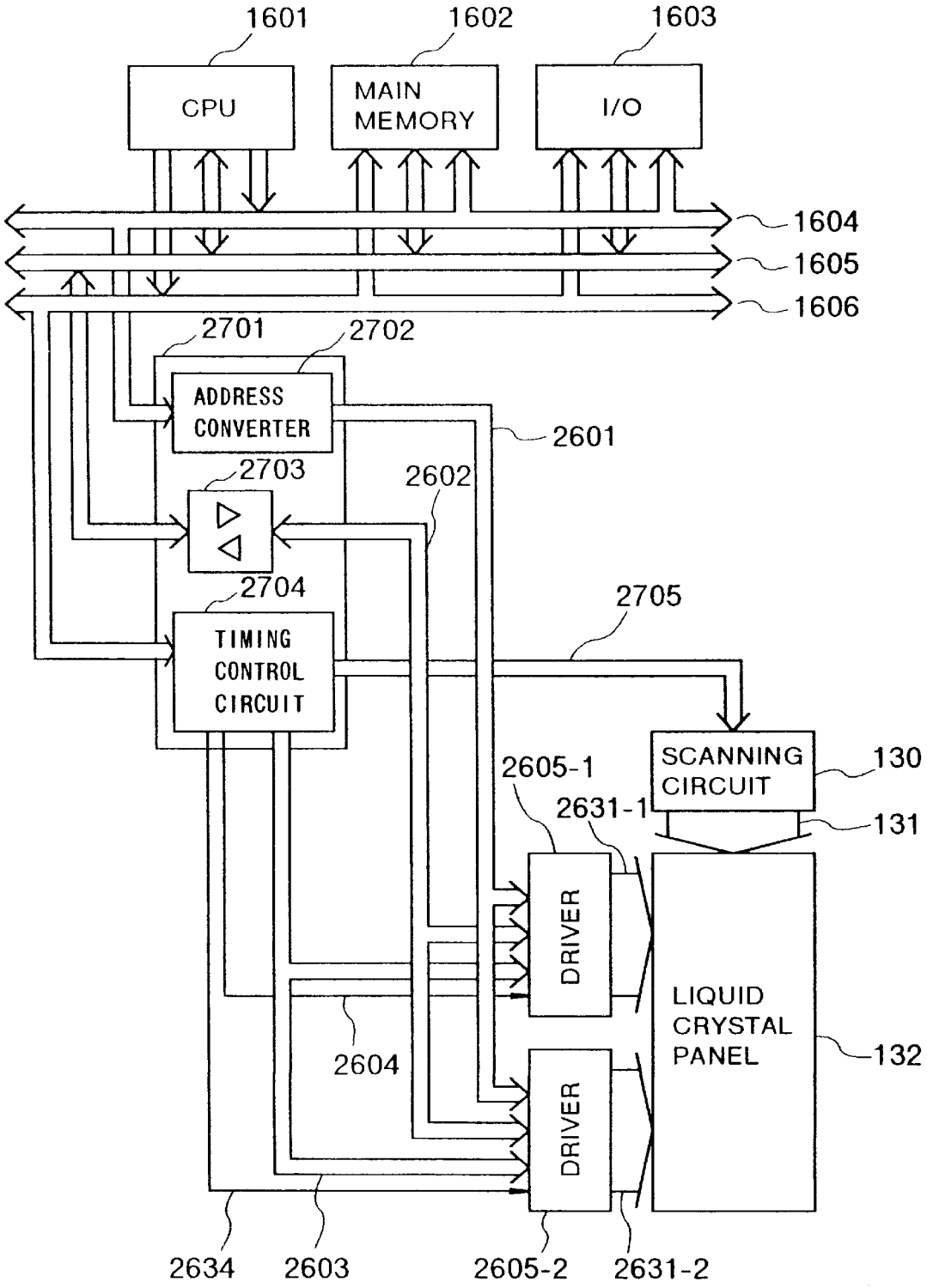
FIG. 27 is a block diagram of a system using the liquid crystal display of the fifth embodiment shown in FIG. 26.

FIG. 27 is a block diagram of a liquid crystal system in the fifth embodiment using the liquid crystal driver 2605 of the present invention.

In FIG. 27, reference numeral 2701 denotes a liquid crystal controller, and numeral 2702 denotes an address converter for converting an address transferred through the address bus 1604 into an X coordinate value (or a row address) and a Y coordinate value (or a column address) corresponding to a memory map of the liquid crystal driver 2605. Numeral 2703 denotes a buffer for display data, numeral 2704 a timing control circuit, and numeral 2705 a control signal of the scanning circuit 130.

Figure 28:
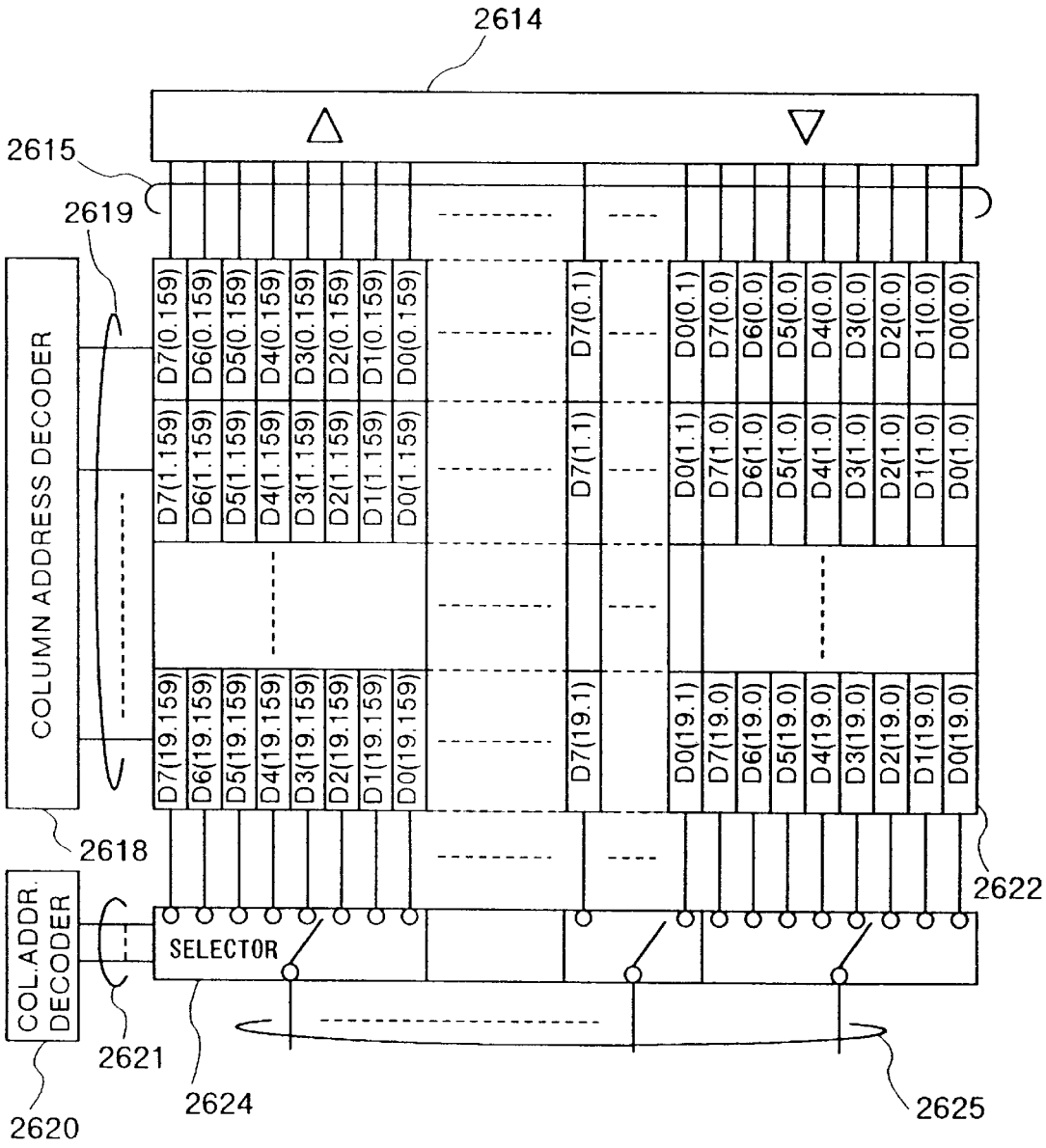
FIG. 28 shows a memory map of a liquid crystal driver shown in FIG. 26.

FIG. 28 shows in units of one bit a memory map of the memory cell 2622 in the liquid crystal driver 2605 of the present invention.

Returning to FIG. 26 again, the fifth embodiment of the present invention will be explained in detail.

In FIG. 26, when data access to the memory cell 2622 in the liquid crystal driver 2605 is to be made, a row address (or an X coordinate value) and a column address (or a Y coordinate value) are multiplex-transferred to the address bus 2601, as explained in conjunction with the first embodiment, and the addresses are taken into the row address latch/counter 2610 and the column address latch/counter 2616 by a control signal transferred by the control signal bus 2603, so that a read/write processing for data stored in the memory cell 2622 is performed through the I/O port 2614.

Since 8-bit data on one address is stored at bits on the memory cell 2622 driven by the same decode line 2619, a data converting function is required at the time of output when it is considered that the system makes the 8-bit data correspond onto respective bits in a transverse or horizontal direction.

Detailed explanation will be made using FIG. 28. Since 8-bit data on one address is stored in the memory cell 2622 on one decode line, there results in a memory map as shown in FIG. 28.

However, in the case where the liquid crystal drivers of the present invention are provided in the Y-axis direction (or on the left or right side) of the liquid crystal panel 132, it is necessary to successively output 8-bit data on the same address from one output line 2631. Therefore, the selector 2624 is provided in the data bus 2623 which transfers data outputted from the memory cell 2622. A decode signal 2621 of lower bits of a column address generated by the column address decoder 2620 is used as a selection signal so that the selector 2624 makes selection one bit by one bit.

Thereby, even if the liquid crystal driver 2605 of the present invention is provided in the Y-axis direction (or on the left or right side) of the liquid crystal panel 132, 8-bit data on one address is arranged in a horizontal direction on the display screen of the liquid crystal panel 132.

Also, in the case where the liquid crystal drivers of the present embodiment are provided in the Y-axis direction (or on the left or right side) of the liquid crystal panel 132, address control or management is made to the liquid crystal controller 2701 shown in FIG. 27, as in the first embodiment.

According to the liquid crystal driver of the embodiment, since the display access of once in one horizontal period suffices to generate and output a liquid crystal applied voltage corresponding to display data, thereby enabling display on a liquid crystal panel, there is provided an effect that it is possible to attain a reduction in power consumption of the whole of a display system including a liquid crystal display.

According to the liquid crystal driver of the embodiment, since the display access of once in one horizontal period suffices, there is provided an effect that it is possible to assign the other period to an updating access, thereby realizing high-speed updating.

According to the liquid crystal driver of the embodiment, since the liquid crystal driver has a general purpose memory interface, a liquid crystal display system can use the liquid crystal driver as a general purpose memory. Accordingly, there is provided an effect that the convenience in use is improved.

According to the liquid crystal driver of the embodiment, since the liquid crystal driver has a grayscale function incorporated therein, there is provided an effect that it is possible to provide a screen which is easy to see.

According to the liquid crystal driver of the embodiment, since respective bits on the same address are arranged in the horizontal direction of a liquid crystal panel either in the case where an oblong liquid crystal display is constructed or in the case where a longitudinal liquid crystal display is constructed, there is provided an effect that it is possible to use the liquid crystal driver without changing the address/data management of a liquid crystal display system for each liquid crystal display.

According to the embodiment, since a plurality of liquid crystal drivers can be used, it is possible to drive a large-area display screen.

Next, a sixth embodiment of a liquid crystal driver according to the present invention will be explained in reference to FIGS. 29 to 44. In FIGS. 29 to 44, the same reference numerals as those used in FIGS. 1 to 28 denote the same components or elements as those shown in FIGS. 1 to 28.

Figure 29A:
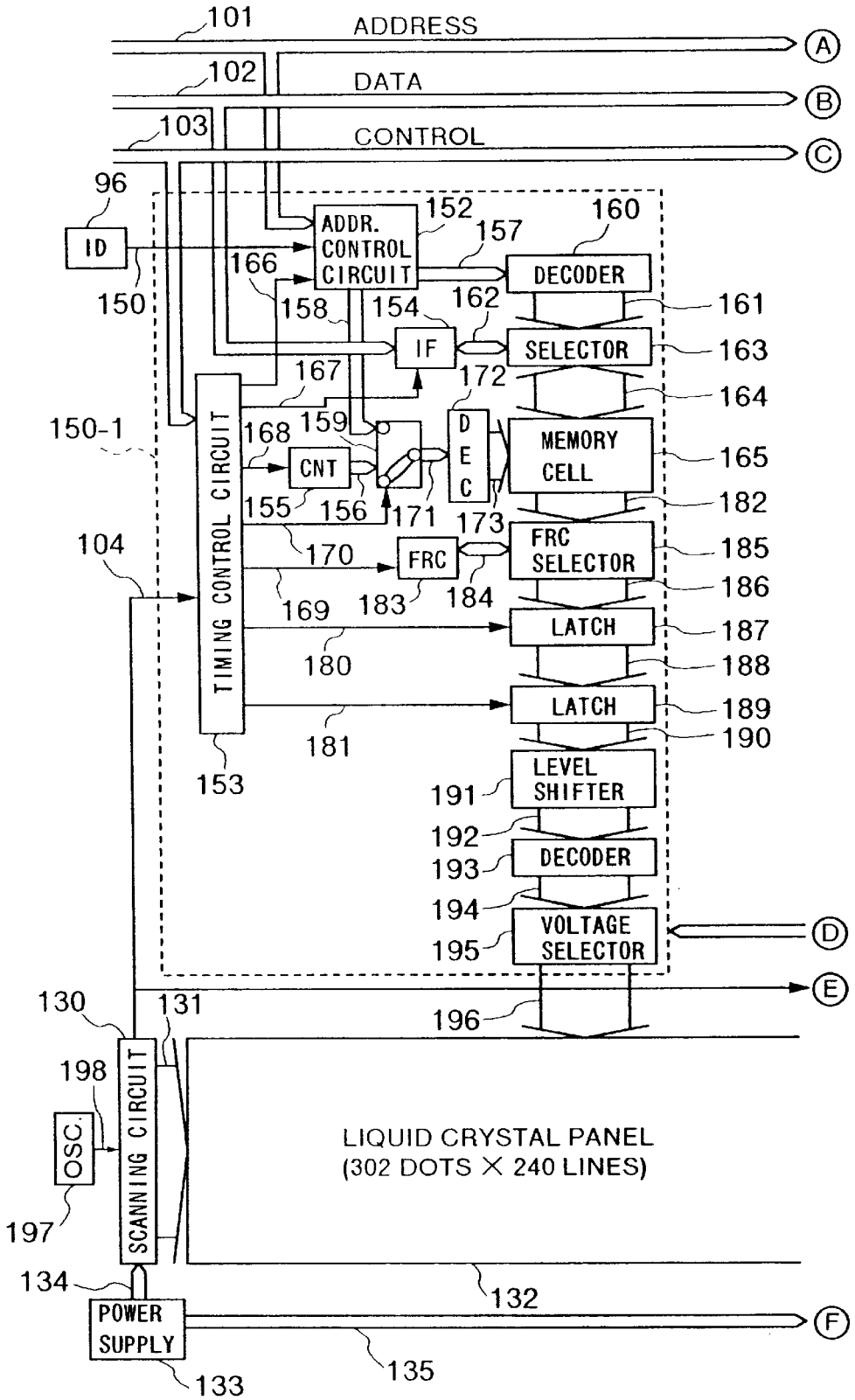
FIGS. 29A and 29B show a block diagram of a liquid crystal display according to a sixth embodiment of the present invention in which the liquid crystal driver of the present invention is used.
Figure 29B:
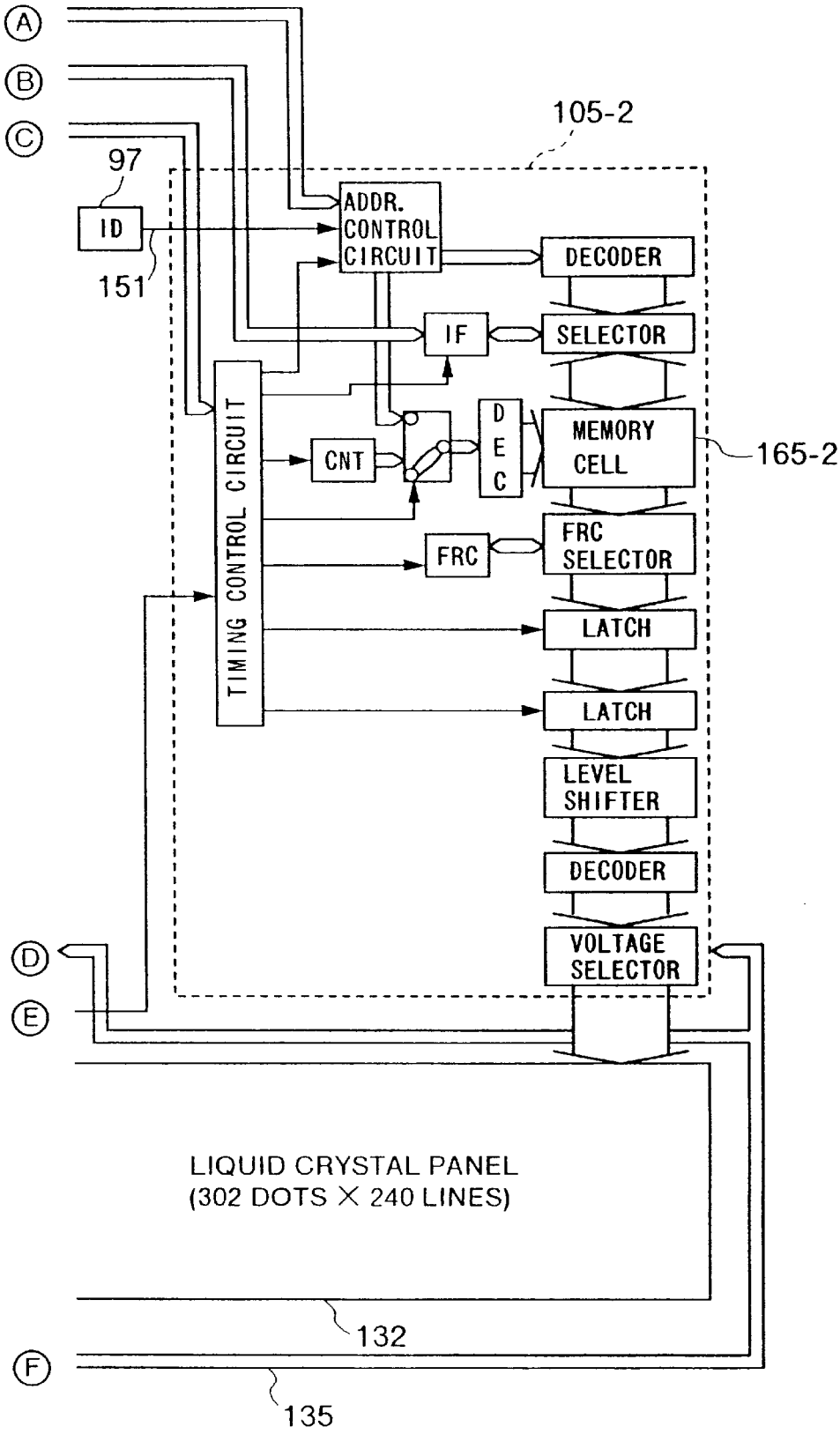

FIG. 29 shows a block diagram of a liquid crystal display using the liquid crystal driver of the present invention.

In FIG. 29, reference numeral 101 denotes an address bus for transferring an address, numeral 102 a data bus for transferring display data, numeral 103 a control signal bus for transferring a control signal, and numeral 104 a display synchronizing signal generated by a scanning circuit 130. Numerals 105-1 and 105-2 each denotes a liquid crystal driver in an integrated circuit form which has the number of outputs equal to 160. Numerals 150 and 151 denote lines of 3-bit address mode signals indicative of the arrangement positions of the liquid crystal drivers 105-1 and 105-2, respectively. In the present embodiment, the address mode signal line 150 receives fixed data of 3 bits from a driver ID generator 96. The address mode signal line 151 receives fixed data of 3 bits from a driver ID generator 97. Driver ID's generated by the driver ID generators 96 and 97 are characteristic data for informing mounted liquid crystal drivers (or liquid crystal driver elements) of their arrangement positions, as will be mentioned later on. The characteristic fixed data can easily be obtained by he combination of a ground potential and a power supply voltage. Numeral 152 denotes an address control circuit for converting an address value inputted from the address bus 101 into a memory address in accordance with the address mode signal line. Numeral 153 denotes a timing control circuit for controlling an updating/display operation on the basis of the control signal bus 103 from the system and the display synchronizing signal 104, numeral 154 an I/O port for performing the input/output control for the data bus 102, numeral 155 a display address counter (CNT) for generating a row address for display, numerals 156 a display address bus, and numerals 157 and 158 a column address and a row address of a memory cell generated by the address control circuit 152. Numeral 159 denotes a selector for selecting an address for display and an address for updating in accordance with a control signal 170, numeral 171 a memory row address selected by the selector 159, numeral 172 a row address decoder (DEC) for selecting a word line of the memory cell, numeral 173 a bus of a selection signal generated by the row address decoder 172, numeral 160 a column address decoder (DEC) for generating a selection signal for selecting a signal line of the memory cell, numeral 161 a bus of the selection signal generated by the column address decoder 160, numeral 162 an input/output bi-directional data bus, numeral 163 a selector for connecting the data bus 162 to a signal line of the memory cell selected by the selection signal bus 161, and numeral 164 a signal line bus through the selector 163. Numeral 165 denotes the memory cell having a capacity of 76800 bits= 160 (pixels)×240 (lines)×2 (bits) corresponding to 160 outputs and 4 grayscales. Numerals 166, 167, 168, 169, 180 and 181 denote control signals generated by the timing control circuit 153. More particularly, numeral 166 denotes a control signal for address conversion, numeral 167 a control signal for control of the input/output of data, numeral 168 a control signal for display address counter, numeral 169 a control signal for controlling an FRC pattern generating circuit (FRC) 183, and numerals 180 and 181 latch signals for display. The FRC (Frame Rate Control) is a system different liquid crystal applied voltages are applied to liquid crystal pixels at a plurality of frame periods to realize grayscale display of the liquid crystal pixels. This system has been disclosed in detail by JP-A-5-210356 filed by the assignee of the present application, which corresponds to U.S. patent application Ser. No. 07/953,807.

Numeral 182 denotes a data bus of 320 lines=160 (outputs)×2 (bits) from the memory cell 165, numeral 174 an FRC data bus, numeral 185 an FRC selector for selecting output data from the FRC data bus 184 and the data bus 182, numeral 186 a data bus of 160 bits, numeral 187 a 160-bit latch circuit for simultaneously latching data of 160 bits of the data bus 186 when the latch signal 180 takes a high level, numeral 188 a data bus of output data from the latch circuit 187, numeral 189 a 160-bit latch circuit for simultaneously latching data of 160 bits on the data bus 188 by virtue of a rising edge of the latch signal 181, numeral 190 a data bus of output data from the latch circuit 189, numeral 191 a level shifter for shifting a signal voltage to a voltage level corresponding to a liquid crystal driving voltage, numeral 192 a data bus of the level-shifted data, numeral 193 a decoder for decoding an alternating current signal and data, numeral 194 a bus of a decoded selection signal, numeral 195 a voltage selector for selecting a liquid crystal applied voltage, and numeral 196 an output signal line. The alternating current signal determines the timing for converting the liquid crystal driving voltage in direct current form into the alternating current form. The alternating current signal is supplied from outside of the driver. Numeral 197 denotes an oscillator for generating a reference clock signal for display, numeral 198 the reference clock signal for display, and numeral 130 the scanning circuit which generates a scanning signal 131 and the display synchronizing signal 104 for liquid crystal driver. Numeral 131 denotes a bus of the scanning signal generated by the scanning circuit 130, and numeral 132 a liquid crystal panel having a resolving power of 320 (dots)×240 (lines). Numeral 133 denotes a power supply circuit, numeral 134 a driving voltage line for driving the scanning circuit 130, and numeral 135 a voltage line for transferring a liquid crystal driving voltage to the liquid crystal driver 105.

In the present embodiment, a SRAM (Static Random Access Memory) is used as the memory cell 165 and a general purpose DRAM (Dynamic Random Access Memory) interface is used as the memory interface. The DRAM interface transfers a row address and a column address in a multiplexing form, thereby making it possible to reduce the number of lines of the address bus. Therefore, the DRAM interface is effective for a portable information equipment which will be mentioned later on.

The operation of the liquid crystal driver in the sixth embodiment of the present invention will now be explained by use of FIG. 29.

First, explanation will be made of an updating operation. As shown in FIG. 29, addresses from the address bus 101 are inputted to the address control circuit 152 and are latched upon falling of a RAS signal and a CAS signal inputted through the timing control circuit 153 from the control signal bus 103. In the address control circuit 153, the latched addresses are converted into a column address 157 and a row address 158 of the memory cell 165. The column address 157 is transferred to the column address decoder 160 so that the selection signal line 161 corresponding to the column address 157 is made valid. The row address 158 is transferred to the selector 159. The selector 156 is controlled by a control signal 170 from the timing control circuit 153 so that the row address 158 is selected and is outputted to the memory row address 171 during an updating access from the CPU. The memory row address 171 is inputted to the row address decoder 172 so that the selection signal bus 173 corresponding to the memory row address is made valid. The data bus 102 is connected to the interface circuit 154 which performs an input/output control. The interface circuit 154 is controlled by a control signal 167 from the timing control circuit 153 so that the interface circuit 154 takes an input/output condition corresponding to a write/read cycle. In the write cycle, the data bus 102 takes an input condition (when seen from the liquid crystal driver 105) to make the selector 163 corresponding to the column address 157 valid so that data is written. On the other hand, since the selection signal bus 173 corresponding to the row address 158 is valid, data of the data bus 102 is written into the memory cell 165 corresponding to the address bus 101. In the read cycle, the data bus 102 takes an output condition (when seen from the liquid crystal driver 105) to make the selector 163 corresponding to the column address 157 valid so that data is read. On the other hand, since the selection signal bus 173 corresponding to the row address 158 is valid, data of the memory cell 165 corresponding to the address bus 101 is outputted to the data bus 102.

Thereby, the updating access to the liquid crystal driver from the system such as CPU becomes possible.

Next, the explanation will be made of a display operation. In the display operation, display data of the memory cell 165 for one line (or one horizontal line) is simultaneously read and the liquid crystal panel 132 is driven in synchronism with a scanning signal from the scanning circuit 130 so that display is made. An FLM signal indicative of a frame period and CL1 signal indicative of a line period for performing the display operation are generated by the scanning circuit 130 and are inputted as a display synchronizing signal 104 to the timing control circuit 153. In accordance with a control signal 168 for display generated by the timing control circuit 153, the display address counter 155 counts at every line period to update a display address and is reset at each frame period. Thereby, it is possible to successively generate display addresses of 0 to 239 at a fixed period. The display address 156 is selected by the selector 159 in accordance with a control signal 170 and is inputted to the row address decoder 172 to make the selection signal bus 173 corresponding to the display address 156 valid so that data of one line is read from the memory cell 165. The read display data is inputted to the FRC selector 185 through the data bus 182. The FRC pattern generating circuit 183 generates an FRC display pattern in accordance with a control signal 169. The FRC display pattern is inputted to the FRC selector 185 through the FRC data bus 184. Based on the display data with two bits for one output from the data bus 182 and the FRC data 184, the FRC selector 185 outputs FRC grayscale display controlled display data with one bit for one output to the data bus 186. The latch circuit 187, which is a level latch circuit, latches the display data 186 when a display latch signal 180 takes a low level. The latch circuit 189, which is an edge latch circuit, latches data on the data bus 188 by virtue of a rising edge of a display latch signal 181. In accordance with a relationship in phase between the display latch signals 180 and 181, data preceding by one line for an address indicated by the display address counter is successively latched at every line period. Data on the data bus 190 is voltage-shifted by the level shifter 191 into a liquid crystal driving voltage and is then outputted to the data bus 192. The decoder 193 decodes an alternating current signal and data on the data bus 192 and outputs a decode signal to the selection signal bus 194. A liquid crystal applied voltage is selected by the voltage selector 195 and is then outputted to the output voltage line 196. On the other hand, the scanning circuit 130 generates a display synchronizing signal FLM indicative of a frame period and a display synchronizing signal CL1 indicative of a line period on the basis of a display reference clock signal 198 generated by the oscillator 197 and transfers them as a display synchronizing signal 104 to the liquid crystal driver 105. The scanning circuit 130 successively makes a scanning signal 131 valid one line by one line in synchronism with the display synchronizing signal CL1. Accordingly, a liquid crystal applied voltage corresponding to the display data is outputted from the output voltage line 196 in synchronism with the display synchronizing signal CL1 and the scanning signal 131 is successively made valid, thereby driving the display panel 132.

Thus, the display access to the liquid crystal driver becomes possible.

Next, explanation will be made by use of FIG. 30. The explanation will be made of a liquid crystal display system such as a personal computer or a work station using the liquid crystal driver of the present embodiment in the case where a CPU with DRAM interface is used as in the Hitachi, Ltd. SH Micon Series.

Figure 30:
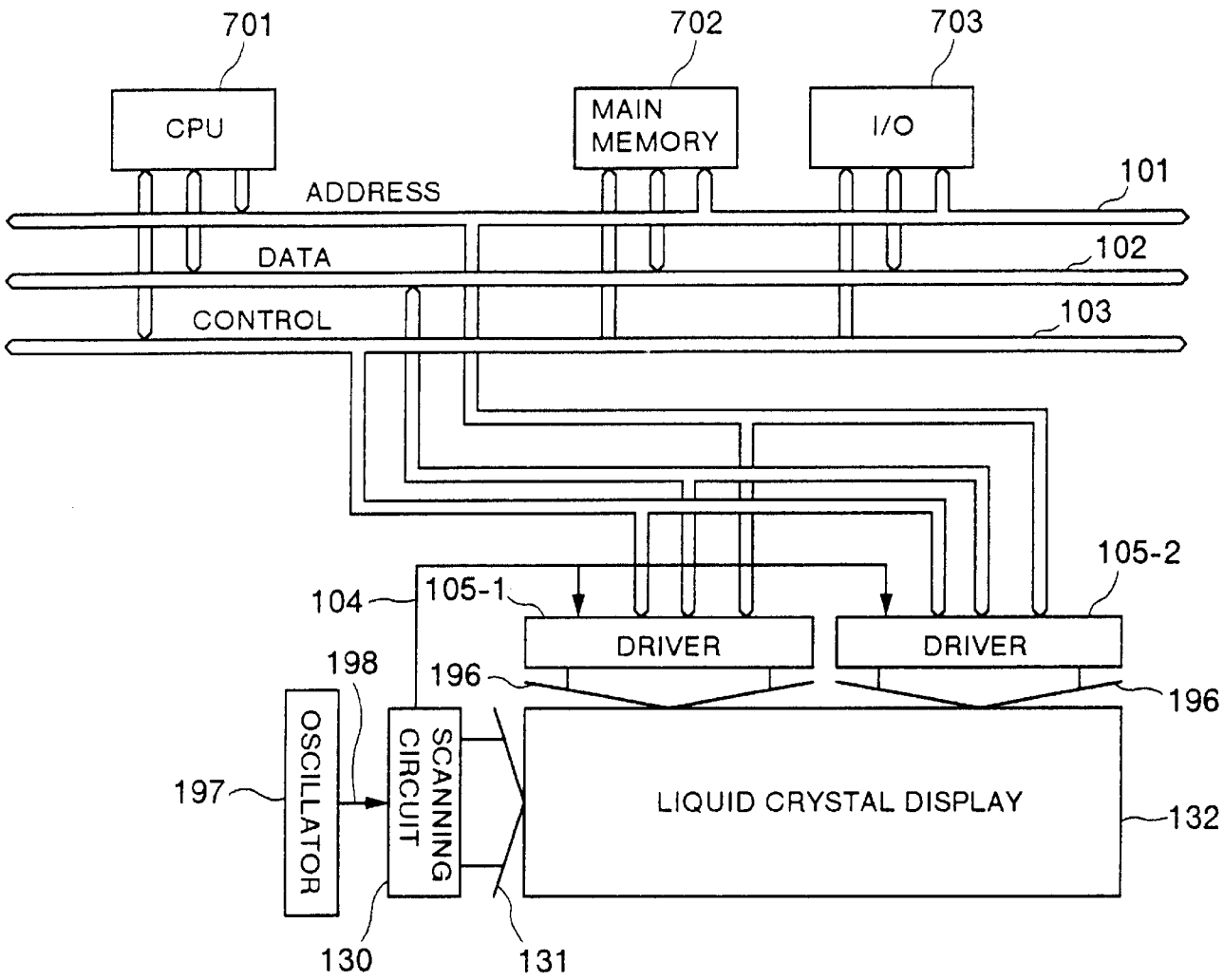
FIG. 30 is a block diagram showing one example of the construction of a liquid crystal display system using the liquid crystal display of the sixth embodiment shown in FIG. 29.

FIG. 30 shows a block diagram of a system using the liquid crystal display in the present embodiment. In FIG. 30, reference numeral 701 denotes a CPU, numeral 702 a main memory, numeral 703 an I/O device, numeral 101 an address bus, numeral 102 a data bus, and numeral 103 a control signal bus. The liquid crystal driver 105 makes an updating access in accordance with an address, data and a control signal transferred through the address bus 101, the data bus 102 and the control signal bus 103 and makes a display access in synchronism with a display synchronizing signal 104 transferred from the scanning circuit 130.

Each of the CPU 701, the main memory 702, the I/O device 703 and the liquid crystal driver 105 is connected to the address bus 101, the data bus 102 and the control signal bus 103 and the CPU 701 can access each of the main memory 702, the I/O device 703 and the liquid crystal driver 105 through the address bus 101, the data bus 102 and the control signal bus 103. A row address and a column address outputted from the CPU 701 are transferred to the liquid crystal driver 105 through the address bus 101. In synchronism with this, memory control signals RAS, CAS and so forth are also outputted from the CPU 701 and are transferred to the liquid crystal driver 105 through the control signal bus 102. The address transferred to the liquid crystal driver 105 is converted by the address control circuit 152 in the liquid crystal driver 105 into an address corresponding to a memory map.

The memory map and the address conversion will now be explained in reference to FIGS. 32A, 32B, 33, 34, 35, 36 and 37.

FIGS. 32A and 32B show memory maps corresponding to the display screen when seen from the CPU and the liquid crystal driver, respectively.

Provided that the allotment of four pixels per one address is made for a display screen of 320 (pixels)×240 (lines), a memory map of the display screen in hexadecimal notation when seen from the CPU 701 is such that the first line includes 00000H to 0004FH, the second line includes 00100H to 0014FH and the 240th line includes 0EF00H to 0EF4FH, as shown in FIG. 32A. The reason why an address skip occurs at the boundary between lines is that eight lower bits of the address and nine upper bits thereof are respectively taken as an X direction address and a Y direction address in order to facilitate an address control. On the other hand, a memory map when seen from the liquid crystal drivers 105-1 and 105-2 is different from the screen memory map when the CPU 701 or takes a memory map of the internal memory cell 165, as shown in FIG. 32B. With six lower bits and eight upper bits of the address of the memory cell 165 being respectively taken as a column direction address and a row direction address, the memory map of each of the liquid crystal drivers 105-1 and 105-2 is such that the first line includes 0000H to 0027H, the second line includes 0040H to 0066H and the 240th line includes 3BC0H to 3BE7H. Therefore, if the address transferred from the CPU 1601 is used as it is, correct address designation for the memory cells 165 incorporated in the the liquid crystal drivers 105-1 and 105-2 cannot be performed. Accordingly, it is required that address conversion from the 8-bit X direction address into the 6-bit column direction address and from the 9-bit Y direction address into the 8-bit row direction address is performed by the address control circuit 152. Thus, the address control circuit 152 converts the 8-bit X direction address into the 6-bit column direction address and the 9-bit Y direction address into the 8-bit row direction address, thereby performing address conversion for the first line from CPU addresses 00000H to 00027H into addresses 0000H to 0027H of the memory cell 165-1 and from CPU addresses 00028H to 0004FH into addresses 0000H to 0027H of the memory cell 165-2, such successive address conversion for each line, and address conversion for the last line from CPU addresses 0EF00H to 0EF27H into addresses 3BC0H to 3BC0H of the memory cell 165-1 and from CPU addresses 0EF28H to 0EF4FH into 3BC0H to 3BE7H of the memory cell 165-2. With such address conversion, it is possible to make the correspondence of the memory map of the CPU to the memory map of the memory cell 165, thereby performing correct address designation.

The arrangement positions of the plurality of liquid crystal drivers 105 for the liquid crystal panel are set by an address mode signal. The address conversion in each arrangement configuration is performed as follows.

As shown in FIG. 33, an address mode signal (150 or 151), which is a 3-bit control signal including MODEA2, MODEA1 and MODEA0, is inputted to the liquid crystal driver 105. By decoding the address mode signal, it is possible to recognize a position where the liquid crystal driver 105 itself is arranged, that is, to identify the liquid crystal driver itself with one of eight drivers ID0 to ID7.

FIGS. 34, 35, 36 and 37 show the arrangement configuration of liquid crystal drivers and address ID's in the cases where the resolving power of the liquid crystal panel is 160 (pixels)×240 (lines), 320 (pixels)×240 (lines), 320 (pixels)×480 (lines), and 640 (pixels)×480 (lines), respectively. From those figures (especially, FIG. 37), in the present embodiment, one driver is longitudinally used so that ID is determined in such an order that a left/upper driver is ID0, a driver below the driver ID0 is ID1, the next driver on the right side of the driver ID0 is ID2, a driver below the driver ID2 is ID3, the next driver on the right side of the driver ID2 is ID4, and a driver below the driver ID4 is ID5. In such arrangement configuration, a scanning (or line scan) direction is a longitudinal or vertical direction.

In the case of the liquid crystal display system of FIG. 29 or 30 corresponding to the configuration shown in FIG. 35, the address mode signal 150 of the driver 105-1 is set to be MODEA2, A1, A0="000" or driver ID=0 and the address mode signal 151 of the driver 105-2 is set to be MODEA2, A1, A0="010" or driver ID=2. Namely, a change-over to an address control corresponding to the liquid crystal arrangement position of the liquid crystal driver is made by the setting of the address mode signal, thereby enabling correct address designation for the memory cell 165.

Further, the CPU can access the plurality of liquid crystal drivers 105 individually in such a manner that whether or not the access from the CPU is an access to each liquid crystal driver itself is judged from the address mode signal line and an inputted address to generate a chip selection signal in that liquid crystal driver. In the case of the liquid crystal display system of FIG. 29 or 30, the address mode signal 150 of the driver 105-1 is set to be MODEA2, A1, A0="000" (driver ID=0) and the address mode signal 151 of the driver 105-2 is set to be MODEA2, A1, A0="010" (driver ID=2). Thereby, for example, when an address "0EF27H" is designated from the CPU 701, the liquid crystal driver 105-1 internally generates a chip selection signal and the access is performed. When an address "0EF28H" is designated from the CPU 701, the liquid crystal driver 105-2 internally generates a chip selection signal and the access is performed.

Next, explanation will be made by use of FIG. 31. The explanation will be made of a liquid crystal display system such a personal computer or a work station using the liquid crystal driver of an embodiment in the case where a CPU provided with no DRAM interface is used as in the Hitachi, Ltd. H8 Series.

Figure 31:
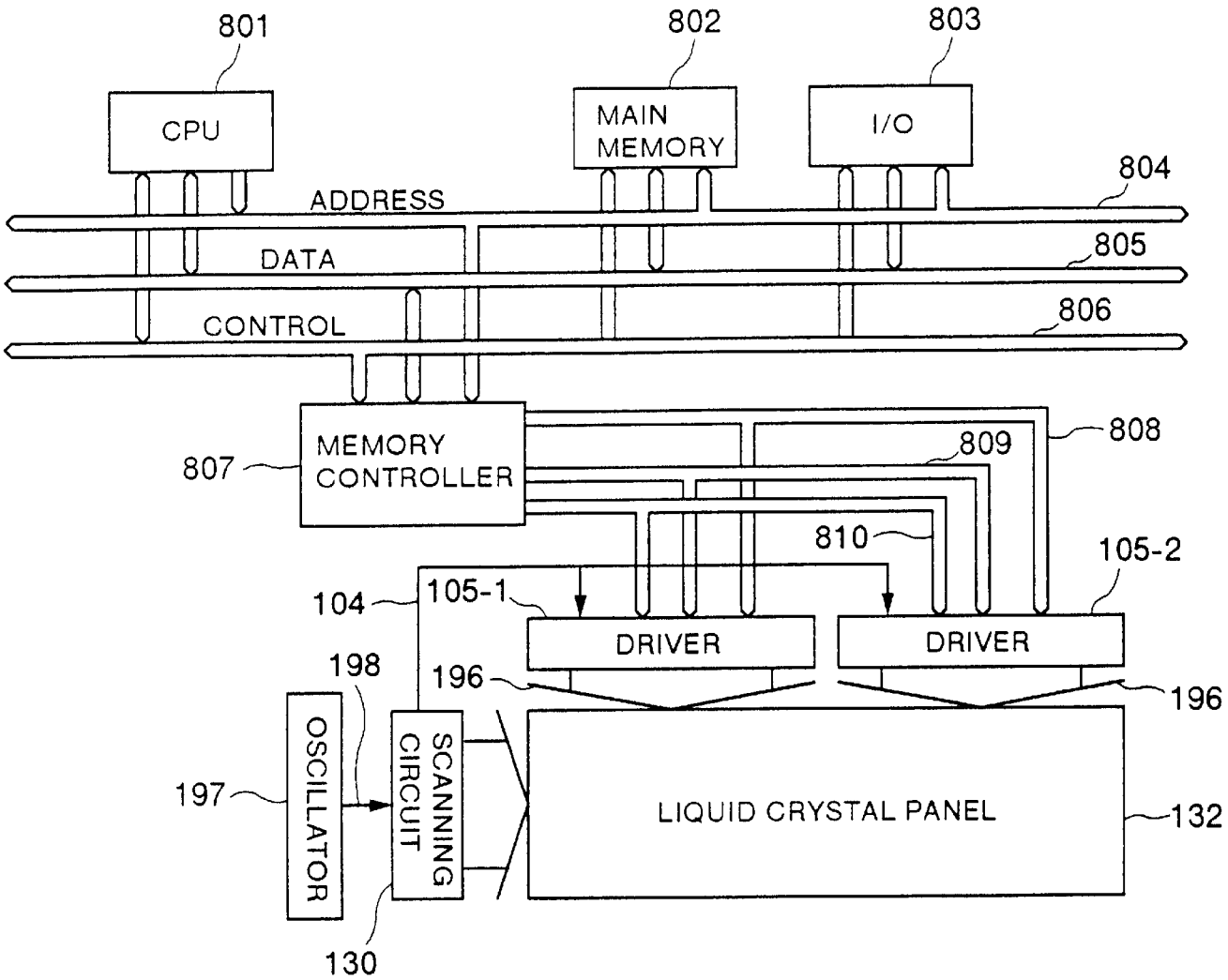
FIG. 31 is a block diagram showing another example of the construction of a liquid crystal display system using the liquid crystal display of the sixth embodiment shown in FIG. 29.
Figure 36:
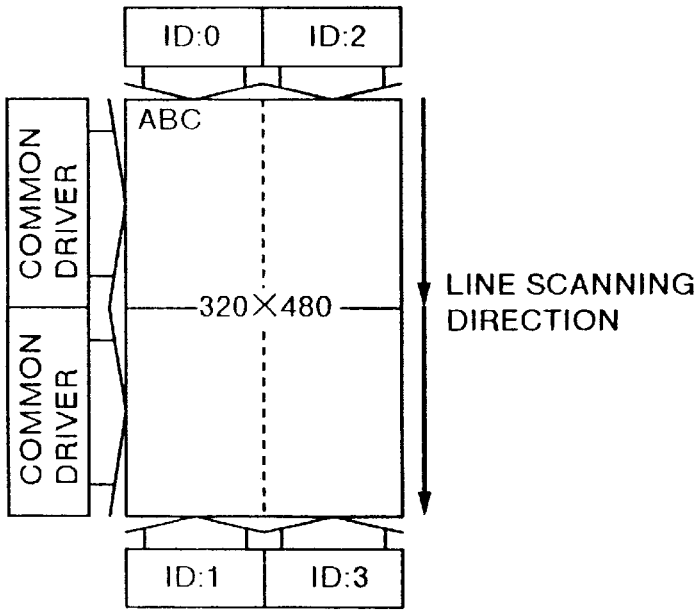

In FIG. 31, reference numeral 804 denotes an address bus, numeral 805 a data bus, and numeral 806 a control signal bus. Numeral 807 denotes a memory controller for receiving the address bus 804, the data bus 805 and the control signal bus 806 to perform a control for the updating access of the liquid crystal driver 105 to the memory, and numerals 808, 809 and 810 denote an address bus, a data bus and a control signal line for a memory updating which are controlled by the memory controller 807 and are connected to the address bus 101, the data bus 102 and the signal control bus 103 connected to the liquid crystal driver 105.

Each of a CPU 801, a main memory 802, an I/O device 803 and a memory controller 807 is connected to the address bus 804, the data bus 805 and the control signal bus 806 so that the CPU 801 can access each of the main memory 802, the I/O device 803 and the memory controller 807 through the address bus 804, the data bus 805 and the control signal bus 806. An address outputted from the CPU 801 is transferred to the memory controller 807 through the address bus 804 and is latched. In synchronism with this, a control signal is also outputted from the CPU 801 and is transferred to the memory controller 807 through the control signal bus 806. The memory controller 807 outputs a row address, a column address and memory control signals RAS, CAS and so forth, on the basis of the address and the control signal inputted from the address bus 804 and the control signal bus 806, to the address data bus 808 and the control signal bus 810 in a timed relation, thereby making access to the liquid crystal driver 105. The operation of the liquid crystal driver 105 is similar to that in the liquid crystal display system shown in FIG. 30.

Next, the detailed timing of an updating memory access of the liquid crystal driver 105 will be explained by use of FIGS. 29 and 38 to 44.

Figure 38:
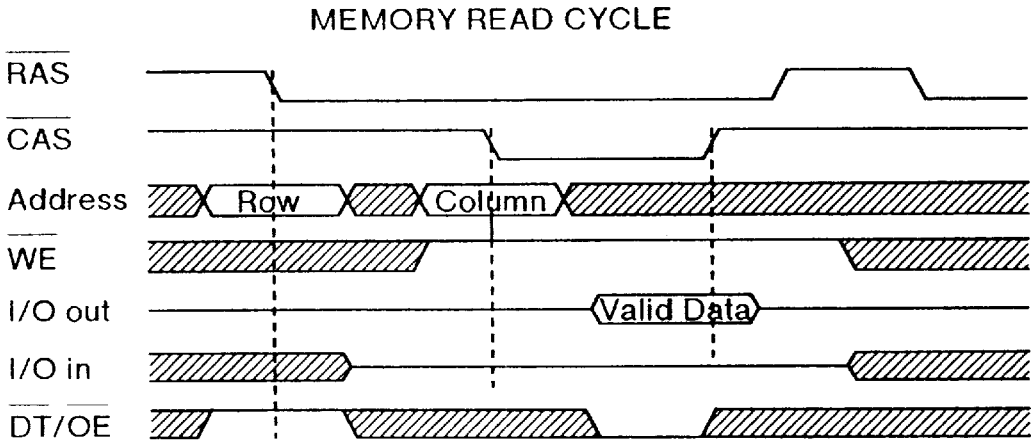
FIG. 38 is a timing chart showing a memory read cycle.

A memory read cycle will be explained using FIG. 38. A row address and a column address are inputted from the address bus 101. The taking-in of the row address is made upon falling of a RAS signal inputted from the control signal bus 103, and the taking-in of the column address is made upon falling of a CAS signal. The address control circuit 152 performs the above-mentioned address conversion to designate a row address and a column address of the memory cell 165 from which read data is outputted in a period of time when a DT/OE signal is in a low level.

Figure 39:
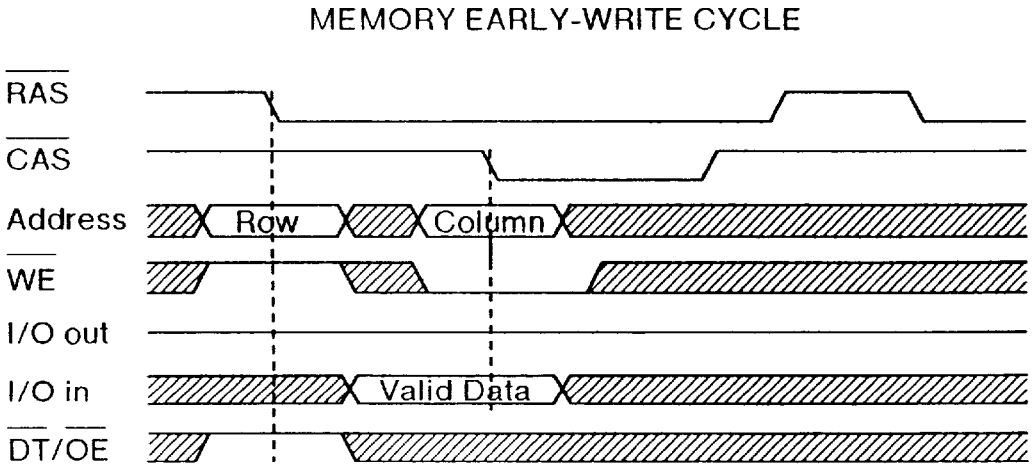
FIG. 39 is a timing chart showing a memory early-write cycle.

A memory write cycle will be explained using FIG. 39. A row address and a column address are inputted from the address bus 101. The taking-in of the row address is made upon falling of a RAS signal inputted from the control signal bus 103, and the taking-in of the column address is made upon falling of a CAS signal. Upon falling of the CAS signal when a WE signal is in a low level, write data is taken in. The address control circuit 152 performs address conversion to designate a row address and a column address of the memory cell 165 into which the write data is in turn written.

Figure 40:
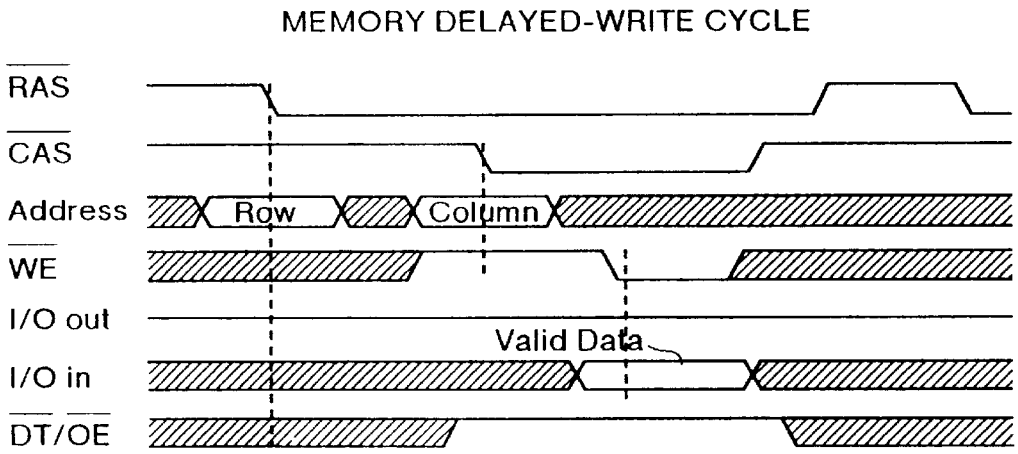
FIG. 40 is a timing chart showing a memory delayed-write cycle.

A memory delayed-write cycle will be explained using FIG. 40. A row address and a column address are inputted from the address bus 101. The taking-in of the row address is made upon falling of a RAS signal inputted from the control signal bus 103, and the taking-in of the column address is made upon falling of a CAS signal. Upon falling of a WE signal when the CAS signal is in a low level, write data is taken in. The address control circuit 152 performs address conversion to designate a row address and a column address of the memory cell 165 into which the write data is in turn written.

Figure 41:
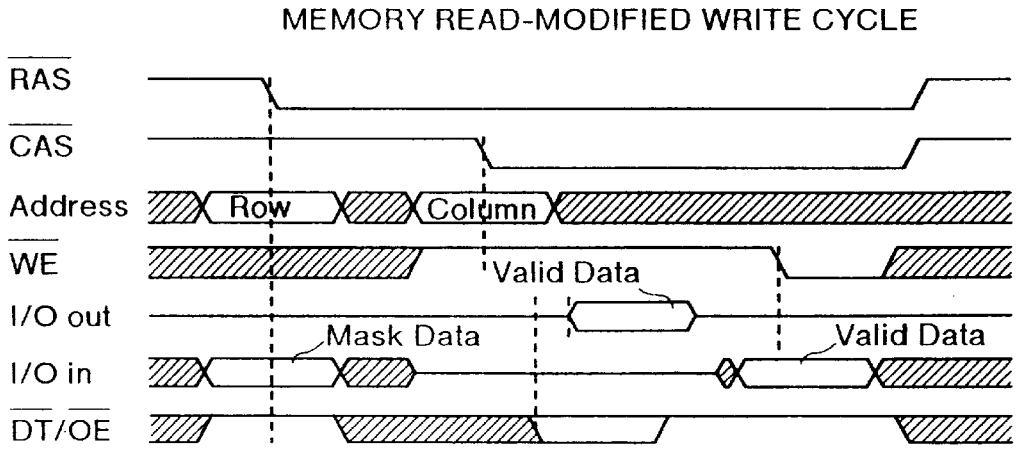
FIG. 41 is a timing chart showing a memory read-modified write cycle.

A memory read-modified write cycle will be explained using FIG. 41. A row address and a column address are inputted from the address bus 101. The taking-in of the row address is made upon falling of a RAS signal inputted from the control signal bus 103, and the taking-in of the column address is made upon falling of a CAS signal. Upon falling of the RAS signal, mask data is taken in. The address control circuit 152 performs address conversion to designate a row address and a column address of the memory cell 165 from which read data is outputted in a period of time when a DT/OE signal is in a low level. Upon falling of a WE signal when the CAS signal is in a low level, write data is taken in. The address control circuit 152 performs address conversion to designate a row address and a column address of the memory cell 165 into which the write data is in turn written while bits corresponding to the mask data are masked.

Next, explanation will be made of a page mode access with which a high-speed access is possible. In the page mode access, access for data of the same row address is made in such a manner that a row address and a column address are first designated as in a random access and only an address is designated in the subsequent cycles. Thereby, high-speed access becomes possible.

Figure 42:
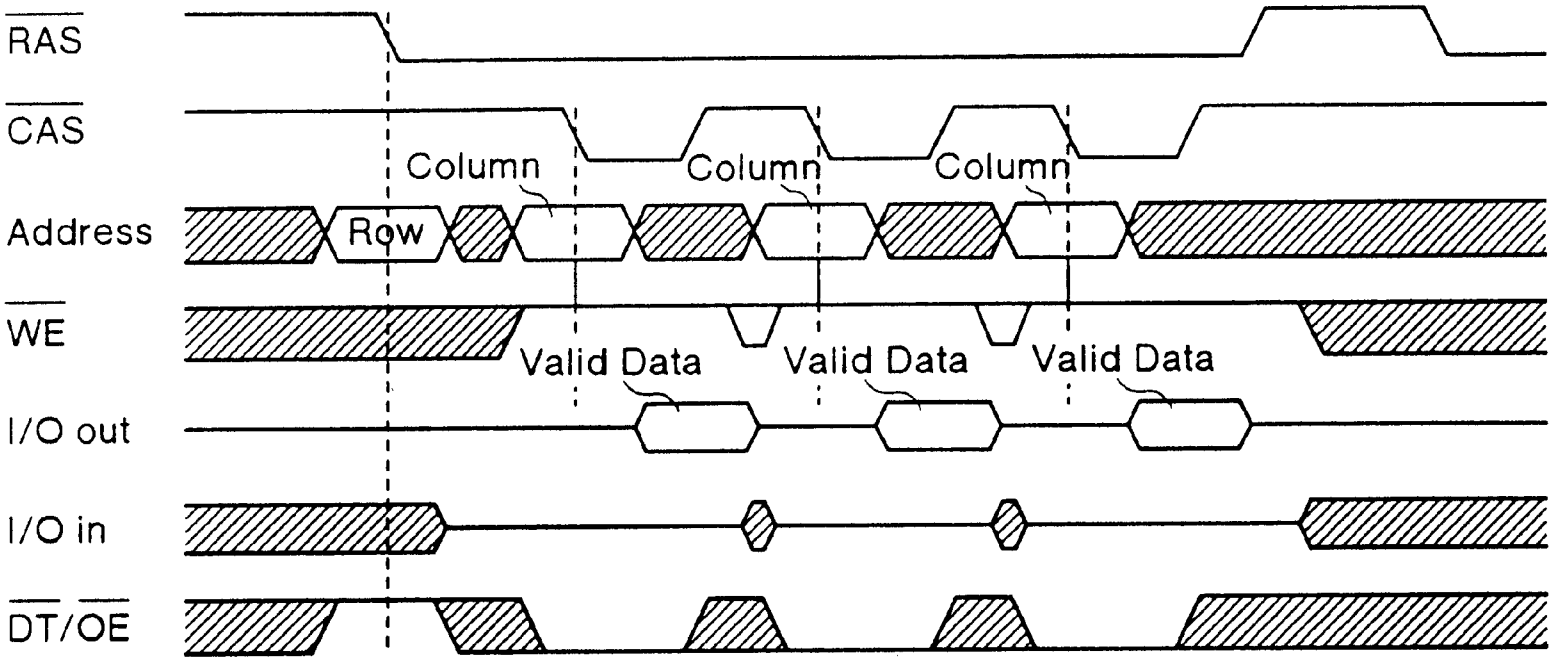
FIG. 42 is a timing chart showing a memory page mode read cycle.

A memory page mode read cycle will be explained using FIG. 42. A row address and a column address are inputted from the address bus 101. The taking-in of the row address is made upon falling of a RAS signal inputted from the control signal bus 103, and the taking-in of the column address is made upon falling of a CAS signal. The address control circuit 152 performs address conversion to designate a row address and a column address of the memory cell 165 from which read data is outputted in a period of time when a DT/OE signal is in a low level. Further, upon falling of the CAS signal when the RAS signal remains in the low level, a column address is taken in again to designate a row address and a column address of the memory cell 165 with the row address unchanged. From the designated memory cell address, read data is outputted in a period of time when the DT/OE signal is in a low level. Subsequently, this operation is repeated to successively output a plurality of read data.

Figure 43:
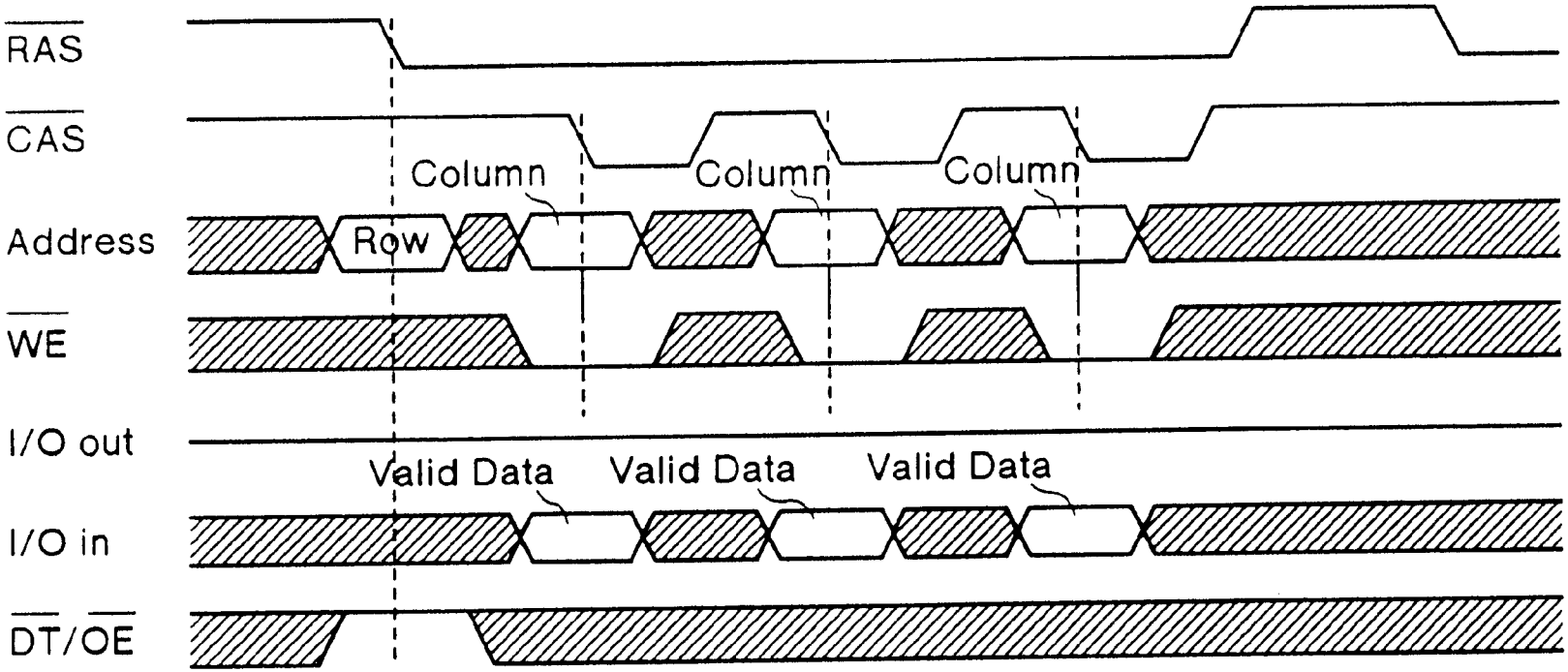
FIG. 43 is a timing chart showing a memory page mode early-write cycle.

A memory page mode early-write cycle will be explained using FIG. 43. A row address and a column address are inputted from the address bus 101. The taking-in of the row address is made upon falling of a RAS signal inputted from the control signal bus 103, and the taking-in of the column address is made upon falling of a CAS signal. Upon falling of the CAS signal when a WE signal is in a low level, write data is taken in. The address control circuit 152 performs address conversion to designate a row address and a column address of the memory cell 165 into which the write data is in turn written. Further, a column address is taken in again upon falling of the CAS signal when the RAS signal remains in the low level, and write data is taken in upon falling of the CAS signal when a WE signal is in a low level. With the row address unchanged, a row address and a column address of the memory cell 165 are designated. The write data is written into the designated memory cell address. Subsequently, this operation is repeated to successively write a plurality of write data.

Figure 44:
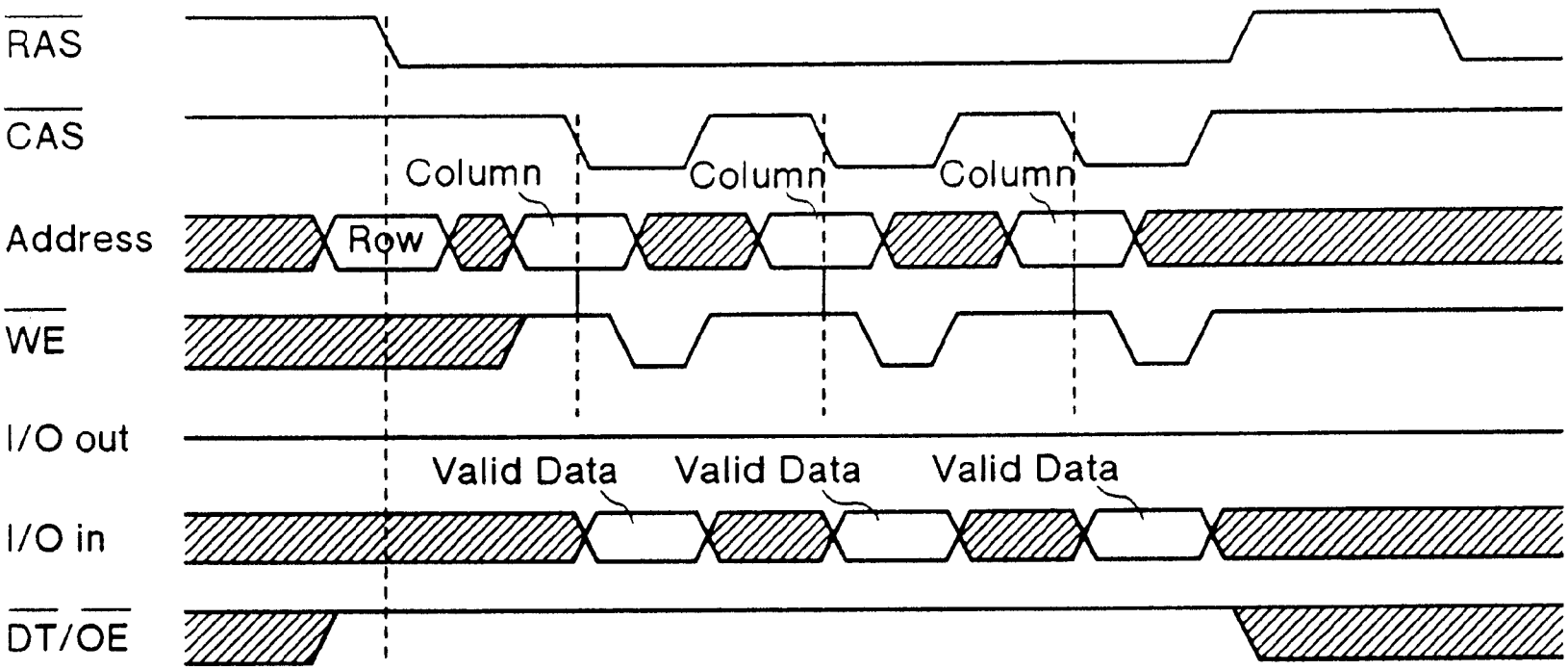
FIG. 44 is a timing chart showing a memory page mode delayed-write cycle.

A memory page mode delayed-write cycle will be explained using FIG. 44. A row address and a column address are inputted from the address bus 101. The taking-in of the row address is made upon falling of a RAS signal inputted from the control signal bus 103, and the taking-in of the column address is made upon falling of a CAS signal. Upon falling of a WE signal when the CAS signal is in a low level, write data is taken in. The address control circuit 152 performs address conversion to designate a row address and a column address of the memory cell 165 into which the write data is in turn written. Further, a column address is taken in again upon falling of the CAS signal when the RAS signal remains in the low level, and write data is taken in upon falling of the WE signal when the CAS signal is in a low level. With the row address unchanged, a row address and a column address of the memory cell 165 are designated. The write data is written into the designated memory cell address. Subsequently, this operation is repeated to successively write a plurality of write data.

By thus supporting a general-purpose DRAM access cycle inclusive of a random access, a page mode access and so forth as disclosed in *Hitachi LCD Controller/Driver LSI Data Book,* pp. 638–690, published by Hitachi, Ltd., it is possible to easily construct a liquid crystal display system using the liquid crystal driver of the present embodiment.

Next, the detailed timing of a display access will be explained by use of FIGS. 29, 45 and 46.

In the display access, at the same period synchronous with a display synchronizing signal 104 from the scanning circuit 130, display data of the memory cell 165 for each one line is converted into a liquid crystal applied voltage which is in turn outputted to the output voltage line 196, thereby driving the liquid crystal panel 132.

Figure 45:
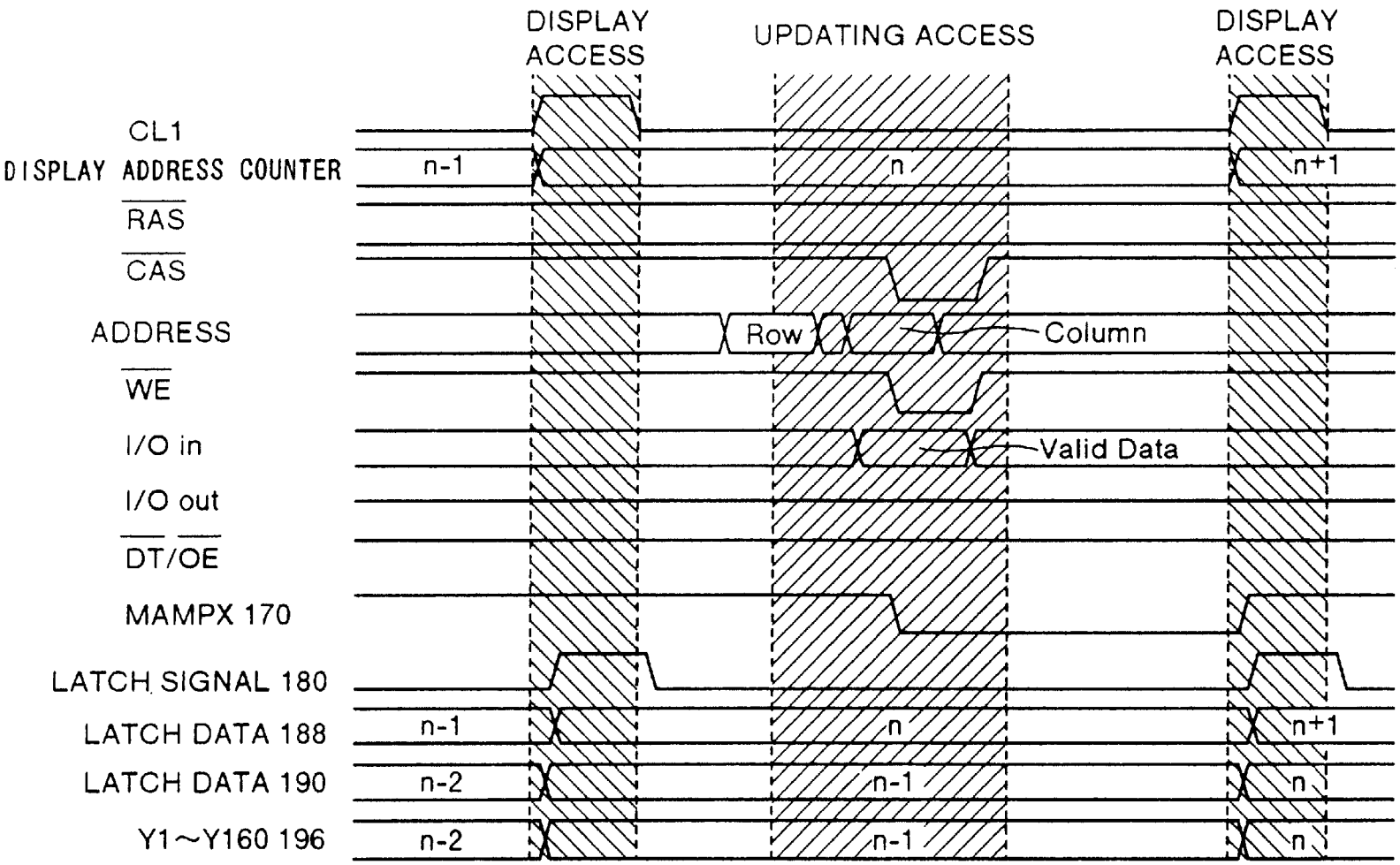
FIG. 45 is a timing chart showing a display access and an updating access.

As shown in FIG. 45, the display address counter 155 is counted up in synchronism with the rising of a display synchronizing signal CL1 to successively count up the row address so that a liquid crystal applied voltage is outputted one row by one row from the output voltage line 196 in synchronism with the rising of the display synchronizing signal CL1. More particularly, in the display access, after a latch signal 180 is risen in synchronism with the display synchronizing signal CL1 so that the output of the FRC selector 185 held by the latch circuit 187 is outputted, the output of the FRC selector 185 is held upon falling of the latch signal 180. On the other hand, the latch circuit 189 latches latch data 188 upon rising of the display synchronizing signal CL1 in response to a control signal 181 synchronous with CL1. An updating access from the CPU can be made in the intervals of the display access performed at a fixed period. A row address is held upon falling of a RAS signal and a column address is subsequently held upon falling of a CAS signal, so that access is made to a storage position designated by both the addresses. A control signal (MAMPX) 170 to the selector 159 for making a change-over between a row address from the CPU and a row address from the counter 155 is turned to a low level upon falling of the CAS signal so that the change-over to the updating side is made. Upon rising of the next display synchronizing signal CL1, the control signal 170 returns to a high level.

Since the updating access and the display access are independent from each other and asynchronous with each other, there may be the case where the timing of the updating access and the timing of the display access overlap. FIG. 46 shows timings in the case where the updating access and the display access overlap. If the display operation is not performed at the fixed period, the quality of display of the liquid crystal panel is deteriorated. In the present embodiment, the two stages of latch circuits 187 and 189 are provided for enabling the display operation at the fixed period even in the case where the updating access and the display access overlap.

Figure 46:
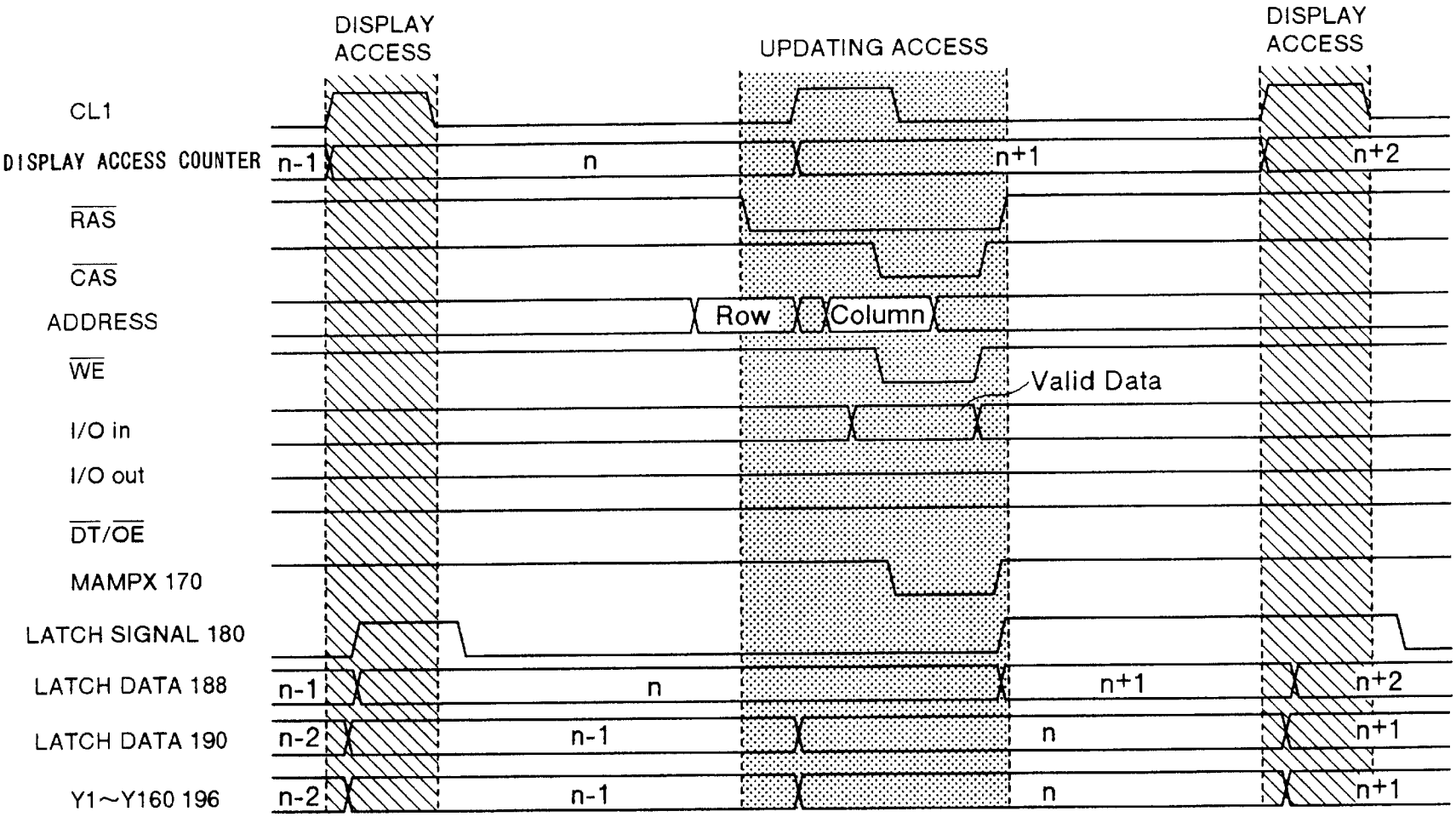
FIG. 46 is a timing chart similar to FIG. 45 in the case where the display access and the updating access overlap.

As shown in FIG. 46, when a display synchronizing signal CL1 is inputted in a low level period of a RAS signal, a latch signal 180 for the latch circuit 187 is prevented from rising in synchronism with the display synchronizing signal CL1. As a result, the updating access has a preference. Namely, the updating access from the CPU makes access to the memory cell 165 from the time of falling of a CAS signal when a row address and a column address are both settled and is completed upon rising of the CAS signal. A control signal MAMPX 170 to the selector 159 selects an updating address when the signal is in a low level and selects a display address when it is in a high level. In the case of the updating access, the control signal 170 is turned to the low level upon falling of the CAS signal. However, in the updating access conflicts with the display access, the control signal is returned to the high level upon rising of the CAS signal so that the updating of latch data 188 is made immediately after the updating access.

In the display access, the display address counter 155 is counted up from n (n: positive integer) to n+1 and latch data 188 corresponding to the row address n is latched by the latch circuit 189 in response to a control signal 181, as in the case of FIG. 45. Thus, the updating of latch data 190 is made as scheduled irrespective of the confliction between accesses. But, the latch signal 180 having been prevented from rising is risen at the point of time of rising of the CAS signal (or at the point of time when the updating access is completed), thereby updating the latch data 190 into data corresponding to the row address n+1. As a result, the latch data 190 can follow the updated latch data 188 upon rising of the next display synchronizing signal CL1. Since the latch circuit 187 is a level latch circuit, the latch circuit 187 successively takes in data of row addresses n +1 and n+2 and holds the data of the row address n+2 upon falling of the latch signal 180. Namely, the updating access from the CPU is made in the low level period of the CAS signal while the display access is such that the operation of output to the liquid crystal panel is performed always upon rising of the display synchronizing signal CL1 and the operation of reading of data from the memory cell 165, in the case where the display access overlap the updating access, is performed in a period of time until the next display synchronizing signal CL1 and with no updating access. (Even in the case where the updating access is continuous, the operation of reading of data from the memory cell 165 is performed in a period of time in the updating access other than a period of time when the CAS signal is in a low level.)

By thus providing the two stages of latch circuits 187 and 189 and skillfully controlling the latch signals therefor, it is possible to normally make an updating access and a display access even in the case where they overlap.

Therefore, since the updating access from the CPU is always performed irrespective of the period of the display access, high-speed updating can be realized.

The above-mentioned sixth embodiment has been disclosed in conjunction with the case where the memory capacity is 160 (pixels)×240 (lines)×2 (bits)=76800 bits and the number of outputs is 160. However, it is possible to cope with the other memory capacity and the other number of outputs by correspondingly changing the control circuit, the display address counter and so forth. Also, in the sixth embodiment, four-grayscale display has been made by the FRC system with 2-bit grayscale data provided for one pixel. However, it is possible to cope with multi-grayscale display by increasing the number of FRC patterns and the number of grayscale data and correspondingly changing the memory capacity, the FRC selector and so forth. Further, grayscale display is possible even if not the FRC system but a pulse width modulation system is used as a grayscale control system.

Next, a seventh embodiment of the present invention, in which liquid crystal drivers are arranged longitudinally (in a Y-axis direction), will be explained FIGS. 47 to 55.

Figure 47A:
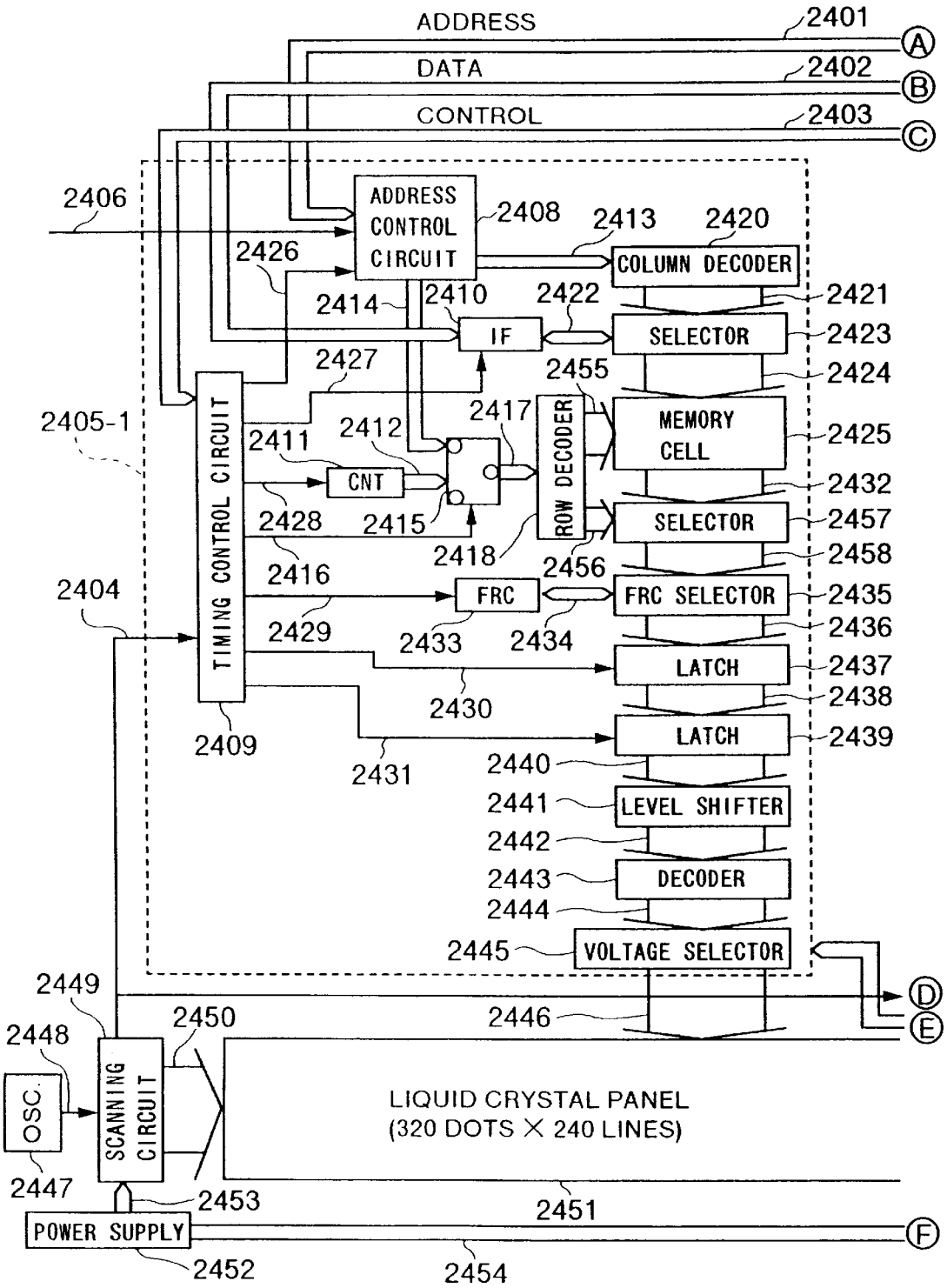
FIGS. 47A and 47B show a block diagram of a liquid crystal display according to a seventh embodiment of the present invention in which the liquid crystal driver with internal memory of the present invention is used.
Figure 47B:
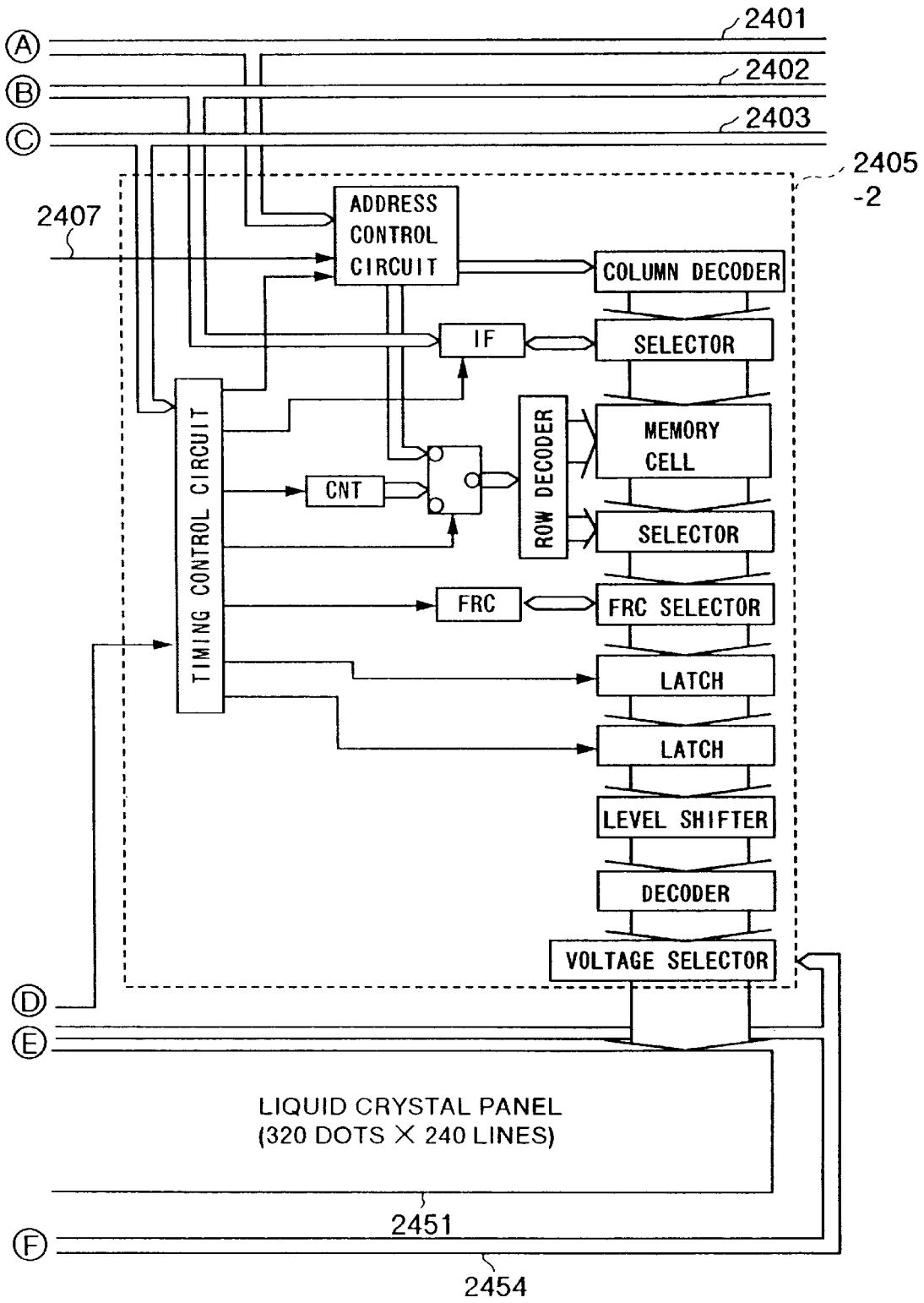

FIG. 47 is a block diagram of a liquid crystal display using the liquid crystal driver of the present invention.

In FIG. 47, reference numeral 2401 denotes an address bus for transferring an address, numeral 2402 a data bus for transferring display data, numeral 2403 a control signal bus for transferring a control signal, and numeral 2404 a display synchronizing signal generated by a scanning circuit 2449. Numeral 2405 denotes a liquid crystal driver of the present invention which has the number of outputs equal to 160. Numerals 2406 and 2407 denote lines of 3-bit address mode signals indicative of the arrangement positions of the liquid crystal drivers 2405-1 and 2405-2, respectively, and numeral 2408 denotes an address control circuit for converting an address value inputted from the address bus 2401 into a memory address in accordance with the address mode signal line. Numeral 2409 denotes a timing control circuit for controlling an updating/display operation on the basis of the control signal bus 2403 from the system and the display synchronizing signal 2404, numeral 2410 an I/O port for performing the input/output control for the data bus 2402, numeral 2411 a display address counter for generating a row address for display, numerals 2412 a display address bus, and numerals 2413 and 2414 a column address and a row address of a memory cell generated by the address control circuit 2408. Numeral 2415 denotes a selector for selecting an address for display and an address for updating in accordance with a control signal 2416, numeral 2417 a memory row address selected by the selector 2415, numeral 2418 a row address decoder for selecting a word line of the memory cell, numeral 2455 a bus of a selection signal generated by the row address decoder 2418, numeral 2456 a bus of a selection signal generated by the row address decoder 2418, numeral 2420 a column address decoder for generating a selection signal for selecting a signal line of the memory cell, numeral 2421 a bus of the selection signal generated by the column address decoder 2420, numeral 2422 an input/output bi-directional data bus, numeral 2423 a selector for connecting the data bus 2422 to a signal line of the memory cell selected by the selection signal bus 2421, numeral 2424 a signal line bus through the selector 2423, and numeral 2425 the memory cell having a capacity of 76800 bits=160 (pixels)×240 (lines)×2 (bits) corresponding to 160 outputs and 4 grayscales. Numerals 2426, 2427, 2428, 2429, 2430 and 2431 denote control signals generated by the timing control circuit 2406. More particularly, numeral 2426 denotes a control signal for address conversion, numeral 2427 a control signal for control of the input/output of data, numeral 2428 a control signal for display address counter, numeral 2429 a control signal for controlling an FRC pattern generating circuit 2433, and numerals 2430 and 2431 latch signals for display. Numeral 2432 denotes a data bus of 320 lines=160 (outputs)×2 (bits) from the memory cell 2425, numeral 2457 a selector for selecting 4-pixel data connected to the same address, numeral 2458 a bus of data selected by the selector 2457, numeral 2433 the FRC pattern generating circuit, numeral 2434 an FRC data bus, numeral 2435 an FRC selector for selecting output data from the FRC data bus 2434 and the data bus 2432, numeral 2436 a data bus of 160 bits, numeral 2437 a 160-bit latch circuit for simultaneously latching data of 160 bits of the data bus 2436 when the latch signal 2430 takes a high level, numeral 2438 a data bus of output data from the latch circuit 2437, numeral 2439 a 160-bit latch circuit for simultaneously latching data of 160 bits on the data bus 2438 by virtue of a rising edge of the latch signal 2431, numeral 2440 a data bus of output data from the latch circuit 2439, numeral 2441 a level shifter for shifting a signal voltage to a voltage level corresponding to a liquid crystal driving voltage, numeral 2442 a data bus of the level-shifted data, numeral 2443 a decoder for decoding an alternating current signal and data, numeral 2444 a bus of a decoded selection signal, numeral 2445 a voltage selector for selecting a liquid crystal applied voltage, and numeral 2446 an output voltage line. Numeral 2447 denotes an oscillator for generating a reference clock signal for display, numeral 2448 the reference clock signal for display, and numeral 2449 the scanning circuit. The scanning circuit 2449 generates the display synchronizing signal 2404 for liquid crystal driver. Numeral 2450 denotes a bus of the scanning signal generated by the scanning circuit 2449, and numeral 2451 a liquid crystal panel having a resolving power of 320 (dots)×240 (lines). Numeral 2452 denotes a power supply circuit, numeral 2453 a driving voltage line for driving the scanning circuit 2449, and numeral 2454 a voltage line for transferring a liquid crystal driving voltage to the liquid crystal driver 2405.

The operation of the liquid crystal driver in the seventh embodiment will now be explained by use of FIG. 47.

First, explanation will be made of an updating operation. As shown in FIG. 47, a row address and a column address from the address bus 2401 are inputted to the address control circuit 2408 and are latched upon falling of a RAS signal and a CAS signal which are control signals inputted through the timing control circuit 2409 from the control signal bus 2402. In the address control circuit 2408, the latched addresses are converted into a column address 2413 and a row address 2414 of the memory cell 2425. The column address 2413 is transferred to the column address decoder 2420 so that the selection signal line 2421 corresponding to the column address 2413 is made valid. The row address 2414 is transferred to the selector 2415. The selector 2415 is controlled by a control signal 2416 from the timing control circuit 2409 so that the row address 2414 is selected and is outputted to the memory row address 2417 during an access from the CPU. The memory row address 2417 is inputted to the row address decoder 2418 so that the selection signal bus 2419 corresponding to the memory row address is made valid. The data bus 2402 is connected to the I/O port 2410 which performs an input/output control. The I/O port 2410 is controlled by a control signal 2427 from the timing control circuit 2409 so that the interface circuit 2410 takes an input/output condition corresponding to a write/read cycle. In the write cycle, the data bus 2402 takes an input condition (when seen from the liquid crystal driver) to make the selector 2423 corresponding to the column address 2410 valid so that data is written. On the other hand, since the selection signal bus 2419 corresponding to the row address 2414 is valid, data of the data bus 2402 is written into the memory cell 2425 corresponding to the address bus 2401. In the read cycle, the data bus 2402 takes an output condition (when seen from the liquid crystal driver) to make the selector 2423 corresponding to the column address 2413 valid so that data is read. On the other hand, since the selection signal bus 2419 corresponding to the row address 2414 is valid, data of the memory cell 2425 corresponding to the address bus 2401 is outputted to the data bus 2402.

Thereby, the updating access to the liquid crystal driver from the system such as CPU becomes possible.

Next, the explanation will be made of a display operation. In the display operation, display data of the memory cell for one line (or one vertical line) is simultaneously read and the liquid crystal panel is driven in synchronism with a scanning signal from the scanning circuit 2449 so that display is made. An FLM signal indicative of a frame period and CL1 signal indicative of a line period for performing the display operation are generated by the scanning circuit 2449 and are inputted as a display synchronizing signal 2404 to the timing control circuit 2407. In accordance with a control signal 2425 for display generated by the timing control circuit 2407, the display address counter 2409 counts at each line period to update a display address and is reset at each frame period. Thereby, it is possible to successively generate display addresses of 0 to 239 at a fixed period. The display address 2412 is selected by the selector 2415 in accordance with a control signal 2416 and is inputted to the row address decoder 2418 to make the selection signal bus 2419 corresponding to the display address 2412 valid so that data of one line is read from the memory cell 2425.

Figure 55:
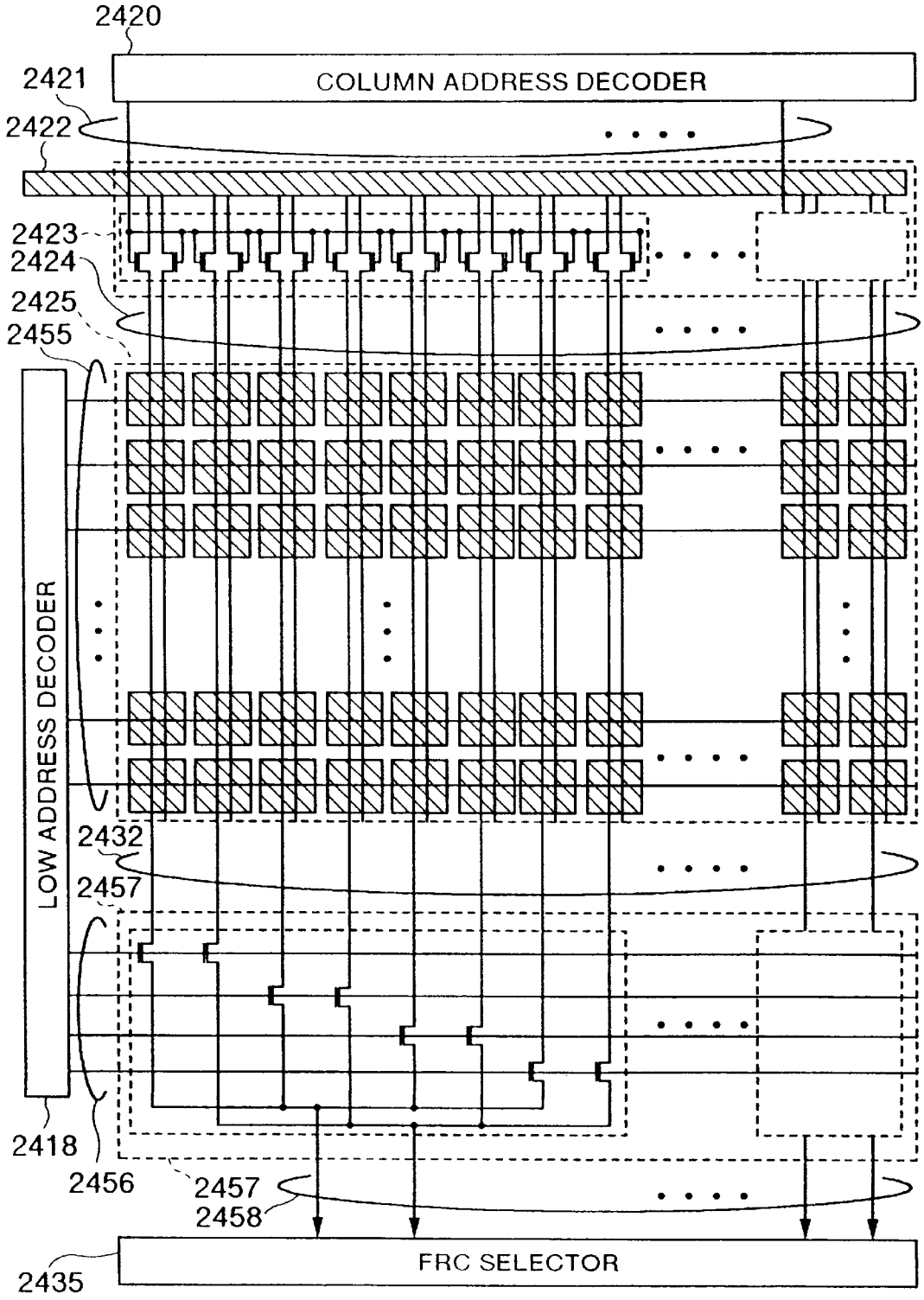
FIG. 55 is a detailed block diagram of a memory cell in the seventh embodiment.

The operation of the memory cell in the seventh embodiment will now be explained in detail by use of FIG. 55.

The memory cell 2425 has data of 8 bits=4 (pixels)×2 (bits) allotted to the same address and these four pixels corresponds to four pixels in a transverse (or horizontal) direction of the display screen of the liquid crystal panel. In an updating access, it is therefore necessary to perform simultaneous reading/writing of four pixels. In a display access, since a line scanning direction is the transverse direction of the display screen of the liquid crystal panel (vertical lines are read one by one at a time), it is necessary to output the above-mentioned four pixels one by one form one output voltage line for each display access. Accordingly, there is provided the selector 2457 having a construction the details of which are shown in FIG. 55.

The operation of the memory cell 2455 will be explained. In an updating access, the column address decoder 2420 generates 160 selection signal lines 2421 from a 8-bit column address and the selector 2423 selects signal lines of 8 bits by one selection signal line 2421 so that signal lines 2424 of 8 bits corresponding thereto are made valid. On the other hand, the row address decoder 2418 generates and selects 60 selection signal lines 2455 from a 6-bit row address. Thereby, a read/write operation can be performed.

In a display operation, the row address decoder 2418 generates 60 selection signal lines 2455 from 6 upper bits of a 8-bit display address generated by the display address counter and generates 4 selection signal lines 2456 from 2 lower bits thereof. Data 2432 selected by the selection signal 2544 is selected by the selection signal 2456 and the selector 2457 to read data 2456 of 160 (outputs)×2 (bits)=320 bits which is in turn outputted to the FRC selector 2435.

Figure 61:
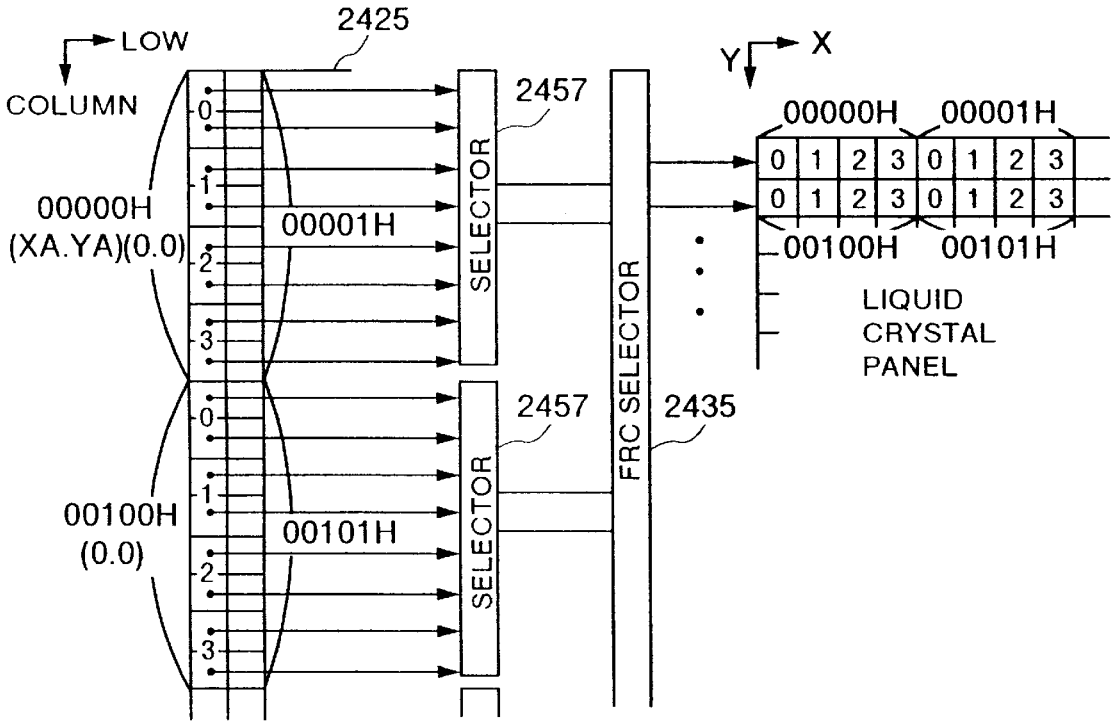
FIG. 61 is an explanatory view showing a relationship between a memory address and a bit map in he case where the liquid crystal driver is arranged in a Y direction.

Supplemental explanation of this display access will be made by use of FIG. 61. Since the line scanning direction is the horizontal direction of the liquid crystal panel, the contents of the memory cell are read with the row number of the memory cell 2445 being successively updated. However, since four pixels of pixel 0 to pixel 3 are included in one row, only the pixel 0 is first extracted from each set of four pixels to provide one line output. Subsequently, the similar is successively repeated for the pixel 1, pixel 2 and pixel 3.

Returning to FIG. 47 again, the FRC pattern generating circuit 2433 generates an FRC display pattern in accordance with a control signal 2429. The FRC display pattern is inputted to the FRC selector 2435 through the FRC data bus 2434. Based on the display data with two bits for one output from the data bus 2432 and the FRC data 2434, the FRC selector 2435 outputs FRC grayscale display controlled display data with one bit for one output to the data bus 2436. The latch circuit 2437 latches the display data 2436 when a display latch signal 2430 takes a high level. The latch circuit 2439 latches output data of the latch circuit 2437 on the data bus 2438 by virtue of a rising edge of a display latch signal 2431. In accordance with a relationship in phase between the display latch signals 2430 and 2431, data preceding by one line for an address indicated by the display address counter is successively latched at each line period. Data on the data bus 2440 is voltage-shifted by the level shifter 2441 into a liquid crystal driving voltage and is then outputted to the data bus 2442. The decoder 2443 decodes an alternating current signal and data on the data bus 2442 and outputs a decode signal to the selection signal bus 2444. A liquid crystal applied voltage is selected by the voltage selector 2445 and is then outputted to the output voltage line 2446. On the other hand, the scanning circuit 2449 generates a display synchronizing signal FLM indicative of a frame period and a display synchronizing signal CL1 indicative of a line period on the basis of a display reference clock signal 2448 generated by the oscillator 2447 and transfers them as a display synchronizing signal 2404 to the liquid crystal driver 2405. The scanning circuit 2449 successively makes a scanning signal 2450 valid one line by one line in synchronism with the display synchronizing signal CL1. Accordingly, a liquid crystal applied voltage corresponding to the display data is outputted from the output voltage line 2446 of the liquid crystal driver 2406 in synchronism with the display synchronizing signal CL1 and the scanning signal 2450 is successively made valid, thereby driving the display panel 2451.

Thus, the display access to the liquid crystal driver becomes possible.

Next, explanation will be made by use of FIG. 48. The explanation will be made of a liquid crystal display system such a personal computer or a work station using the liquid crystal driver of the present embodiment in the case where a CPU with DRAM interface is used as in the Hitachi, Ltd. SH Micon Series.

Figure 48:
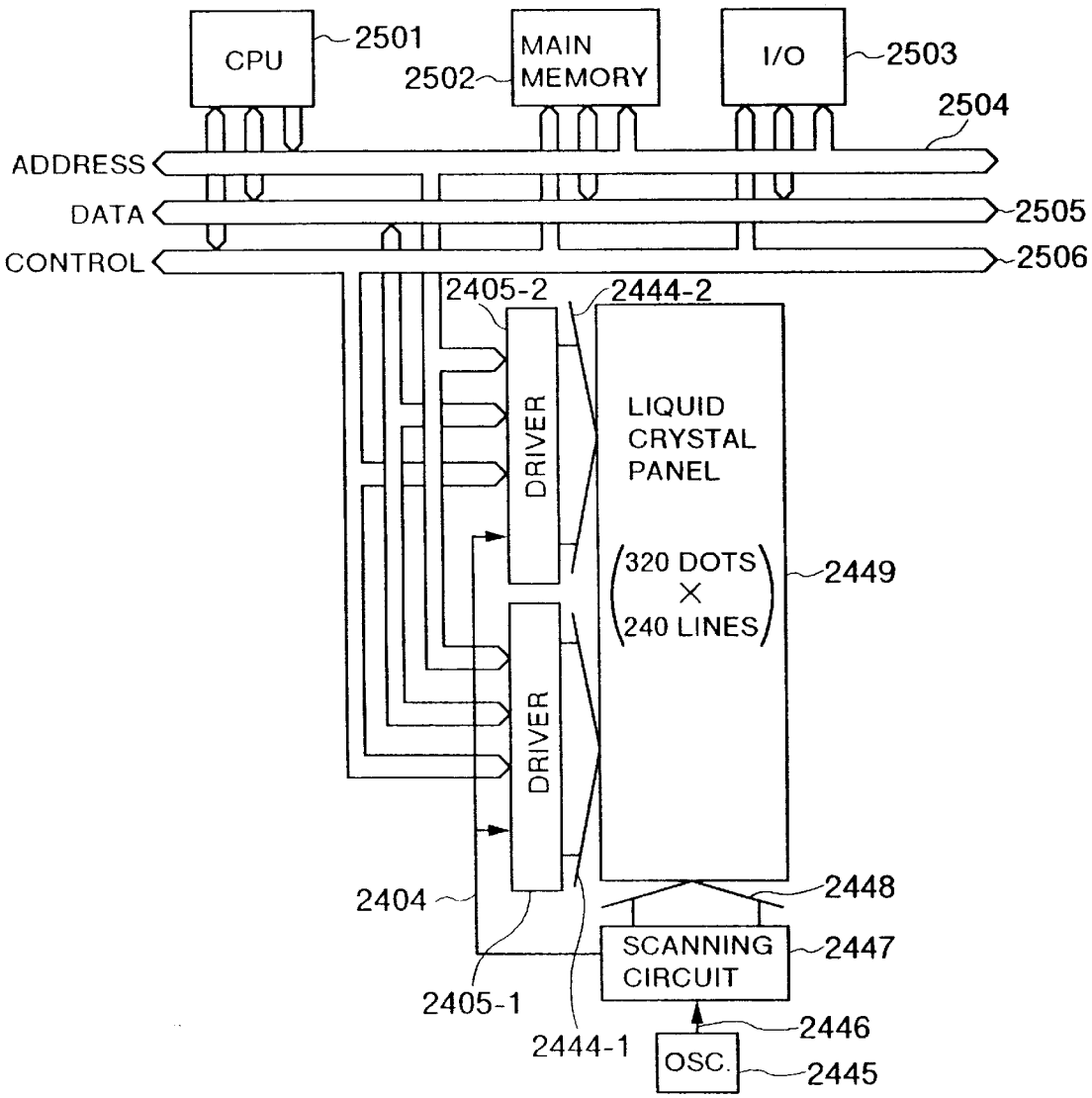
FIG. 48 is a block diagram showing one example of the construction of a liquid crystal display system using the liquid crystal display of the seventh embodiment.

As shown in FIG. 48, each of a CPU 2501, a main memory 2502, an I/O device 2503 and the liquid crystal driver 2405 is connected to an address bus 2504, a data bus 1505 and a control signal bus 2506 and the CPU 2501 can access each of the main memory 2502, the I/O device 2503 and the liquid crystal driver 2405 through the address bus 2504, the data bus 2505 and the control signal bus 2506. A row address and a column address outputted from the CPU 2501 are transferred to the liquid crystal driver 2505 through the address bus 2504. In synchronism with this, memory control signals RAS, CAS and so forth are also outputted from the CPU 2501 and are transferred to the liquid crystal driver 2405 through the control signal bus 2506. The address transferred to the liquid crystal driver 2405 is converted by the address control circuit 2408 in the liquid crystal driver 2405 into an address corresponding to a memory map. The memory map and the address conversion will now be explained in reference to FIGS. 50, 51, 52, 53 and 54.

Figure 50A:
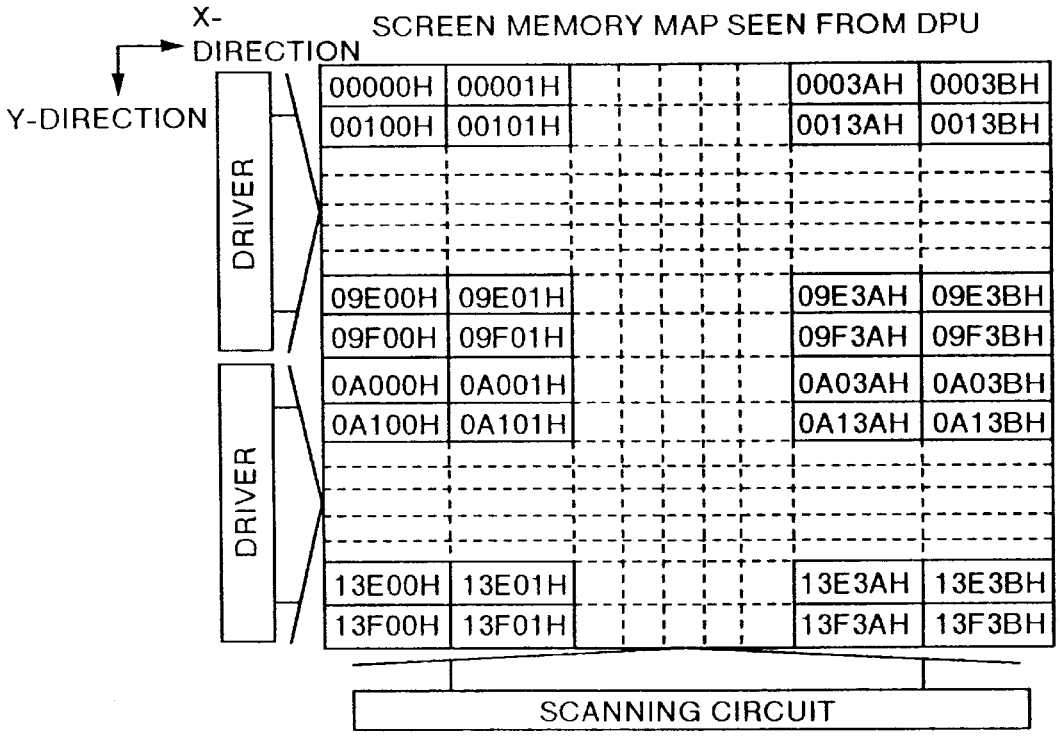
FIG. 50A is a screen memory map of the liquid crystal display system in the seventh embodiment when seen from the CPU.
Figure 50B:
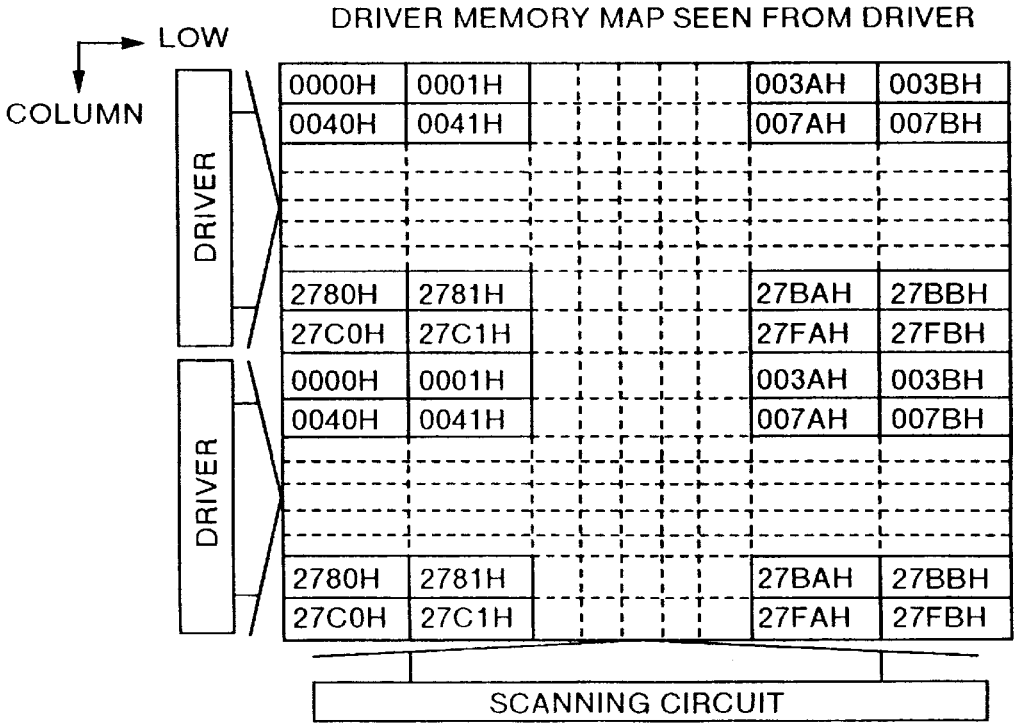
FIG. 50B is a driver memory map thereof when seen from the liquid crystal driver.

FIGS. 50A and 50B show memory maps when seen from the CPU and the liquid crystal driver, respectively.

Provided that the allotment of four pixels per one address is made for a display screen of 320 (pixels)×240 (lines), a memory map of the display screen in hexadecimal notation when seen from the CPU 2501 is such that the first line includes 00000H to 0003BH, the second line includes 00100H to 0013BH and the 320th line includes 13F00H to 13F3BH, as shown in FIG. 50A. The reason why an address skip occurs at the boundary between lines is that eight lower bits of the address and ten upper bits thereof are respectively taken as an X direction address and a Y direction address in order to facilitate an address control. On the other hand, a memory map when seen from the liquid crystal drivers 2405-1 and 2405-2 is different from the screen memory map when the CPU 2501 or takes a memory map of the internal memory cell 2425, as shown in FIG. 50B. With six lower bits and eight upper bits of the address of the memory cell 2425 being respectively taken as a row direction address and a column direction address, the memory map of each of the liquid crystal drivers 2405-1 and 2405-2 is such that the first line includes 0000H to 003BH, the second line includes 0040H to 007BH and the 160th line includes 27C0H to 27FBH. Therefore, if the address transferred from the CPU 2501 is used as it is, a correct address designation for the memory cells 2425 incorporated in the the liquid crystal drivers 2405-1 and 2405-2 cannot be performed. Accordingly, it is necessary to perform address conversion by the address control circuit 2408. Thus, it is required that address conversion from the 8-bit X direction address into the 6-bit row direction address and from the 10-bit Y direction address into the 8-bit column direction address is performed by the address control circuit 2408. The address control circuit 2408 converts the 8-bit X direction address into the 6-bit row direction address and the 10-bit Y direction address into the 8-bit column direction address, thereby performing address conversion from CPU addresses 00000H to 0003BH into addresses 0000H to 003BH of the memory cell 2425, similarly from 09F00H to 09F3BH into 27C0H to 25FBH, from 0A000H to 0A03BH into 0000H to 003BH, and from 13F00H to 13F3BH into 27C0H to 27FBH. With such address conversion, it is possible to make correspondence to the memory map of the memory cell 2425, thereby performing correct address designation.

As in the case of the sixth embodiment, the arrangement positions of the plurality of liquid crystal drivers 2405 for the liquid crystal panel are set by an address mode signal. The address conversion is performed as follows.

In a manner similar to that in the sixth embodiment, the liquid crystal driver 2405 is inputted with a 3-bit control signal including address mode signals MODEA2, MODEA1 and MODEA0 (see FIG. 33) determined in accordance with the arrangement position of the liquid crystal driver. By decoding this control signal, it is possible to set eight driver ID's of ID0 to ID7. FIGS. 51, 52, 53 and 54 show the configuration of liquid crystal drivers and address ID's in the cases where the resolving power of the liquid crystal panel is 240 (horizontal)'160 (vertical), 240 (horizontal)×320 (vertical), 480 (horizontal)×320 (vertical), and 480 (horizontal)×640 (vertical), respectively. In the case of the liquid crystal display system of FIG. 47 or 48, the address mode signal line 2406 of the driver 2405-1 is set to be MODEA2, A1, A0="000" (driver ID=0) and the address mode signal line 2407 of the driver 2405-2 is set to be MODEA2, A1, A0="010" (driver ID=2). Namely, a change-over to an address control corresponding to the liquid crystal arrangement position of the liquid crystal driver is made by the setting of the address mode signal line, thereby enabling correct address designation for the memory cell 2425.

Further, the CPU can access the plurality of liquid crystal drivers 2405 individually in such a manner that whether or not the access from the CPU is an access to each liquid crystal driver itself is judged from the address mode signal line and an inputted address to generate a chip selection signal in that liquid crystal driver. In the case of the liquid crystal display system of FIG. 47 or 48, the address mode signal line 2406 of the liquid crystal driver 2405-1 is set to be MODEA2, A1, A0="000" (driver ID=0) and the address mode signal line 2407 of the driver 2405-2 is set to be MODEA2, A1, A0="010" (driver ID=2). Thereby, when an address "09F00H" is designated from the CPU, the liquid crystal driver 2405-1 internally generates a chip selection signal and the access is performed. When an address "0A000H" is designated from the CPU, the liquid crystal driver 2405-2 internally generates a chip selection signal and the access is performed.

Next, explanation will be made by use of FIG. 49. The explanation will be made of a liquid crystal display system such as a personal computer or a work station using the liquid crystal driver of an embodiment in the case where a CPU provided with no DRAM interface is used as in the Hitachi, Ltd. H8 Series.

Figure 49:
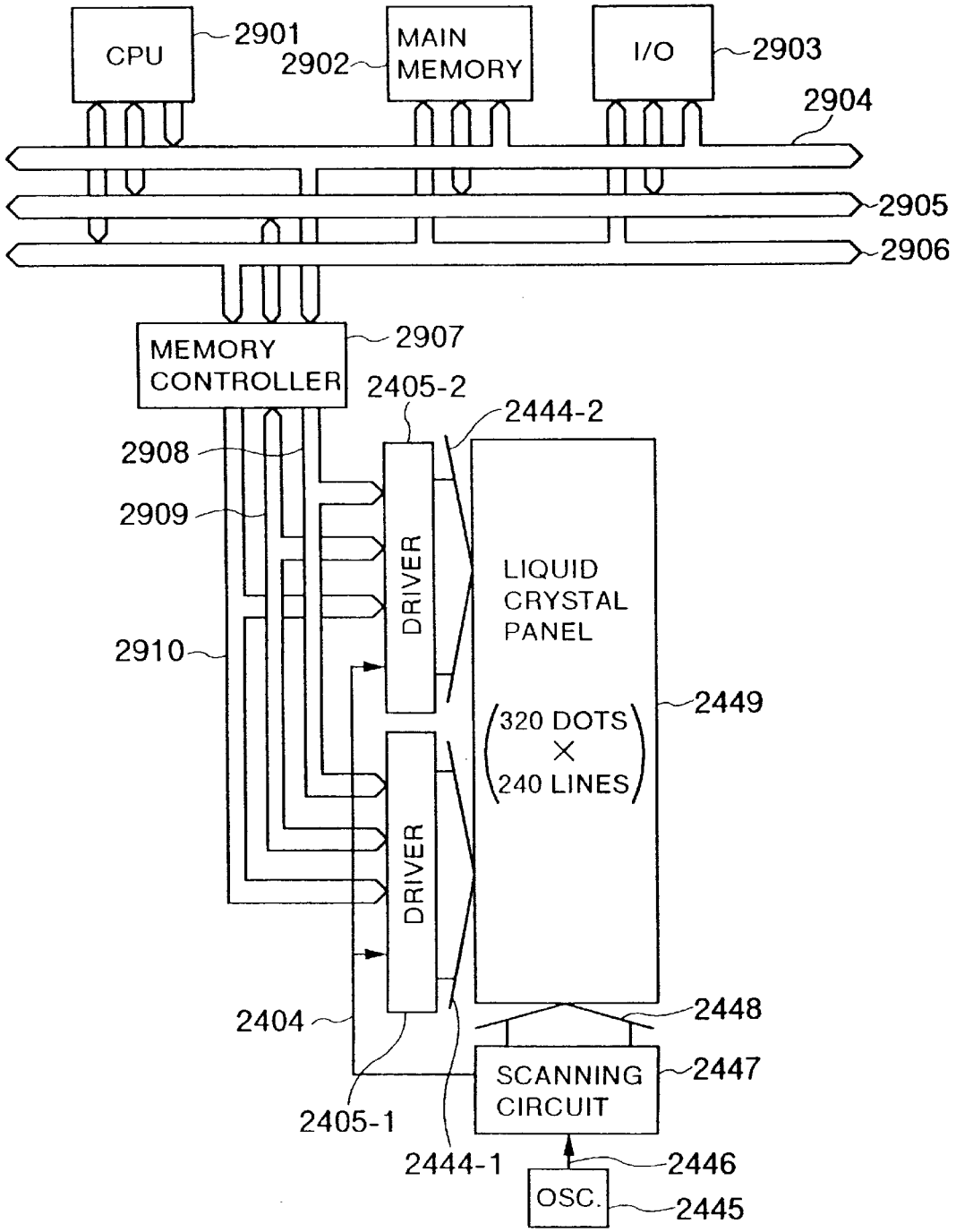
FIG. 49 is a block diagram showing another example of the construction of a liquid crystal display system using the liquid crystal display of the seventh embodiment.

As shown in FIG. 49, each of a CPU 2901, a main memory 2902, an I/O device 2903 and a memory controller 2907 is connected to an address bus 2904, a data bus 2905 and a control signal bus 2906 and the CPU 2901 can access each of the main memory 2902, the I/O device 2903 and the memory controller 2907 through the address bus 2904, the data bus 2905 and the control signal bus 2906. An address outputted from the CPU 2901 is transferred to the memory controller 2907 through the address bus 2904 and is latched. In synchronism with this, a control signal is also outputted from the CPU 2901 and is transferred to the memory controller 2907 through the control signal bus 2906. The memory controller 2907 outputs a row address, a column address and memory control signals RAS, CAS and so forth, on the basis of the address and the control signal inputted from the address bus 2904 and the control signal bus 2906, to the address data bus 2908 and the control signal bus 2910 in a timed relation, thereby making access to the liquid crystal driver 2405. The operation of the liquid crystal driver 2405 is similar to that in the liquid crystal display system shown in FIG. 48.

In the foregoing embodiments, the DRAM interface has been used as a memory interface of the memory cell. However, a SRAM interface can be used. In the case of the SRAM interface, since an address indicative of an X coordinate value and an address indicative of a Y coordinate value are simultaneously transferred on an address bus, the number of lines of the address bus is increased as compared with that in the case where the DRAM interface is used. But, since access to a memory becomes possible with two cycles of the CPU, the updating speed is improved.

Figure 62:
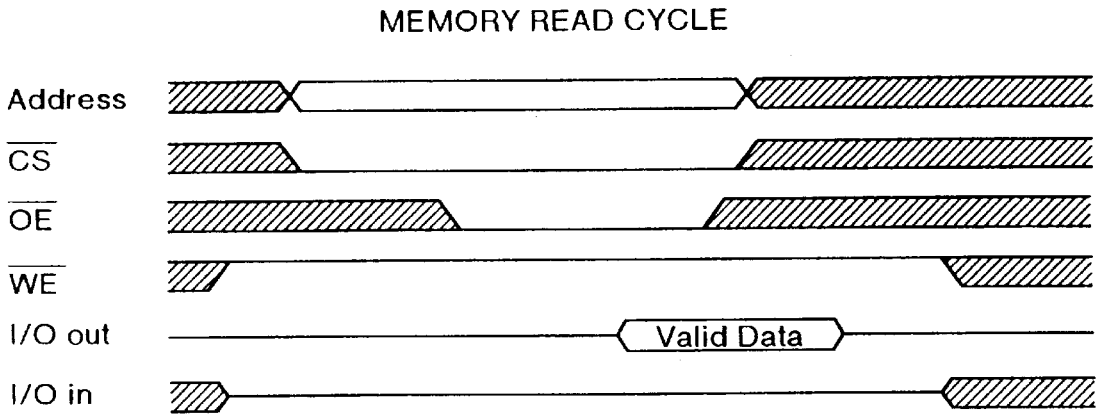
FIG. 62 is a timing chart showing a memory read cycle in another embodiment of the present invention in which an SRAM interface is used.
Figure 63:
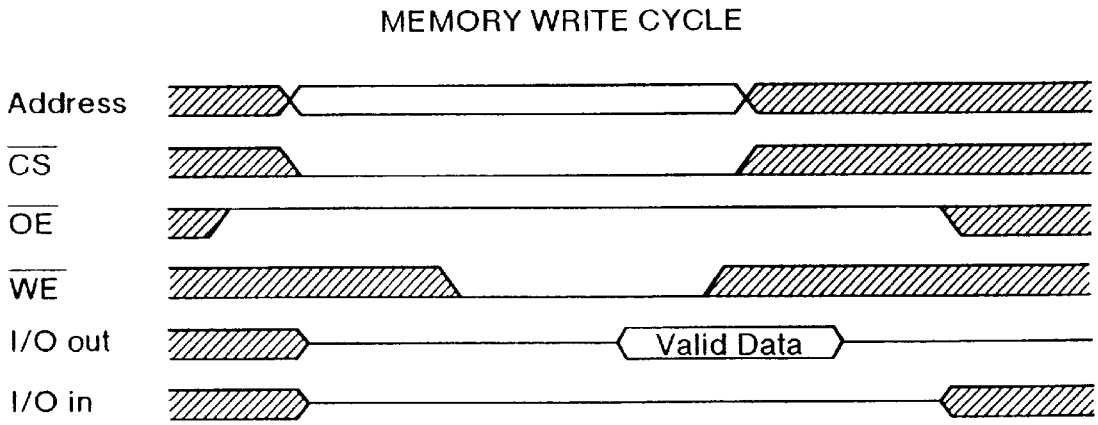
FIG. 63 is a timing chart showing a memory write cycle in the other embodiment of the present invention in which the SRAM interface is used.

FIGS. 62 and 63 show timing charts which represent a memory read cycle and a memory write cycle in the present embodiment, respectively. In order to realize such timing, it is necessary to change the construction of the liquid crystal driver, more particularly, the construction of the address bus 101, the address control circuit 152 and the timing control circuit 153 in the construction shown in FIG. 29.

The operation of the liquid crystal driver of the present embodiment is as follows. Upon memory access from the CPU, an address indicative of an X coordinate value and an address indicative of a Y coordinate value are simultaneously obtained from the address bus and the reading/writing of data is made in accordance with the timing shown in FIG. 62 or 63. A display operation is similar to that in the embodiment shown in FIG. 29.

A memory read cycle in the present embodiment will be explained using FIG. 62. An address is inputted from the address bus 101 to the address control circuit 152 which in turn performs address conversion to designate a row address and a column address of the memory cell 165. Read data is outputted in a period of time when a CS signal (or a chip selection signal for selecting the whole of the liquid crystal driver) and an output enable (OE) signal received from the control signal bus 103 are both active (or in low level).

A memory write cycle will be explained using FIG. 63. The operation until the input of an address from the address bus and the designation of a row address and a column address of the memory cell 165 through address conversion is the same as that in the read cycle. In the write cycle, write data is written in a period of time when the CS signal and a write enable (WE) signal received from the control signal bus are both active (or in low level).

By thus supporting a general-purpose SRAM access cycle as disclosed in *Hitachi IC Memory DATA BOOK No.* 1, pp. 269–282, published by Hitachi, Ltd., it is possible to easily construct a liquid crystal display system using the liquid crystal driver of the present embodiment.

Also, by providing the two stages of latch circuits 2437 and 2439 and controlling the latch signals therefor, it is possible to normally make an updating access and a display access even in the case where they overlap. Therefore, the updating access from the CPU can always be performed with no restriction of the display access.

In the present embodiment too, the memory capacity of the memory, the number of outputs and the number of grayscales are not limited to those mentioned above. Also, the use of the memory cell construction shown in FIG. 55 makes it possible to arrange the liquid crystal driver in the Y-axis direction of a display screen.

Next, other embodiments as portable information equipments using the liquid crystal display will be explained by use of FIGS. 56 to 60. Since the liquid crystal display of the present invention has a low power consumption, it is preferably mounted on a battery-driven portable information equipment.

Figure 52:
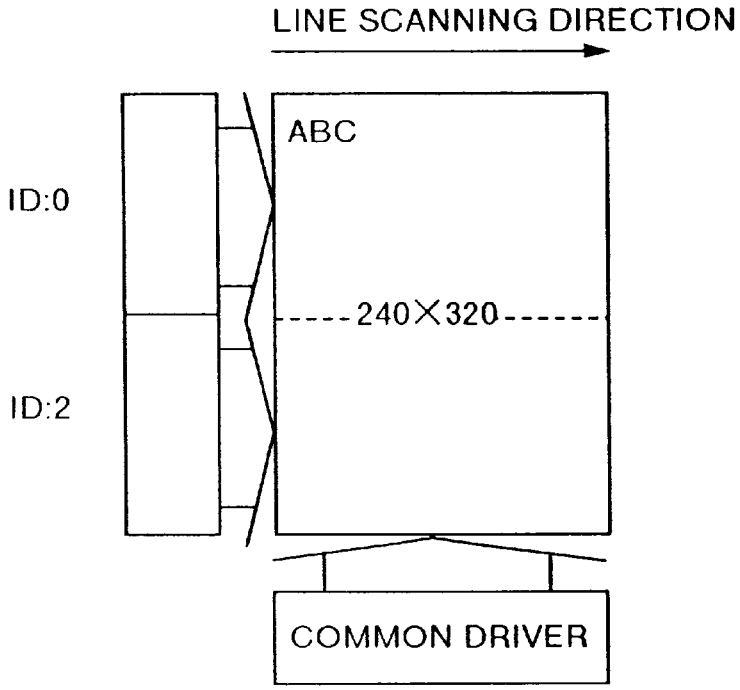
Figure 53:
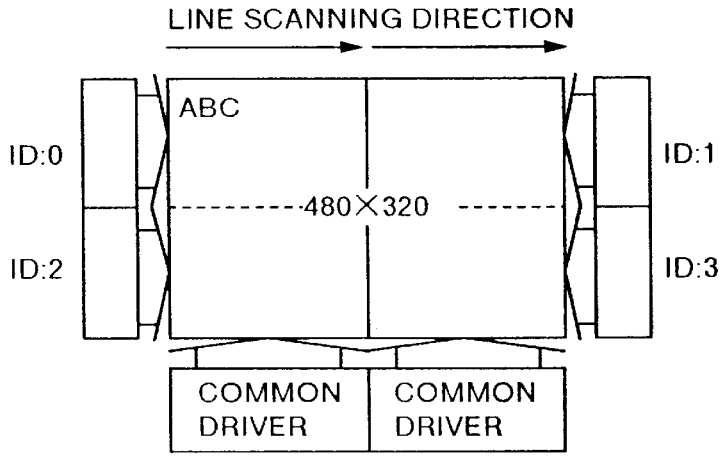
Figure 54:
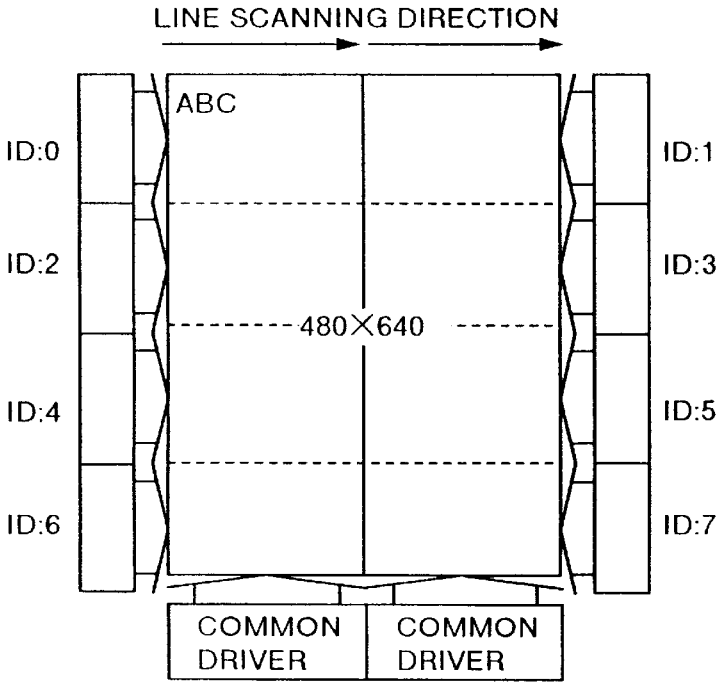
Figure 56:
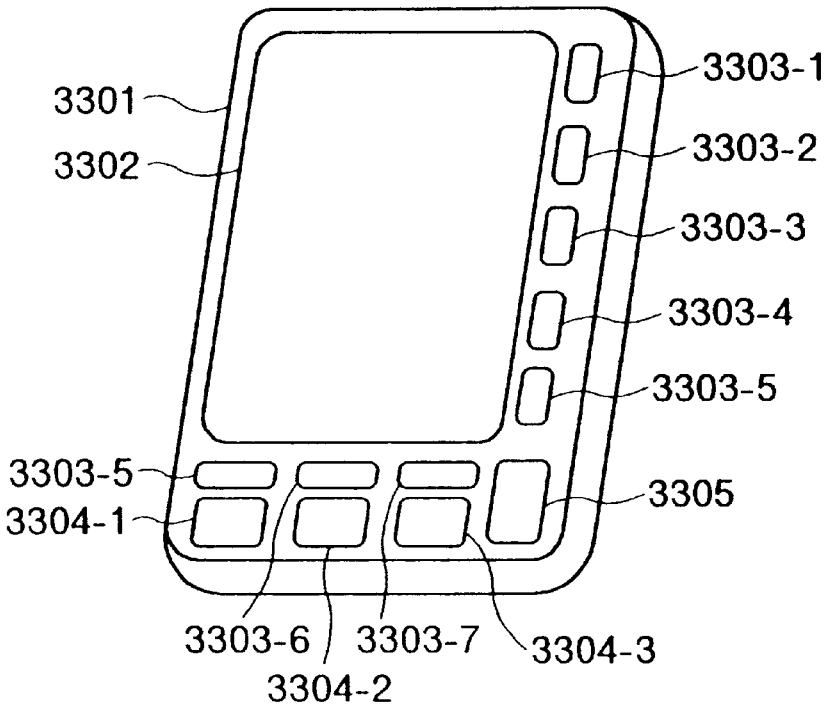
FIGS. 56 to 60 are sketchy views of portable information equipments in which the liquid crystal driver with internal memory of the present invention is used.

FIG. 56 shows an embodiment of a portable information equipment using a longitudinal liquid crystal panel having a screen size of 4 to 6 inches and a resolving power of 240 (pixels)×320 (lines) (corresponding to FIG. 52). Reference numeral 3301 denotes a portable information equipment, and numeral 3302 denotes a pen-input and tablet-integrated type of liquid crystal display having a resolving power of 240 (pixels)×320 (lines). A liquid crystal driver has a longitudinal or vertical construction as shown in conjunction with the seventh embodiment. Numeral 3303 denotes various function keys, numeral 3304 command or menu keys, and numeral 3305 an execution key. The search of a data base of telephone numbers, addresses and so forth and the function of a word processor or the like can be realized by a pen input and key operation.

Figure 37:
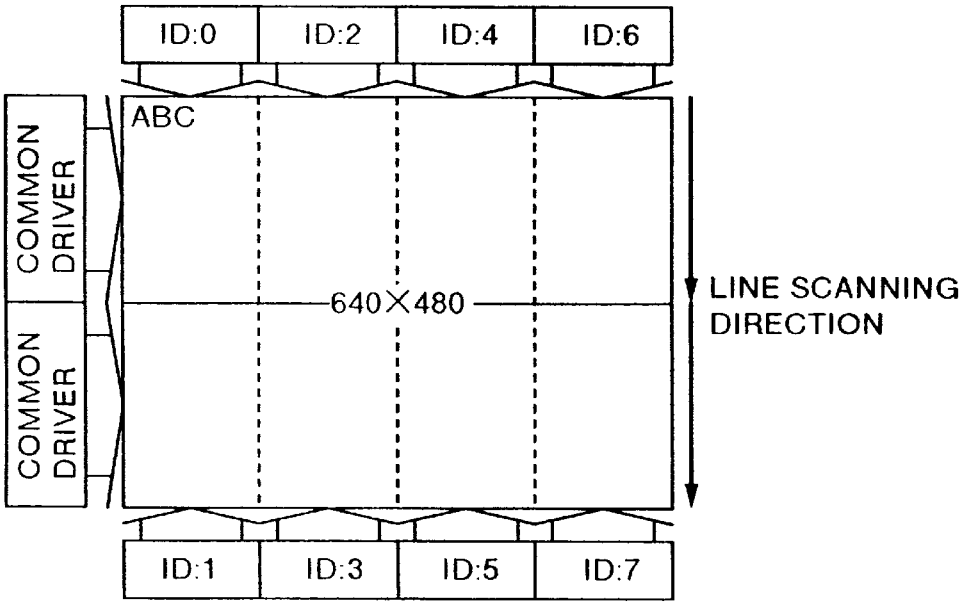
Figure 57:
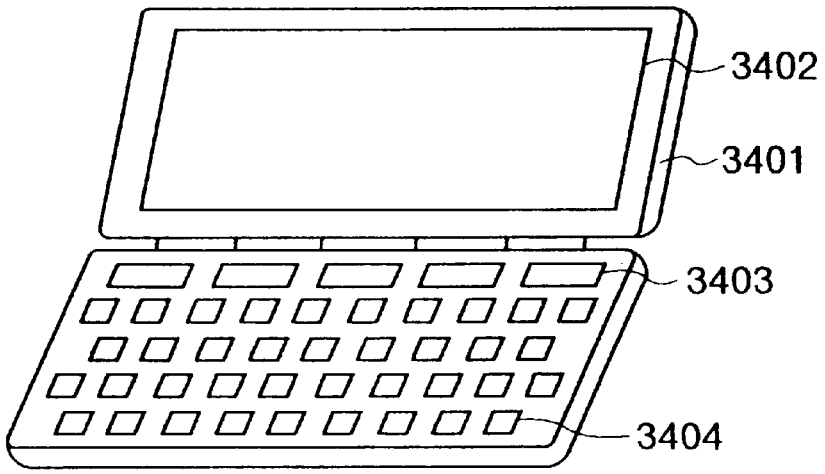

FIG. 57 shows an embodiment of a portable information equipment using an oblong liquid crystal panel having a screen size of 8 to 10 inches and a resolving power of 640 (pixels)×480 (lines) (corresponding to FIG. 37). Reference numeral 3401 denotes a portable information equipment, and numeral 3402 denotes a liquid crystal display having a resolving power of 640 (pixels)×480 (lines). A liquid crystal driver has a transverse or horizontal construction as shown in conjunction with the sixth embodiment. Numeral 3403 denotes various function keys, and numeral 3404 denotes keys. The search of a data base of telephone numbers, addresses and so forth and the function of a word processor, a personal computer or the like can be realized by a key operation.

Figure 58:
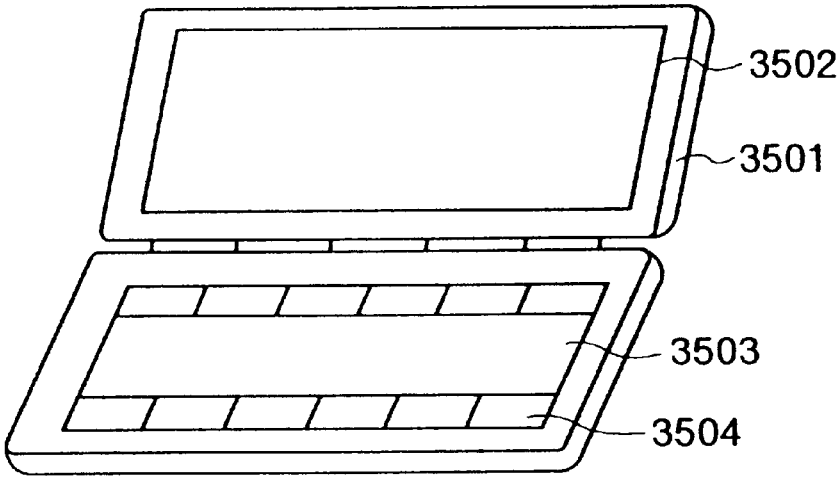

FIG. 58 shows an embodiment of a portable information equipment using two oblong liquid crystal panels each having a screen size of 4 to 6 inches and a resolving power of 320 (pixels)×240 (lines) (corresponding to FIG. 35). Reference numeral 3501 denotes a portable information equipment, and numeral 3502 denotes a liquid crystal display having a resolving power of 320 (pixels)×240 (lines). A liquid crystal driver of the liquid crystal display 3502 has a transverse construction as shown in conjunction with the sixth embodiment. Numeral 3503 denotes a pen-input and tablet-integrated type of liquid crystal display having a resolving power of 320 (pixels)×240 (lines). A liquid crystal driver of the liquid crystal display 3503 has a transverse construction as shown in conjunction with the sixth embodiment. Numeral 3504 denotes various function keys for pen input. The search of a data base of telephone numbers, addresses and so forth and the function of a word processor or the like can be realized by a pen input operation.

Figure 51:
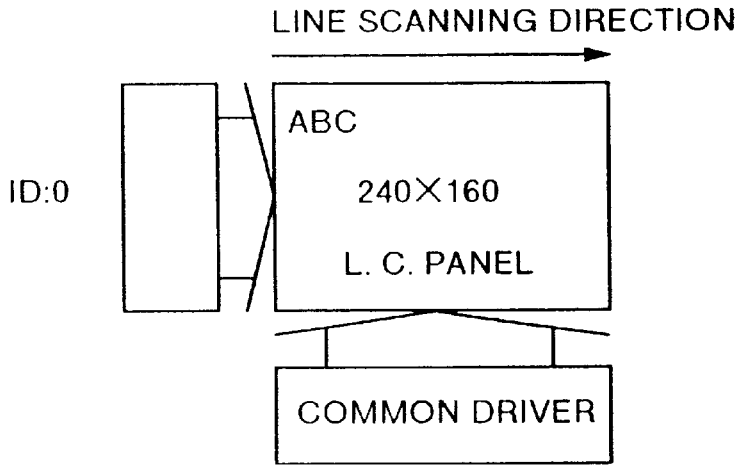
FIGS. 51 to 54 are diagrams showing the respective liquid crystal driver arrangements in the liquid crystal display of the seventh embodiment for different resolving powers of the liquid crystal panel.
Figure 59:
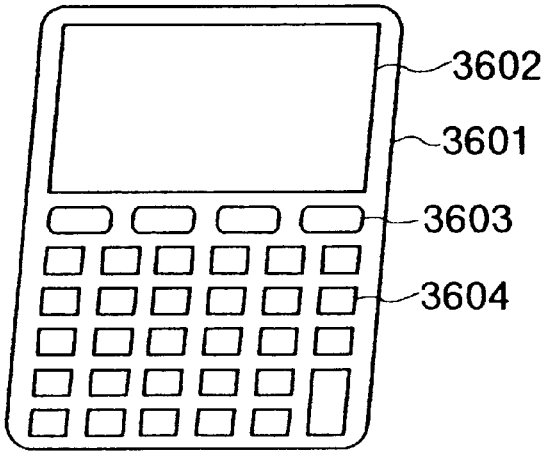

FIG. 59 shows an embodiment of a portable information equipment using an oblong liquid crystal panel having a screen size of 2 to 3 inches and a resolving power of 240 (pixels)×160 (lines) (corresponding to FIG. 51). Reference numeral 3601 denotes a portable information equipment, and numeral 3602 denotes a liquid crystal display having a resolving power of 240 (pixels)×160 (lines). A liquid crystal driver has a longitudinal construction as shown in conjunction with the seventh embodiment. Numeral 3603 denotes function keys, and numeral 3604 denotes keys. The search of a data base of telephone numbers, addresses and so forth and the function of a word processor or the like can be realized by a key operation.

Figure 60:
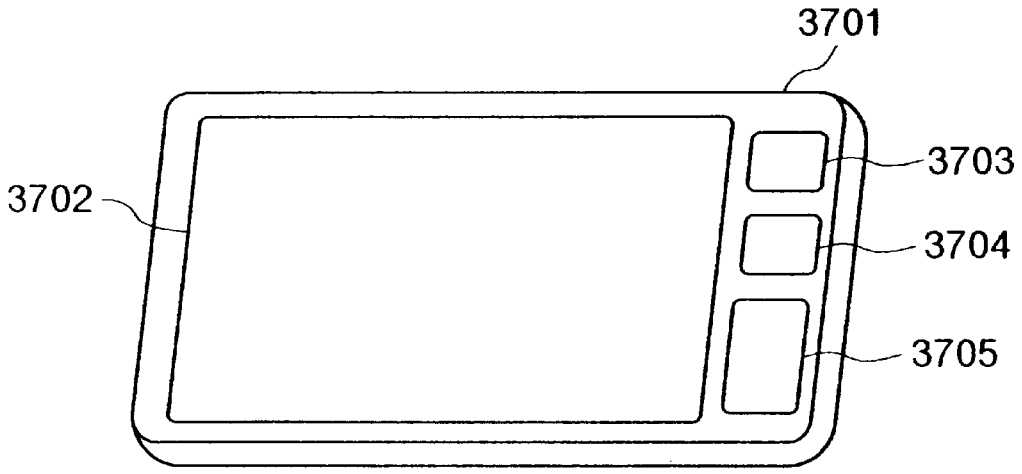

FIG. 60 shows an embodiment of a portable information equipment using an oblong liquid crystal panel having a screen size of 4 to 6 inches and a resolving power of 320 (pixels)×240 (lines) (corresponding to FIG. 35). Reference numeral 3701 denotes a portable information equipment, and numeral 3702 denotes a pen-input and tablet-integrated type of liquid crystal display having a resolving power of 320 (pixels)×240 (lines). A liquid crystal driver has a transverse construction as shown in conjunction with the sixth embodiment. Numeral 3703 denotes a function key, numeral 3704 a command or menu key, and numeral 3705 an execution key. The search of a data base of telephone numbers, addresses and so forth and the function of a word processor or the like can be realized by a pen input and key operation.

According to the liquid crystal driver of the present invention, display access of once in one horizontal period suffices to generate and output a liquid crystal applied voltage corresponding to display data, thereby enabling display on a liquid crystal panel. Therefore, it is possible to attain a reduction in power consumption of the whole of a display system including a liquid crystal display.

According to the liquid crystal driver of the present invention, an updating access can always be made with no restriction of a display access. Therefore, it is possible to realize high-speed updating.

With the use of address conversion means for converting a CPU address into a memory address, address operation or determination for updating becomes easy since even in the case where a plurality of liquid crystal drivers are used, the addresses of a display memory when seen from the CPU can be made linear in both of an X direction and a Y direction.

According to the liquid crystal driver of the present invention, the liquid crystal driver has a general purpose memory interface, a system can use the liquid crystal driver as a general purpose memory. Therefore, the convenience in use is improved.

The liquid crystal driver is connected to an address bus and a data bus of a CPU so that the CPU can make direct access to a display memory incorporated in the liquid crystal driver. Therefore, it is possible to eliminate/reduce a control circuit for memory access.

According to the liquid crystal driver of the present invention, when the liquid crystal driver has a grayscale function incorporated therein, it is possible to provide a screen which is easy to see.

According to the liquid crystal driver of the present invention, either in the case where the liquid crystal driver is arranged in a transverse or horizontal direction of a liquid crystal panel or in the case where the liquid crystal driver is arranged in a longitudinal or vertical direction of the liquid crystal panel, a bit map seen from a CPU is such that respective data bits on the same address are arranged in the transverse direction of the liquid crystal panel. Therefore, it is possible to use the liquid crystal driver without changing the address/data management of a system for the transverse or longitudinal arrangement of the liquid crystal driver. Accordingly, it is possible to perform an updating access at a high speed.

According to the present invention, since a plurality of liquid crystal drivers can be used, it is possible to drive liquid crystal panels with various screen sizes or areas of small size to large size having different resolving powers.

What is claimed is:

1. An information processing system comprising:

a central processing unit;

a bus coupled to said central processing unit; and a display apparatus coupled to said bus, said display apparatus including a display panel including a plurality of data lines and a plurality of scanning lines in a matrix form, a plurality of signal drivers for supplying driving voltages corresponding to display data to said plurality of data lines to display an image, each of said signal drivers including a display memory for storing said display data and being constructed in an integrated circuit, and a scanning driver for scanning said plurality of scanning lines;

wherein said central processing unit transfers said display data via said bus to said display memory; and wherein each of said plurality of said signal drivers includes a terminal, to which a driver identifier (ID) is inputted, said driver ID indicating a position of said each of said plurality of said signal drivers in the horizontal direction of said display panel.

* * * * *